US011493034B2

(12) United States Patent
Kidd et al.

(10) Patent No.: US 11,493,034 B2
(45) Date of Patent: Nov. 8, 2022

(54) METHOD OF CONTROLLING A PUMP AND MOTOR

(71) Applicant: Pentair Flow Technologies, LLC, Delavan, WI (US)

(72) Inventors: Melissa Drechsel Kidd, Coral Springs, FL (US); William James Genaw, Duluth, GA (US); Micheal Pasche, Sharon, WI (US); Gary T. Baase, II, Kenosha, WI (US)

(73) Assignee: Pentair Flow Technologies, LLC, Delavan, WI (US)

( * ) Notice: Subject to any disclaimer, the term of this patent is extended or adjusted under 35 U.S.C. 154(b) by 170 days.

(21) Appl. No.: 16/694,575

(22) Filed: Nov. 25, 2019

(65) Prior Publication Data

US 2020/0088189 A1 Mar. 19, 2020

Related U.S. Application Data

(63) Continuation of application No. 15/421,251, filed on Jan. 31, 2017, now Pat. No. 10,590,926, which is a (Continued)

(51) Int. Cl.
*F04B 49/08* (2006.01)
*F04D 15/00* (2006.01)

(Continued)

(52) U.S. Cl.
CPC ..... *F04B 49/08* (2013.01); *F04B 17/03* (2013.01); *F04B 47/06* (2013.01); *F04B 49/06* (2013.01);

(Continued)

(58) Field of Classification Search
CPC .. F04D 15/0066; F04D 13/08; F04D 15/0209; F04D 15/0236; F04D 15/0088;

(Continued)

(56) References Cited

U.S. PATENT DOCUMENTS 981,213 A 1/1911 Mollitor
1,061,919 A 5/1913 Miller (Continued)

FOREIGN PATENT DOCUMENTS

AU 2007332716 A1 6/2008
AU 2007332769 A1 6/2008

(Continued)

OTHER PUBLICATIONS

1—Complaint Filed by Pentair Water Pool & Spa, Inc. and Danfoss Drives NS with respect to Civil Action No. 5:11-cv-00459-D; Aug. 31, 2011.

(Continued)

*Primary Examiner* — Peter J Bertheaud
(74) *Attorney, Agent, or Firm* — Husch Blackwell LLP

(57) ABSTRACT

A variable frequency drive system and a method of controlling a pump driven by a motor with the pump in fluid communication with a fluid system is provided. The method includes monitoring a pressure in the fluid system, monitoring and adjusting an operating frequency of the motor to maintain the pressure at a pressure set point, and, based on the monitored operating frequency, causing the pump to temporarily boost the pressure in the fluid system to a temporary boost set point for a first time period. The method also includes determining whether the temporarily boosted pressure in the fluid system stays above the pressure set point for a second time period and causing the pump to enter a sleep mode when the temporarily boosted pressure stays above the pressure set point through the second time period.

20 Claims, 63 Drawing Sheets

Related U.S. Application Data continuation of application No. 12/481,435, filed on Jun. 9, 2009, now Pat. No. 9,556,874.

(51) Int. Cl.

| | |
|---|---|
| ***F04B 49/06*** | (2006.01) |
| ***F04D 13/08*** | (2006.01) |
| ***F04B 17/03*** | (2006.01) |
| ***F04D 13/10*** | (2006.01) |
| ***F04D 15/02*** | (2006.01) |
| ***F04B 47/06*** | (2006.01) |
| *F04B 49/10* | (2006.01) |
| *F04B 47/00* | (2006.01) |

(52) U.S. Cl.

CPC ..... *F04B 49/065* (2013.01); *F04D 13/08* (2013.01); *F04D 13/10* (2013.01); *F04D 15/0066* (2013.01); *F04D 15/0088* (2013.01); *F04D 15/0209* (2013.01); *F04D 15/0236* (2013.01); *F04B 47/00* (2013.01); *F04B 49/10* (2013.01); *F04B 2203/0204* (2013.01); *F04B 2205/04* (2013.01); *F04B 2205/05* (2013.01); *F04D 15/0077* (2013.01); *F04D 15/0254* (2013.01)

(58) Field of Classification Search

CPC .. F04D 13/10; F04D 15/0077; F04D 15/0254; F04B 49/065; F04B 49/10; F04B 47/06; F04B 2205/04; F04B 2205/05; F04B 49/08; F04B 2203/0204; F04B 47/00

See application file for complete search history.

(56) References Cited

U.S. PATENT DOCUMENTS 1,977,394 A 10/1934 McCormick
1,993,267 A 3/1935 Ferguson
2,131,304 A 9/1938 Shaw
2,238,597 A 4/1941 Page
2,458,006 A 1/1949 Kilgore
2,488,365 A 11/1949 Abbott et al.
2,494,200 A 1/1950 Ramqvist
2,615,937 A 10/1952 Ludwig et al.
2,716,195 A 8/1955 Anderson
2,767,277 A 10/1956 Wirth
2,778,958 A 1/1957 Hamm et al.
2,881,337 A 4/1959 Wall
3,116,445 A 12/1963 Wright
3,191,935 A 6/1965 Decker
3,204,423 A 9/1965 Resh, Jr.
3,226,620 A 12/1965 Elliott et al.
3,227,808 A 1/1966 Morris et al.
3,291,058 A 12/1966 McFarlin
3,316,843 A 5/1967 Vaughan
3,481,973 A 12/1969 Arons et al.
3,530,348 A 9/1970 Conner
3,558,910 A 1/1971 Dale et al.
3,559,731 A 2/1971 Stafford
3,562,614 A 2/1971 Gramkow
3,566,225 A 2/1971 Poulsen
3,573,579 A 4/1971 Lewus
3,581,895 A 6/1971 Howard et al.
3,593,081 A 7/1971 Forst
3,594,623 A 7/1971 Lamaster
3,596,158 A 7/1971 Watrous
3,613,805 A 10/1971 Lindstad et al.
3,624,470 A 11/1971 Johnson
3,634,842 A 1/1972 Niedermeyer
3,652,912 A 3/1972 Bordonaro
3,671,830 A 6/1972 Kruper
3,726,606 A 4/1973 Peters
3,735,233 A 5/1973 Ringle
3,737,749 A 6/1973 Schmit
3,753,072 A 8/1973 Jurgens
3,761,750 A 9/1973 Green
3,761,792 A 9/1973 Whitney et al.
3,777,232 A 12/1973 Woods et al.
3,777,804 A 12/1973 McCoy
3,778,804 A 12/1973 Adair
3,780,759 A 12/1973 Yahle
3,781,925 A 1/1974 Curtis et al.
3,787,882 A 1/1974 West et al.
3,792,324 A 2/1974 Suarfz et al.
3,800,205 A 3/1974 Zalar
3,814,544 A 6/1974 Roberts et al.
3,838,597 A 10/1974 Montgomery et al.
3,867,071 A 2/1975 Hartley
3,882,364 A 5/1975 Wright
3,902,369 A 9/1975 Metz
3,910,725 A 10/1975 Rule
3,913,342 A 10/1975 Barry
3,916,274 A 10/1975 Lewus
3,941,507 A 3/1976 Niedermeyer
3,949,782 A 4/1976 Athey et al.
3,953,777 A 4/1976 McKee
3,956,760 A 5/1976 Edwards
3,963,375 A 6/1976 Curtis
3,972,647 A 8/1976 Niedermeyer
3,976,919 A 8/1976 Vandevier et al.
3,987,240 A 10/1976 Schultz
4,000,446 A 12/1976 Vandevier et al.
4,021,700 A 5/1977 Ellis-Anwyl
4,030,450 A 6/1977 David
4,041,470 A 8/1977 Slane et al.
4,061,442 A 12/1977 Clark et al.
4,087,204 A 5/1978 Niedermeyer
4,108,574 A 8/1978 Bartley et al.
4,123,792 A 10/1978 Gephart et al.
4,133,058 A 1/1979 Baker
4,142,415 A 3/1979 Jung et al.
4,151,080 A 4/1979 Zuckerman et al.
4,157,728 A 6/1979 Mitamura et al.
4,168,413 A 9/1979 Halpine
4,169,377 A 10/1979 Scheib
4,182,363 A 1/1980 Fuller
4,185,187 A 1/1980 Rogers
4,187,503 A 2/1980 Walton
4,206,634 A 6/1980 Taylor et al.
4,215,975 A 8/1980 Niedermeyer
4,222,711 A 9/1980 Mayer
4,225,290 A 9/1980 Allington
4,228,427 A 10/1980 Niedermeyer
4,233,553 A 11/1980 Prince et al.
4,241,299 A 12/1980 Bertone
4,255,747 A 3/1981 Bunia
4,263,535 A 4/1981 Jones
4,276,454 A 6/1981 Zathan
4,286,303 A 8/1981 Genheimer et al.
4,303,203 A 12/1981 Avery
4,307,327 A 12/1981 Streater et al.
4,309,157 A 1/1982 Niedermeyer
4,314,478 A 2/1982 Beaman
4,319,712 A 3/1982 Bar
4,322,297 A 3/1982 Bajka
4,330,412 A 5/1982 Frederick
4,332,527 A 6/1982 Moldovan et al.
4,353,220 A 10/1982 Curwen et al.
4,366,426 A 12/1982 Turlej
4,369,438 A 1/1983 Wilhelmi
4,370,098 A 1/1983 McClain et al.
4,370,690 A 1/1983 Baker
4,371,315 A 2/1983 Shikasho
4,375,613 A 3/1983 Fuller et al.
4,384,825 A 5/1983 Thomas et al.
4,394,262 A 7/1983 Bukowski et al.
4,399,394 A 8/1983 Ballman
4,402,094 A 9/1983 Sanders
4,409,532 A 10/1983 Hollenbeck et al.
4,419,625 A 12/1983 Bejot et al.
4,420,787 A 12/1983 Tibbits et al.
4,421,643 A 12/1983 Frederick
4,421,653 A 12/1983 Le Dain et al.

(56) References Cited

U.S. PATENT DOCUMENTS 4,425,836 A 1/1984 Pickrell
4,427,545 A 1/1984 Arguilez
4,428,434 A 1/1984 Gelaude
4,429,343 A 1/1984 Freud
4,437,133 A 3/1984 Rueckert
4,448,072 A 5/1984 Tward
4,449,260 A 5/1984 Whitaker
4,453,118 A 6/1984 Phillips et al.
4,456,432 A 6/1984 Mannino
4,462,758 A 7/1984 Speed
4,463,304 A 7/1984 Miller
4,468,604 A 8/1984 Zaderej
4,470,092 A 9/1984 Lombardi
4,473,338 A 9/1984 Garmong
4,494,180 A 1/1985 Streater et al.
4,496,895 A 1/1985 Kawate et al.
4,504,773 A 3/1985 Suzuki et al.
4,505,643 A 3/1985 Millis et al.
D278,529 S 4/1985 Hoogner
4,514,989 A 5/1985 Mount
4,520,303 A 5/1985 Ward
4,529,359 A 7/1985 Sloan
4,541,029 A 9/1985 Ohyama
4,545,906 A 10/1985 Frederick
4,552,512 A 11/1985 Gallup et al.
4,564,041 A 1/1986 Kramer
4,564,882 A 1/1986 Baxter et al.
4,581,900 A 4/1986 Lowe et al.
4,604,563 A 8/1986 Min
4,605,888 A 8/1986 Kim
4,610,605 A 9/1986 Hartley
4,620,835 A 11/1986 Bell
4,622,506 A 11/1986 Shemanske et al.
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller
4,670,697 A 6/1987 Wrege et al.
4,676,914 A 6/1987 Mills et al.
4,678,404 A 7/1987 Lorett et al.
4,678,409 A 7/1987 Kurokawa
4,686,439 A 8/1987 Cunningham et al.
4,695,779 A 9/1987 Yates
4,697,464 A 10/1987 Martin
4,703,387 A 10/1987 Miller
4,705,629 A 11/1987 Weir et al.
4,716,605 A 1/1988 Shepherd et al.
4,719,399 A 1/1988 Wrege
4,728,882 A 3/1988 Stanbro et al.
4,751,449 A 6/1988 Chmiel
4,751,450 A 6/1988 Lorenz et al.
4,758,697 A 7/1988 Jeuneu
4,761,601 A 8/1988 Zaderej
4,764,417 A 8/1988 Gulya
4,764,714 A 8/1988 Alley et al.
4,766,329 A 8/1988 Santiago
4,767,280 A 8/1988 Markuson et al.
4,780,050 A 10/1988 Caine et al.
4,781,525 A 11/1988 Hubbard et al.
4,782,278 A 11/1988 Bossi et al.
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis et al.
4,806,457 A 2/1989 Yanagisawa
4,820,964 A 4/1989 Kadah
4,827,197 A 5/1989 Giebeler
4,834,624 A 5/1989 Jensen et al.
4,837,656 A 6/1989 Barnes
4,839,571 A 6/1989 Farnham et al.
4,841,404 A 6/1989 Marshall et al.
4,843,295 A 6/1989 Thompson et al.
4,862,053 A 8/1989 Jordan et al.
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi et al.
4,958,118 A 9/1990 Pottebaum
4,963,778 A 10/1990 Jensen et al.
4,967,131 A 10/1990 Kim
4,971,522 A 11/1990 Butlin
4,975,798 A 12/1990 Edwards et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A 5/1991 Snyder, Jr. et al.
5,015,152 A 5/1991 Greene
5,017,853 A 5/1991 Chmiel
5,026,256 A 6/1991 Kuwabara et al.
5,028,854 A 7/1991 Moline
5,041,771 A 8/1991 Min
5,051,068 A 9/1991 Wong
5,051,681 A 9/1991 Schwarz
5,076,761 A 12/1991 Krohn et al.
5,076,763 A 12/1991 Anastos et al.
5,079,784 A 1/1992 Rist et al.
5,091,817 A 2/1992 Alley et al.
5,098,023 A 3/1992 Burke
5,099,181 A 3/1992 Canon
5,100,298 A 3/1992 Shibata et al.
RE33,874 E 4/1992 Miller
5,103,154 A 4/1992 Dropps et al.
5,117,233 A 5/1992 Hamos et al.
5,123,080 A 6/1992 Gillett et al.
5,129,264 A 7/1992 Lorenc
5,135,359 A 8/1992 Dufresne
5,145,323 A 9/1992 Farr
5,151,017 A 9/1992 Sears et al.
5,154,821 A 10/1992 Reid
5,156,535 A 10/1992 Budris et al.
5,158,436 A 10/1992 Jensen et al.
5,159,713 A 10/1992 Gaskill et al.
5,164,651 A 11/1992 Hu et al.
5,166,595 A 11/1992 Leverich
5,167,041 A 12/1992 Burkitt
5,172,089 A 12/1992 Wright et al.
D334,542 S 4/1993 Lowe et al.
5,206,573 A 4/1993 McCleer et al.
5,213,477 A 5/1993 Watanabe et al.
5,222,867 A 6/1993 Walker, Sr. et al.
5,234,286 A 8/1993 Wagner
5,234,319 A 8/1993 Wilder
5,235,235 A 8/1993 Martin et al.
5,238,369 A 8/1993 Farr
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier et al.
5,295,790 A 3/1994 Bossart et al.
5,295,857 A 3/1994 Toly
5,296,795 A 3/1994 Dropps et al.
5,302,885 A 4/1994 Schwarz et al.
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.
5,360,320 A 11/1994 Jameson et al.
5,361,215 A 11/1994 Tompkins et al.

(56) References Cited

U.S. PATENT DOCUMENTS 5,363,912 A 11/1994 Wolcott
5,394,748 A 3/1995 McCarthy
5,418,984 A 5/1995 Livingston, Jr.
D359,458 S 6/1995 Pierret et al.
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi et al.
5,449,274 A 9/1995 Kochan
5,449,997 A 9/1995 Gilmore et al.
5,450,316 A 9/1995 Gaudet et al.
D363,060 S 10/1995 Hunger et al.
5,457,373 A 10/1995 Heppe et al.
5,457,826 A 10/1995 Haraga et al.
5,466,995 A 11/1995 Genga
5,469,215 A 11/1995 Nashiki
5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein et al.
5,519,848 A 5/1996 Wloka et al.
5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous et al.
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill et al.
5,550,497 A 8/1996 Carobolante
5,550,753 A 8/1996 Tompkins et al.
5,559,418 A 9/1996 Burkhart
5,559,720 A 9/1996 Tompkins et al.
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker et al.
5,570,481 A 11/1996 Mathis et al.
5,571,000 A 11/1996 Zimmermann et al.
5,577,890 A 11/1996 Nielsen et al.
5,580,221 A 12/1996 Triezenberg
5,582,017 A 12/1996 Noji et al.
5,587,899 A 12/1996 Ho et al.
5,589,076 A 12/1996 Womack
5,589,753 A 12/1996 Kadah et al.
5,592,062 A 1/1997 Bach
5,598,080 A 1/1997 Jensen et al.
5,601,413 A 2/1997 Langley et al.
5,604,491 A 2/1997 Coonley et al.
5,614,812 A 3/1997 Wagoner
5,616,239 A 4/1997 Wendell et al.
5,618,460 A 4/1997 Fowler et al.
5,622,223 A 4/1997 Vasquez
5,624,237 A 4/1997 Prescott et al.
5,626,464 A 5/1997 Schoenmeyr et al.
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,620 A 8/1997 Langhorst
5,669,323 A 9/1997 Pritchard
5,672,050 A 9/1997 Webber et al.
5,682,624 A 11/1997 James
5,690,476 A 11/1997 Miller
5,708,337 A 1/1998 Breit et al.
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A 3/1998 Sterghos et al.
5,731,673 A 3/1998 Gilmore
5,736,884 A 4/1998 Ettes et al.
5,739,648 A 4/1998 Ellis et al.
5,744,921 A 4/1998 Makaran
5,752,785 A 5/1998 Tanaka et al.
5,754,036 A 5/1998 Walker
5,754,421 A 5/1998 Nystrom
5,763,969 A 6/1998 Metheny et al.
5,767,606 A 6/1998 Bresolin
5,777,833 A 7/1998 Romillon
5,780,992 A 7/1998 Beard
5,791,882 A 8/1998 Stucker et al.
5,796,234 A 8/1998 Vrionis
5,799,643 A 9/1998 Miyata et al.
5,802,910 A 9/1998 Krahn et al.
5,804,080 A 9/1998 Klingenberger
5,808,441 A 9/1998 Nehring
5,814,966 A 9/1998 Williamson et al.
5,818,708 A 10/1998 Wong
5,818,714 A 10/1998 Zou et al.
5,819,848 A 10/1998 Rasmuson et al.
5,820,350 A 10/1998 Mantey et al.
5,828,200 A 10/1998 Ligman et al.
5,833,437 A 11/1998 Kurth et al.
5,836,271 A 11/1998 Sasaki et al.
5,845,225 A 12/1998 Mosher
5,856,783 A 1/1999 Gibb
5,863,185 A 1/1999 Cochimin et al.
5,883,489 A 3/1999 Konrad
5,884,205 A 3/1999 Elmore et al.
5,892,349 A 4/1999 Bogwicz et al.
5,894,609 A 4/1999 Barnett
5,898,958 A 5/1999 Hall
5,906,479 A 5/1999 Hawes
5,907,281 A 5/1999 Miller et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad et al.
5,946,469 A 8/1999 Chidester
5,947,689 A 9/1999 Schick
5,947,700 A 9/1999 McKain et al.
5,959,431 A 9/1999 Xiang
5,959,534 A 9/1999 Campbell et al.
5,961,291 A 10/1999 Sakagami et al.
5,963,706 A 10/1999 Baik
5,969,958 A 10/1999 Nielsen et al.
5,973,465 A 10/1999 Rayner
5,973,473 A 10/1999 Anderson et al.
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasmussen
6,043,461 A 3/2000 Holling et al.
6,045,331 A 4/2000 Gehm et al.
6,045,333 A 4/2000 Breit
6,046,492 A 4/2000 Machida et al.
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen
6,080,973 A 6/2000 Thweatt
6,081,751 A 6/2000 Luo et al.
6,091,604 A 7/2000 Plougsgaard
6,092,992 A 7/2000 Imblum et al.

(56) References Cited

U.S. PATENT DOCUMENTS 6,094,026 A 7/2000 Cameron
D429,699 S 8/2000 Davis et al.
D429,700 S 8/2000 Liebig
6,094,764 A 8/2000 Veloskey et al.
6,098,654 A 8/2000 Cohen et al.
6,102,665 A 8/2000 Centers et al.
6,116,040 A 9/2000 Stark
6,119,707 A 9/2000 Jordan
6,121,746 A 9/2000 Fisher et al.
6,121,749 A 9/2000 Wills et al.
6,125,481 A 10/2000 Sicilano
6,125,883 A 10/2000 Creps et al.
6,142,741 A 11/2000 Nishihata et al.
6,146,108 A 11/2000 Mullendore
6,150,776 A 11/2000 Potter et al.
6,157,304 A 12/2000 Bennett et al.
6,164,132 A 12/2000 Matulek
6,171,073 B1 1/2001 McKain et al.
6,178,393 B1 1/2001 Irvin
6,184,650 B1 2/2001 Gelbman
6,188,200 B1 2/2001 Maiorano
6,198,257 B1 3/2001 Belehradek et al.
6,199,224 B1 3/2001 Versland
6,203,282 B1 3/2001 Morin
6,208,112 B1 3/2001 Jensen et al.
6,212,956 B1 4/2001 Donald et al.
6,213,724 B1 4/2001 Haugen et al.
6,216,814 B1 4/2001 Fujita et al.
6,222,355 B1 4/2001 Ohshima et al.
6,227,808 B1 5/2001 McDonough
6,232,742 B1 5/2001 Wacknov et al.
6,236,177 B1 5/2001 Zick et al.
6,238,188 B1 5/2001 Lifson
6,247,429 B1 6/2001 Hara et al.
6,249,435 B1 6/2001 Vicente et al.
6,251,285 B1 6/2001 Ciochetti
6,253,227 B1 6/2001 Tompkins et al.
D445,405 S 7/2001 Schneider et al.
6,254,353 B1 7/2001 Polo et al.
6,257,304 B1 7/2001 Jacobs et al.
6,257,833 B1 7/2001 Bates
6,259,617 B1 7/2001 Wu
6,264,431 B1 7/2001 Triezenberg
6,264,432 B1 7/2001 Kilayko et al.
6,280,611 B1 8/2001 Henkin et al.
6,282,370 B1 8/2001 Cline et al.
6,298,721 B1 10/2001 Schuppe et al.
6,299,414 B1 10/2001 Schoenmeyr
6,299,699 B1 10/2001 Porat et al.
6,318,093 B2 11/2001 Gaudet et al.
6,320,348 B1 11/2001 Kadah
6,322,710 B1 11/2001 Katsumata et al.
6,326,752 B1 12/2001 Jensen et al.
6,329,784 B1 12/2001 Puppin et al.
6,330,525 B1 12/2001 Hays et al.
6,342,841 B1 1/2002 Stingl
6,349,268 B1 2/2002 Ketonen et al.
6,350,105 B1 2/2002 Kobayashi et al.
6,351,359 B1 2/2002 Jæger
6,354,805 B1 3/2002 Møller
6,355,177 B2 3/2002 Senner et al.
6,356,464 B1 3/2002 Balakrishnan et al.
6,356,853 B1 3/2002 Sullivan
6,362,591 B1 3/2002 Moberg
6,364,620 B1 4/2002 Fletcher et al.
6,364,621 B1 4/2002 Yamauchi
6,366,053 B1 4/2002 Belehradek
6,366,481 B1 4/2002 Balakrishnan et al.
6,369,463 B1 4/2002 Maiorano
6,373,204 B1 4/2002 Peterson et al.
6,373,728 B1 4/2002 Aarestrup
6,374,854 B1 4/2002 Acosta
6,375,430 B1 4/2002 Eckert et al.
6,380,707 B1 4/2002 Rosholm et al.
6,388,642 B1 5/2002 Cotis
6,390,781 B1 5/2002 McDonough
6,406,265 B1 6/2002 Hahn et al.
6,407,469 B1 6/2002 Cline et al.
6,411,481 B1 6/2002 Seubert
6,415,808 B2 7/2002 Joshi
6,416,295 B1 7/2002 Nagai et al.
6,426,633 B1 7/2002 Thybo
6,443,715 B1 9/2002 Mayleben et al.
6,445,565 B1 9/2002 Toyoda et al.
6,447,446 B1 9/2002 Smith et al.
6,448,713 B1 9/2002 Farkas et al.
6,450,771 B1 9/2002 Centers et al.
6,462,971 B1 10/2002 Balakrishnan et al.
6,464,464 B2 10/2002 Sabini et al.
6,468,042 B2 10/2002 Møller
6,468,052 B2 10/2002 McKain et al.
6,474,949 B1 11/2002 Arai et al.
6,475,180 B2 11/2002 Peterson et al.
6,481,973 B1 11/2002 Struthers
6,483,278 B2 11/2002 Harvest
6,483,378 B2 11/2002 Blodgett
6,490,920 B1 12/2002 Netzer
6,493,227 B2 12/2002 Nielsen et al.
6,496,392 B2 12/2002 Odell
6,499,961 B1 12/2002 Wyatt et al.
6,501,629 B1 12/2002 Marriott
6,503,063 B1 1/2003 Brunsell
6,504,338 B1 1/2003 Eichorn
6,520,010 B1 2/2003 Bergveld et al.
6,522,034 B1 2/2003 Nakayama
6,523,091 B2 2/2003 Mala et al.
6,527,518 B2 3/2003 Ostrowski
6,534,940 B2 3/2003 Bell et al.
6,534,947 B2 3/2003 Johnson et al.
6,537,032 B1 3/2003 Horiuchi et al.
6,538,908 B2 3/2003 Balakrishnan et al.
6,539,797 B2 4/2003 Livingston et al.
6,543,940 B2 4/2003 Chu
6,548,976 B2 4/2003 Jensen et al.
6,564,627 B1 5/2003 Sabini et al.
6,570,778 B2 5/2003 Lipo et al.
6,590,188 B2 7/2003 Cline et al.
6,591,697 B2 7/2003 Henyan
6,591,863 B2 7/2003 Ruschell et al.
6,592,708 B2 7/2003 Vanell
6,595,051 B1 7/2003 Chandler
6,595,762 B2 7/2003 Khanwilkar et al.
6,604,909 B2 8/2003 Schoenmeyr
6,607,360 B2 8/2003 Fong
6,616,413 B2 9/2003 Humpheries
6,623,245 B2 9/2003 Meza et al.
6,625,824 B1 9/2003 Lutz et al.
6,628,501 B2 9/2003 Toyoda
6,632,072 B2 10/2003 Lipscomb et al.
6,636,135 B1 10/2003 Veiier
6,638,023 B2 10/2003 Scott
D482,664 S 11/2003 Hunt et al.
6,643,153 B2 11/2003 Balakrishnan et al.
6,651,900 B1 11/2003 Yoshida
6,655,922 B1 12/2003 Flek
6,663,349 B1 12/2003 Discenzo et al.
6,665,200 B2 12/2003 Goto et al.
6,672,147 B1 1/2004 Mazet
6,675,912 B2 1/2004 Carrier
6,676,382 B2 1/2004 Leighton et al.
6,676,831 B2 1/2004 Wolfe
6,687,141 B2 2/2004 Odell
6,687,923 B2 2/2004 Dick et al.
6,690,250 B2 2/2004 Møller
6,696,676 B1 2/2004 Graves et al.
6,700,333 B1 3/2004 Hirshi et al.
6,709,240 B1 3/2004 Schmalz et al.
6,709,241 B2 3/2004 Sabini et al.
6,709,575 B1 3/2004 Verdegan et al.
6,715,996 B2 4/2004 Moeller
6,717,318 B1 4/2004 Mathiassen
6,732,387 B1 5/2004 Waldron
6,737,905 B1 5/2004 Noda et al.
D490,726 S 6/2004 Eungprabhanth et al.

(56) References Cited

U.S. PATENT DOCUMENTS

| | | | |
|---|---|---|---|
| 6,742,387 | B2 | 6/2004 | Hamamoto et al. |
| 6,747,367 | B2 | 6/2004 | Cline et al. |
| 6,758,655 | B2 | 7/2004 | Sacher |
| 6,761,067 | B1 | 7/2004 | Capano |
| 6,768,279 | B1 | 7/2004 | Skinner et al. |
| 6,770,043 | B1 | 8/2004 | Kahn |
| 6,774,664 | B2 | 8/2004 | Godbersen |
| 6,776,038 | B1 | 8/2004 | Horton et al. |
| 6,776,584 | B2 | 8/2004 | Sabini et al. |
| 6,778,868 | B2 | 8/2004 | Imamura et al. |
| 6,779,205 | B2 | 8/2004 | Mulvey et al. |
| 6,782,309 | B2 | 8/2004 | Laflamme et al. |
| 6,783,328 | B2 | 8/2004 | Lucke et al. |
| 6,789,024 | B1 | 9/2004 | Kochan et al. |
| 6,794,921 | B2 | 9/2004 | Abe et al. |
| 6,797,164 | B2 | 9/2004 | Leaverton |
| 6,798,271 | B2 | 9/2004 | Swize |
| 6,799,950 | B2 | 10/2004 | Meier et al. |
| 6,806,677 | B2 | 10/2004 | Kelly et al. |
| 6,837,688 | B2 | 1/2005 | Kimberlin et al. |
| 6,842,117 | B2 | 1/2005 | Keown |
| 6,847,130 | B1 | 1/2005 | Belehradek et al. |
| 6,847,854 | B2 | 1/2005 | Discenzo |
| 6,854,479 | B2 | 2/2005 | Harwood |
| 6,863,502 | B2 | 3/2005 | Bishop et al. |
| 6,867,383 | B1 | 3/2005 | Currier |
| 6,875,961 | B1 | 4/2005 | Collins |
| 6,882,165 | B2 | 4/2005 | Ogura |
| 6,884,022 | B2 | 4/2005 | Albright et al. |
| D504,900 | S | 5/2005 | Wang |
| D505,429 | S | 5/2005 | Wang |
| 6,888,537 | B2 | 5/2005 | Benson et al. |
| 6,895,608 | B2 | 5/2005 | Goettl |
| 6,900,736 | B2 | 5/2005 | Crumb |
| 6,906,482 | B2 | 6/2005 | Shimizu et al. |
| D507,243 | S | 7/2005 | Miller |
| 6,914,793 | B2 | 7/2005 | Balakrishnan et al. |
| 6,922,348 | B2 | 7/2005 | Nakajima et al. |
| 6,925,823 | B2 | 8/2005 | Lifson et al. |
| 6,933,693 | B2 | 8/2005 | Schuchmann |
| 6,941,785 | B2 | 9/2005 | Haynes et al. |
| 6,943,325 | B2 | 9/2005 | Pittman et al. |
| D511,530 | S | 11/2005 | Wang |
| 6,965,815 | B1 | 11/2005 | Tompkins et al. |
| 6,966,967 | B2 | 11/2005 | Curry et al. |
| D512,440 | S | 12/2005 | Wang |
| 6,973,794 | B2 | 12/2005 | Street et al. |
| 6,973,974 | B2 | 12/2005 | McLoughlin et al. |
| 6,976,052 | B2 | 12/2005 | Tompkins et al. |
| D513,737 | S | 1/2006 | Riley |
| 6,981,399 | B1 | 1/2006 | Nybo et al. |
| 6,981,402 | B2 | 1/2006 | Bristol |
| 6,984,158 | B2 | 1/2006 | Satoh et al. |
| 6,993,414 | B2 | 1/2006 | Shah |
| 6,998,807 | B2 | 2/2006 | Phillips et al. |
| 6,998,977 | B2 | 2/2006 | Gregori et al. |
| 7,005,818 | B2 | 2/2006 | Jensen |
| 7,012,394 | B2 | 3/2006 | Moore et al. |
| 7,015,599 | B2 | 3/2006 | Gull et al. |
| 7,040,107 | B2 | 5/2006 | Lee et al. |
| 7,042,192 | B2 | 5/2006 | Mehlhorn |
| 7,050,278 | B2 | 5/2006 | Poulsen |
| D523,026 | S | 6/2006 | Vaughn |
| 7,055,189 | B2 | 6/2006 | Goettl |
| 7,070,134 | B1 | 7/2006 | Hoyer |
| 7,077,781 | B2 | 7/2006 | Ishikawa et al. |
| 7,080,508 | B2 | 7/2006 | Stavale et al. |
| 7,081,728 | B2 | 7/2006 | Kemp |
| 7,083,392 | B2 | 8/2006 | Meza et al. |
| 7,083,438 | B2 | 8/2006 | Massaro et al. |
| 7,089,607 | B2 | 8/2006 | Barnes et al. |
| 7,100,632 | B2 | 9/2006 | Harwood |
| 7,102,505 | B2 | 9/2006 | Kates |
| 7,107,184 | B2 | 9/2006 | Gentile et al. |
| 7,112,037 | B2 | 9/2006 | Sabini et al. |
| 7,114,926 | B2 | 10/2006 | Oshita et al. |
| 7,117,120 | B2 | 10/2006 | Beck et al. |
| 7,141,210 | B2 | 11/2006 | Bell et al. |
| 7,142,932 | B2 | 11/2006 | Spira et al. |
| D533,512 | S | 12/2006 | Nakashima et al. |
| 7,163,380 | B2 | 1/2007 | Jones |
| 7,172,366 | B1 | 2/2007 | Bishop, Jr. |
| 7,174,273 | B2 | 2/2007 | Goldberg |
| 7,178,179 | B2 | 2/2007 | Barnes |
| 7,183,741 | B2 | 2/2007 | Mehlhorn |
| 7,195,462 | B2 | 3/2007 | Nybo et al. |
| 7,201,563 | B2 | 4/2007 | Studebaker |
| 7,221,121 | B2 | 5/2007 | Skaug et al. |
| 7,244,106 | B2 | 7/2007 | Kallman et al. |
| 7,245,105 | B2 | 7/2007 | Joo et al. |
| 7,259,533 | B2 | 8/2007 | Yang et al. |
| 7,264,449 | B1 | 9/2007 | Harned et al. |
| 7,281,958 | B2 | 10/2007 | Schuttler et al. |
| 7,292,898 | B2 | 11/2007 | Clark et al. |
| 7,307,538 | B2 | 12/2007 | Kochan, Jr. |
| 7,309,216 | B1 | 12/2007 | Spadola, Jr. et al. |
| 7,318,344 | B2 | 1/2008 | Heger |
| D562,349 | S | 2/2008 | Bulter |
| 7,327,275 | B2 | 2/2008 | Brochu et al. |
| 7,339,126 | B1 | 3/2008 | Niedermeyer |
| D567,189 | S | 4/2008 | Stiles, Jr. et al. |
| 7,352,550 | B2 | 4/2008 | Mladenik et al. |
| 7,375,940 | B1 | 5/2008 | Bertrand |
| 7,388,348 | B2 | 6/2008 | Mattichak |
| 7,407,371 | B2 | 8/2008 | Leone et al. |
| 7,427,844 | B2 | 9/2008 | Mehlhorn |
| 7,429,842 | B2 | 9/2008 | Schulman et al. |
| 7,437,215 | B2 | 10/2008 | Anderson et al. |
| D582,797 | S | 12/2008 | Fraser et al. |
| D583,828 | S | 12/2008 | Li et al. |
| 7,458,782 | B1 | 12/2008 | Spadola, Jr. et al. |
| 7,459,886 | B1 | 12/2008 | Potanin et al. |
| 7,484,939 | B2 | 2/2009 | Hansen |
| 7,516,106 | B2 | 4/2009 | Ehlers et al. |
| 7,517,351 | B2 | 4/2009 | Culp et al. |
| 7,525,280 | B2 | 4/2009 | Fagan et al. |
| 7,528,579 | B2 | 5/2009 | Pacholok et al. |
| 7,542,251 | B2 | 6/2009 | Ivankovic |
| 7,542,252 | B2 | 6/2009 | Chan et al. |
| 7,572,108 | B2 | 8/2009 | Koehl |
| 7,612,529 | B2 | 11/2009 | Kochan, Jr. |
| 7,623,986 | B2 | 11/2009 | Miller |
| 7,641,449 | B2 | 1/2010 | Iimura et al. |
| 7,652,441 | B2 | 1/2010 | Ying Yin Ho |
| 7,686,587 | B2 | 3/2010 | Koehl |
| 7,690,897 | B2 | 4/2010 | Branecky et al. |
| 7,700,887 | B2 | 4/2010 | Niedermeyer |
| 7,704,051 | B2 | 4/2010 | Koehl |
| 7,707,125 | B2 | 4/2010 | Haji-Valizadeh |
| 7,727,181 | B2 | 6/2010 | Rush |
| 7,746,063 | B2 | 6/2010 | Sabini et al. |
| 7,751,159 | B2 | 7/2010 | Koehl |
| 7,753,880 | B2 | 7/2010 | Malackowski |
| 7,755,318 | B1 | 7/2010 | Panosh |
| 7,775,327 | B2 | 8/2010 | Abraham et al. |
| 7,777,435 | B2 | 8/2010 | Aguilar et al. |
| 7,788,877 | B2 | 9/2010 | Andras |
| 7,793,733 | B2 | 9/2010 | Stewart |
| 7,795,824 | B2 | 9/2010 | Shen et al. |
| 7,808,211 | B2 | 10/2010 | Pacholok et al. |
| 7,815,420 | B2 | 10/2010 | Koehl |
| 7,821,215 | B2 | 10/2010 | Koehl |
| 7,854,597 | B2 | 12/2010 | Stiles, Jr. et al. |
| 7,857,600 | B2 | 12/2010 | Koehl |
| 7,874,808 | B2 | 1/2011 | Stiles |
| 7,878,766 | B2 | 2/2011 | Meza et al. |
| 7,900,308 | B2 | 3/2011 | Erlich et al. |
| 7,922,457 | B2 | 4/2011 | Lindsey et al. |
| 7,925,385 | B2 | 4/2011 | Stavale et al. |
| 7,931,447 | B2 | 4/2011 | Levin et al. |
| 7,945,411 | B2 | 5/2011 | Kernan et al. |
| 7,976,284 | B2 | 7/2011 | Koehl |
| 7,983,877 | B2 | 7/2011 | Koehl |
| 7,990,091 | B2 | 8/2011 | Koehl |

(56) References Cited

U.S. PATENT DOCUMENTS 8,007,255 B2 8/2011 Hattori et al.
8,011,895 B2 9/2011 Ruffo
8,019,479 B2 9/2011 Stiles et al.
8,032,256 B1 10/2011 Wolf et al.
8,043,070 B2 10/2011 Stiles, Jr. et al.
8,049,464 B2 11/2011 Muntermann
8,098,048 B2 1/2012 Hoff
8,104,110 B2 1/2012 Caudill et al.
8,126,574 B2 2/2012 Discenzo et al.
8,133,034 B2 3/2012 Mehlhorn et al.
8,134,336 B2 3/2012 Michalske et al.
8,164,470 B2 4/2012 Brochu et al.
8,177,520 B2 5/2012 Mehlhorn et al.
8,281,425 B2 10/2012 Cohen
8,299,662 B2 10/2012 Schmidt et al.
8,303,260 B2 11/2012 Stavale et al.
8,313,306 B2 11/2012 Stiles, Jr. et al.
8,316,152 B2 11/2012 Geltner et al.
8,317,485 B2 11/2012 Meza et al.
8,337,166 B2 12/2012 Meza et al.
8,361,313 B2 1/2013 Pancaldi et al.
8,380,355 B2 2/2013 Mayleben et al.
8,405,346 B2 3/2013 Trigiani
8,405,361 B2 3/2013 Richards et al.
8,444,394 B2 5/2013 Koehl
8,465,262 B2 6/2013 Stiles, Jr. et al.
8,469,675 B2 6/2013 Stiles, Jr. et al.
8,480,373 B2 7/2013 Stiles, Jr. et al.
8,500,413 B2 8/2013 Stiles, Jr. et al.
8,540,493 B2 9/2013 Koehl
8,547,065 B2 10/2013 Trigiani
8,573,952 B2 11/2013 Stiles, Jr. et al.
8,579,600 B2 11/2013 Vijayakumar
8,602,745 B2 12/2013 Stiles, Jr. et al.
8,641,383 B2 2/2014 Meza et al.
8,641,385 B2 2/2014 Koehl
8,669,494 B2 3/2014 Tran
8,756,991 B2 6/2014 Edwards
8,763,315 B2 7/2014 Hartman et al.
8,774,972 B2 7/2014 Rusnak et al.
8,801,389 B2 8/2014 Stiles, Jr. et al.
8,981,684 B2 3/2015 Drye et al.
9,030,066 B2 5/2015 Drye
9,051,930 B2 6/2015 Stiles, Jr. et al.
9,238,918 B2 1/2016 McKinzie
9,556,874 B2 1/2017 Kidd et al.
9,822,782 B2 11/2017 McKinzie
2001/0002238 A1 5/2001 McKain et al.
2001/0029407 A1 10/2001 Tompkins et al.
2001/0041139 A1 11/2001 Sabini et al.
2002/0000789 A1 1/2002 Haba
2002/0002989 A1 1/2002 Jones
2002/0010839 A1 1/2002 Tirumala et al.
2002/0018721 A1 2/2002 Kobayashi et al.
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0076330 A1 6/2002 Lipscomb et al.
2002/0082727 A1 6/2002 Laflamme et al.
2002/0089236 A1 7/2002 Cline et al.
2002/0093306 A1 7/2002 Johnson et al.
2002/0101193 A1 8/2002 Farkas et al.
2002/0111554 A1 8/2002 Drzewiecki et al.
2002/0131866 A1 9/2002 Phillips
2002/0136642 A1 9/2002 Moller
2002/0143478 A1 10/2002 Vanderah et al.
2002/0150476 A1 10/2002 Lucke et al.
2002/0163821 A1 11/2002 Odell
2002/0172055 A1 11/2002 Balakrishnan et al.
2002/0176783 A1 11/2002 Moeller
2002/0190687 A1 12/2002 Bell et al.
2003/0000303 A1 1/2003 Livingston et al.
2003/0017055 A1 1/2003 Fong
2003/0030954 A1 2/2003 Bax et al.
2003/0034284 A1 2/2003 Wolfe
2003/0034761 A1 2/2003 Goto et al.
2003/0048646 A1 3/2003 Odell
2003/0049134 A1 3/2003 Leighton et al.
2003/0051541 A1 3/2003 Kano et al.
2003/0061004 A1 3/2003 Discenzo
2003/0063900 A1 4/2003 Wang et al.
2003/0099548 A1 5/2003 Meza et al.
2003/0106147 A1 6/2003 Cohen et al.
2003/0138327 A1 7/2003 Jones et al.
2003/0174450 A1 9/2003 Nakajima et al.
2003/0186453 A1 10/2003 Bell et al.
2003/0196942 A1 10/2003 Jones
2004/0000525 A1 1/2004 Hornsby
2004/0006486 A1 1/2004 Schmidt et al.
2004/0009075 A1 1/2004 Meza et al.
2004/0013531 A1 1/2004 Curry et al.
2004/0016241 A1 1/2004 Street et al.
2004/0025244 A1 2/2004 Loyd et al.
2004/0055363 A1 3/2004 Bristol
2004/0062658 A1 4/2004 Beck et al.
2004/0064292 A1 4/2004 Beck et al.
2004/0071001 A1 4/2004 Balakrishnan et al.
2004/0080325 A1 4/2004 Ogura
2004/0080352 A1 4/2004 Noda et al.
2004/0090197 A1 5/2004 Schuchmann
2004/0095183 A1 5/2004 Swize
2004/0116241 A1 6/2004 Ishikawa et al.
2004/0117330 A1 6/2004 Ehlers et al.
2004/0118203 A1 6/2004 Heger
2004/0149666 A1 8/2004 Leaverton
2004/0205886 A1 10/2004 Goettl
2004/0213676 A1 10/2004 Phillips et al.
2004/0261167 A1 12/2004 Panopoulos
2004/0265134 A1 12/2004 Iimura et al.
2005/0050908 A1 3/2005 Lee et al.
2005/0058548 A1 3/2005 Thomas et al.
2005/0086957 A1 4/2005 Lifson et al.
2005/0092946 A1 5/2005 Fellington et al.
2005/0095150 A1 5/2005 Leone et al.
2005/0097665 A1 5/2005 Goettl
2005/0123408 A1 6/2005 Koehl
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0162787 A1 7/2005 Weigel
2005/0167345 A1 8/2005 De Wet et al.
2005/0168900 A1 8/2005 Brochu et al.
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik et al.
2005/0226731 A1 10/2005 Mehlhorn et al.
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson et al.
2006/0006246 A1 1/2006 Kim
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 5/2006 Cohen
2006/0093492 A1 5/2006 Janesky
2006/0106503 A1 5/2006 Lamb et al.
2006/0127227 A1 6/2006 Mehlhorn et al.
2006/0138033 A1 6/2006 Hoal et al.
2006/0146462 A1 7/2006 McMillian
2006/0162787 A1 7/2006 Yeh
2006/0169322 A1 8/2006 Torkelson
2006/0201555 A1 9/2006 Hamza
2006/0204367 A1 9/2006 Meza et al.
2006/0226997 A1 10/2006 Kochan
2006/0235573 A1 10/2006 Guion
2006/0269426 A1 11/2006 Llewellyn

(56) References Cited

U.S. PATENT DOCUMENTS

2007/0001635 A1 1/2007 Ho
2007/0041845 A1 2/2007 Freudenberger
2007/0061051 A1 3/2007 Maddox
2007/0080660 A1 4/2007 Fagan et al.
2007/0084274 A1 4/2007 Takayanagi
2007/0113647 A1 5/2007 Mehlhorn
2007/0114162 A1 5/2007 Stiles et al.
2007/0154319 A1 7/2007 Stiles et al.
2007/0154320 A1 7/2007 Stiles et al.
2007/0154321 A1 7/2007 Stiles et al.
2007/0154322 A1 7/2007 Stiles et al.
2007/0154323 A1* 7/2007 Stiles ..... F04B 49/103
417/44.1
2007/0160480 A1 7/2007 Ruffo
2007/0163929 A1 7/2007 Stiles et al.
2007/0177985 A1 8/2007 Walls et al.
2007/0183902 A1 8/2007 Stiles et al.
2007/0187185 A1 8/2007 Abraham et al.
2007/0188129 A1 8/2007 Kochan
2007/0212210 A1 9/2007 Kernan et al.
2007/0212229 A1 9/2007 Stavale et al.
2007/0212230 A1 9/2007 Stavale et al.
2007/0219652 A1 9/2007 McMillan
2007/0258827 A1 11/2007 Gierke
2008/0003114 A1 1/2008 Levin et al.
2008/0031751 A1 2/2008 Littwin et al.
2008/0031752 A1 2/2008 Littwin et al.
2008/0039977 A1 2/2008 Clark et al.
2008/0041839 A1 2/2008 Tran
2008/0044293 A1 2/2008 Hanke et al.
2008/0063535 A1 3/2008 Koehl
2008/0067116 A1 3/2008 Anderson et al.
2008/0095638 A1 4/2008 Branecky
2008/0095640 A1 4/2008 Branecky et al.
2008/0131286 A1 6/2008 Koehl
2008/0131289 A1 6/2008 Koehl
2008/0131291 A1 6/2008 Koehl
2008/0131294 A1 6/2008 Koehl
2008/0131295 A1 6/2008 Koehl
2008/0131296 A1 6/2008 Koehl
2008/0140353 A1 6/2008 Koehl
2008/0152508 A1 6/2008 Meza et al.
2008/0168599 A1 7/2008 Caudill et al.
2008/0181785 A1 7/2008 Koehl
2008/0181786 A1 7/2008 Meza et al.
2008/0181787 A1 7/2008 Koehl
2008/0181788 A1 7/2008 Meza et al.
2008/0181789 A1 7/2008 Koehl
2008/0181790 A1 7/2008 Meza et al.
2008/0189885 A1 8/2008 Erlich et al.
2008/0229819 A1 9/2008 Mayleben et al.
2008/0260540 A1 10/2008 Koehl
2008/0288115 A1 11/2008 Rusnak et al.
2008/0288155 A1 11/2008 Watanabe et al.
2008/0298978 A1 12/2008 Schulman et al.
2009/0014044 A1 1/2009 Hartman et al.
2009/0038696 A1 2/2009 Levin et al.
2009/0052281 A1 2/2009 Nybo et al.
2009/0104044 A1 4/2009 Koehl
2009/0143917 A1 6/2009 Uy et al.
2009/0204237 A1 8/2009 Sustaeta et al.
2009/0204267 A1 8/2009 Sustaeta et al.
2009/0208345 A1 8/2009 Moore et al.
2009/0210081 A1 8/2009 Sustaeta et al.
2009/0269217 A1 10/2009 Vijayakumar
2009/0290991 A1 11/2009 Mehlhorn et al.
2010/0079096 A1 4/2010 Braun et al.
2010/0154534 A1 6/2010 Hampton
2010/0166570 A1 7/2010 Hampton
2010/0197364 A1 8/2010 Lee
2010/0303654 A1 12/2010 Petersen et al.
2010/0306001 A1 12/2010 Discenzo et al.
2010/0312398 A1 12/2010 Kidd et al.
2011/0036164 A1 2/2011 Burdi
2011/0044823 A1 2/2011 Stiles
2011/0052416 A1 3/2011 Stiles
2011/0061415 A1 3/2011 Ward
2011/0066256 A1 3/2011 Sesay et al.
2011/0077875 A1 3/2011 Tran et al.
2011/0084650 A1 4/2011 Kaiser et al.
2011/0110794 A1 5/2011 Mayleben et al.
2011/0280744 A1 11/2011 Drtiz et al.
2011/0286859 A1 11/2011 Drtiz et al.
2011/0311370 A1 12/2011 Sloss et al.
2012/0013285 A1 1/2012 Kasunich et al.
2012/0020810 A1 1/2012 Stiles, Jr. et al.
2012/0100010 A1 4/2012 Stiles, Jr. et al.
2013/0106217 A1 5/2013 Drye
2013/0106321 A1 5/2013 Drye et al.
2013/0106322 A1 5/2013 Drye
2014/0018961 A1 1/2014 Guzelgunler
2014/0372164 A1 12/2014 Egan et al.

FOREIGN PATENT DOCUMENTS

CA 2548437 A1 6/2005
CA 2731482 A1 6/2005
CA 2517040 A1 2/2006
CA 2528580 A1 5/2007
CA 2672410 A1 6/2008
CA 2672459 A1 6/2008
CN 1821574 A 8/2006
CN 101165352 A 4/2008
DE 3023463 A1 2/1981
DE 2946049 A1 5/1981
DE 29612980 U1 10/1996
DE 19736079 A1 8/1997
DE 19645129 A1 5/1998
DE 29724347 U1 11/2000
DE 10231773 A1 2/2004
DE 19938490 A1 4/2005
EP 150068 A2 7/1985
EP 226858 A1 7/1987
EP 246769 A2 11/1987
EP 306814 A1 3/1989
EP 314249 A2 5/1989
EP 709575 A1 5/1996
EP 735273 A1 10/1996
EP 833436 A2 4/1998
EP 831188 A3 2/1999
EP 916026 A1 5/1999
EP 978657 A1 2/2000
EP 1112680 A2 7/2001
EP 1134421 A1 9/2001
EP 1315929 A1 6/2003
EP 1429034 A2 6/2004
EP 1585205 A2 10/2005
EP 1630422 A2 3/2006
EP 1698815 A1 9/2006
EP 1790858 A1 5/2007
EP 1995462 A2 11/2008
EP 2102503 A2 9/2009
EP 2122171 A1 11/2009
EP 2273125 A1 11/2009
FR 2529965 A 2/1984
FR 2703409 A 10/1994
GB 2124304 A 2/1984
JP 550072678 A 5/1980
JP H5010270 A 1/1993
MX 2009006258 A 12/2009
WO 98004835 A1 2/1998
WO 00042339 A1 7/2000
WO 01027508 A1 4/2001
WO 0147099 A1 6/2001
WO 0218826 A1 3/2002
WO 03025442 A1 3/2003
WO 33025442 A1 3/2003
WO 03099705 A2 12/2003
WO 33099705 A2 12/2003
WO 2004006416 A1 1/2004
WO 2004073772 A1 9/2004
WO 2004088694 A1 10/2004
WO 2005011473 A2 2/2005
WO 2005055694 A2 6/2005

(56) References Cited

FOREIGN PATENT DOCUMENTS

| | | | |
|---|---|---|---|
| WO | 2006069568 | A1 | 7/2006 |
| WO | 2008073329 | A2 | 6/2008 |
| WO | 2008073330 | A2 | 6/2008 |
| WO | 2008073386 | A2 | 6/2008 |
| WO | 2008073413 | A2 | 6/2008 |
| WO | 2008073418 | A2 | 6/2008 |
| WO | 2008073433 | A2 | 6/2008 |
| WO | 2008073436 | A2 | 6/2008 |
| WO | 2011100067 | A1 | 8/2011 |
| WO | 2014152926 | A1 | 9/2014 |
| ZA | 200506869 | A | 5/2006 |
| ZA | 200509691 | A | 11/2006 |
| ZA | 200904747 | A | 7/2010 |
| ZA | 200904849 | A | 7/2010 |
| ZA | 200904850 | A | 7/2010 |

OTHER PUBLICATIONS

105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—0rder Denying Motion for Preliminary Injunction for Civil Action 5:11-cv-00459D; Jan. 23, 2012.
123—Answer to Amended Complaint, Counterclaim Against Danfoss Drives A/S, Pentair Water Pool & Spa, Inc. for Civil Action 5:1 l-cv-004590; Jan. 27, 2012.
152—Order Denying Motion for Reconsideration for Civil Action 5: 11-cv-00459D; Apr. 4, 2012.
168—Amended Motion to Stay Action Pending Reexamination of Asserted Patents by Defendants for Civil Action 5:11-cv-00459D; Jun. 13, 2012.
174—Notice and Attachments re Joint Claim Construction Statement for Civil Action 5: 11-cv-004590; Jun. 5, 2012.
186—Order Setting Hearings—Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for Civil Action 5:11-cv-00459D; Jul. 2012.
205-24-Exh23—Plaintiffs Preliminary Disclosure of Asserted Claims and Preliminary Infringement Contentions; cited in Civil Action 5:11-cv-00459; Feb. 21, 2012.
210—0rder Granting Joint Motion for Leave to Enlarge Page Limit for Civil Action 5:11-cv-00459D; Jul. 2012.
218—Notice re Plaintiffs re Order on Motion for Leave to File Excess Pages re Amended Joint Claim Construction Statement for Civil Action 5: 11-cv-00459D; Aug. 2012.
22—Memorandum in Support of Motion for Preliminary Injunction by Plaintiffs with respect to Civil Action 5: 11-cv-00459-D; Sep. 2, 2011.
23—Declaration of E. Randolph Collins, Jr. in Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32—Answerto Complaint with Jury Demand & Counterclaim Against Plaintiffs by Hayward Pool Products & Hayward Industries for Civil Action 5:11-cv-00459D; Oct. 12, 2011.
45—Plaintiffs' Reply to Defendants' Answer to Complaint & Counterclaim for Civil Action 5:11-cv-00459D; Nov. 2, 2011.
50—Amended Answer to Complaint & Counterclaim by Defendants for Civil Action 5:11-cv-00459D; Nov. 23, 2011.
51—Response by Defendants in Opposition to Motion for Preliminary Injunction for Civil Action 5:11-cv-00459D; Dec. 2, 2011.
53—Declaratlon of Douglas C. Hopkins & Exhibits re Response Opposing Motion for Preliminary Injunction for Civil Action 5: 11-cv-00459D; Dec. 2, 2011.
540X38—Danfoss; "VL T 6000 Series Installation, Operation & Maintenance Manual;" Mar. 2000; pp. 1-118; cited in Civil Action 5:11-cv-00459D.
54DX16—Hayward EcoStar Technical Guide (Version2); 2011; pp. 1-51; cited in Civil Action 5:11-cv-00459D.
54DX17—Hayward ProLogic Automation & Chlorination Operation Manual (Rev. F); pp. 1-27; Elizabeth, NJ; cited in. Civil Action 5:11-cv-00459D; Dec. 2, 2011.
54DX18—STMicroelectronics; "AN1946—Sensorless BLDC Motor Control & BEMF Sampling Methods with ST7MC;" 2007; pp. 1-35; Civil Action 5:11-cv-0045D.
54DX19—STMicroelectronics; "AN1276 BLDC Motor Start Routine for ST72141 Microcontroller;" 2000; pp. 1-18 cited in Civil Action 5:11-cv-00459D.
54DX21—Danfoss; "VLT 8000 Aqua Instruction Manual;" Apr. 2004; 1-210; Cited in Civil Action 5:11-cv-00459D.
54DX22—Danfoss; "VLT 8000 Aqua Instruction Manual;" pp. 1-35; cited in Civil Action 5: 11-cv-004590; Dec. 2, 2011.
54DX23—Commander; "Commander SE Advanced User Guide;" Nov. 2002; pp. 1-190; cited in Civil Action 5:11-cv-00459D.
54DX30—Sabbagh et al.; "A Model for Optimal . . . Control of Pumping Stations in Irrigation Systems;" Jul. 1988; NL pp. 119-133; Civil Action 5:11-cv-00459D.
54DX31—Danfoss; "VLT 5000 Flux Aqua OeviceNet Instruction Manual;" Apr. 28, 2003; pp. 1-39; cited in Civil Action 5:11-cv-00459D.
54DX32—Danfoss; "VLT 5000 Flux Aqua Profibus Operating Instructions;" May 22, 2003; 1-64; cited in Civil Action 5:11-cv-00459D.
54DX33—Pentair; "IntelliTouch Owner's Manual Set-Up & Programming;" May 22, 2003; Sanford, NC; pp. 1-61; cited in Civil Action 5:11-cv-00459D.
54DX34—Pentair; "Compool 3800 Pool-Spa Control System Installation & Operating Instructions;" Nov. 7, 1997; pp. 1-45; cited in Civil Action 5:11-cv-00459D.
54DX35—Pentair Advertisement In "Pool & Spa News;" Mar. 22, 2002; pp. 1-3; cited in Civil Action 5:11-cv-00459D.
54DX36—Hayward; "Pro-Series High-Rate Sand Filter Owner's Guide;" 2002; Elizabeth, NJ; pp. 1-5; cited in Civil Action 5:11-cv-00459D.
54DX37—Danfoss; "VLT 8000 Aqua Fact Sheet;" Jan. 2002; pp. 1-3; cited in Civil Action 5:11-cv-00459D.
54DX45—Hopkins; "Synthesis of New Class of Converters that Utilize Energy Recirculation;" pp. 1-7; cited in Civil Action 5:11-cv-00459D; 1994.
54DX46—Hopkins; "High-Temperature, High-Density . . . Embedded Operation;" pp. 1-8; cited in Civil Action 5:11-cv-00459D; Mar. 2006.
54DX47—Hopkins; "Optimally Selecting Packaging Technologies . . . Cost & Performance;" pp. 1-9; cited in Civil Action 5: 11-cv-00459D; Jun. 1999.
54DX48—Hopkins; "Partitioning Digitally . . . Applications to Ballasts;" pp. 1-6; cited in Civil Action 5:11-cv-004590 03/2002.
7-Motion for Preliminary Injunction by Danfoss Drives A/S & Pentair Water Pool & Spa, Inc. with respect to Civil Action No. 5: 11-cv-00459-D; Sep. 30, 2011.
39—Reply to Response to Motion for Preliminary Injunction Filed by Danfoss Drives A/S & Pentair Water Pool & Spa, NC. for Civil Action 5:11-cv-00459D; Jan. 3, 2012.
9PX10—Pentair; "IntelliPro VS+SVRS Intelligent Variable Speed Pump;" 2011; pp. 1-6; cited in Civil Action 5:11-cv-00459D.
9PX11—Pentair; "IntelliTouch Pool & Spa Control Control Systems;" 2011; pp. 1-5; cited in Civil Action 5:11-cv-00459D.
9PX14—Pentair; "IntelliFlo Installation and User's Guide;" pp. 1-53; Jul. 26, 2011; Sanford, NC; cited in Civil Action 5:11-cv-00459D.
9PX16—Hayward Pool Products; "EcoStarowner's Manual (Rev. B);" pp. 1-32; Elizabeth, NJ; cited in Civil Action 5:11-cv-00459D; 2010.
9PX17—Hayward Pool Products; "EcoStar & EcoStar SVRS Brochure;" pp. 1-7; Elizabeth, NJ; cited in Civil Action 5:11-cv-00459D; Sep. 30, 2011.

(56) References Cited

OTHER PUBLICATIONS

9PX19—Hayward Pool Products;" Hayward Energy Solutions Brochure;" pp. 1-3; www.haywardnet.com; cited in Civil Action 5:11-cv-00459D; Sep. 2011.
Appeal Decision, U.S. Appln. No. 12/869,570, dated May 24, 2016.
USPTO Patent Board Decision—Examiner Reversed; Appeal No. 2015-007909 re: U.S. Pat. No. 7,686,587B2; dated Apr. 1, 2016.
USPTO Patent Board Decision—Examiner Affirmed in Part; Appeal No. 2016-002780 re: U.S. Pat. No. 7,854,597B2 dated Aug. 30, 2016.
USPTO Patent Board Decision—Decision on Reconsideration, Denied; Appeal No. 2015-007909 re: U.S. Pat. No. 7,686,587B2; dated Aug. 30, 2016.
Board Decision for Appeal 2016-002726, Reexamination Control U.S. Appl. No. 95/002,005, U.S. Pat. No. 7,857,600B2 dated Jul. 1, 2016.
U.S. Patent Trial and Appeal Board's Rule 36 Judgment, without opinion, in Case No. 2016-2598, dated Aug. 15, 2017, pp. 1-2.
U.S. Court of Appeals for the Federal Circuit, Notice of Entry of Judgment, accompanied by Opinion, in Case No. 2017-1021, Document 57-1, filed and entered Feb. 7, 2018, pp. 1-16.
Amended Complaint filed by Pentair Water Pool & Spa, Inc. and Danloss Drives A/S, Civil Action No. 5.11-cv-00459-D filed Jan. 17, 2012, 12 pages.
Bibliographic Data Sheet showing correct filing date of U.S. Appl. No. 10/730,747, dated Jul. 11, 2005, 2 pages.
Shirley et al. "A Mechatronics and Material Handling Systems Laboratory: Experiments and Case Studies." The International Journal of Electrical Engineering & Education, vol. 48, No. 1, Jan. 1, 2011, pp. 92-103.
Goulds Pumps, Balanced Flow System Installation Record, before Jun. 9, 2009, 2 pages.
Bjarke Soerensen; "Have You Chatted With Your Pump Today?", before Jun. 9, 2009; pp. 1-2.
Goulds Pumps; "Balanced Flow Submersible System Informational Seminar;" before Jun. 9, 2009, pp. 1-22.
Goulds Pumps; "Balanced Flow System . . . The Future of Constant Pressure Has Arrived;" before Jun. 9, 2009.
Grundfos; "CU301 Installation & Operation Manual;" Apr. 2009; pp. 1-2; before Jun. 9, 2009; www.grundfos.com.
Grundfos; "JetPaq—The Complete Pumping System;" Brochure, before Jun. 9, 2009, pp. 1-4.
Grundfos; "SQ/SQE—A New Standard in Submersible Pumps;" Brochure; before Jun. 9, 2009; pp. 1-14.
Grundfos; "Uncomplicated Electronics . . . Advanced Design;" before Jun. 9, 2009, pp. 1-10.
Baldor; "Baldor Motors and Drives Series 14 Vector Drive Control Operating & Technical Manual;" Mar. 22, 1992; pp. 1-92.
Compool; "Compool CP3800 PoolSpa Control System Installation and Operating Instructions;" Nov. 7, 1997; pp. 1-45.
Dinverter; "Dinverter 2B User Guide;" Nov. 1998; pp. 1-94.
Baldor; "Baldor Series 10 Inverter Control: Installation and Operating Manual"; Feb. 2000; pp. 1-74.
Brochure Entitled "Constant Pressure Water for Private Well Systems," for Myers Pentair Pump Group, Jun. 28, 2000.
F.E. Myers; "Featured Product: F.E Myers Introducts Revolutionary Constant Pressure Water System;" pp. 1-8; Jun. 28, 2000; Ashland, OH USA.
Goulds Pumps; "Balanced Flow Submersible System Installation, Operation & Trouble-Shooting Manual;" pp. 1-9; 2000; USA.
Goulds Pumps; "Balanced Flow System Model BFSS Variable Speed Submersible Pump" Brochure; pp. 1-3; Jan. 2000; USA.
"Constant Pressure is the Name of the Game"; Published Article from National Driller; Mar. 2001.
Email Regarding Grundfos' Price Increases/SQ/SOE Curves; pp. 1-7; Dec. 19, 2001.
Franklin Electric; "CP Water-Subdrive 75 Constant Pressure Controller" Product Data Sheet; May 2001; Bluffton, IN USA.
Goulds Pumps; "Balanced Flow System Brochure;" pp. 1-4; 2001.
Goulds Pumps; "Balanced Flow System Model BFSS Variable Speed Submersible Pump System" Brochure; pp. 1-4; Jan. 2001; USA.
Amtrol Inc.; "Amtrol Unearths the Facts About Variable Speed Pumps and Constant Pressure Valves;" pp. 1-5; Aug. 2002; West Warwick, RI USA.
Bimal K. Bose—The University of Tennessee, Knoxville, Modem Power Electronics and AC Drives, book, Copyright 2002, 728 pages, Prentice-Hall, Inc., Upper Saddle River, New Jersey.
Brochure for Amtrol, Inc. Entitled "Amtrol unearths the facts about variable speed pumps and constant pressure valves," Mar. 2002.
Commander; "Commander SE Advanced User Guide;" Nov. 2002; pp. 1-118.
Franklin Electric; "Franklin Aid, Subdrive 75: You Made It Better;" vol. 20, No. 1; pp. 1-2; Jan./Feb. 2002; www.franklin-electric.com.
Franklin Electric; "Franklin Application Installation Data;" vol. 21, No. 5, Sep./Oct. 2003; pp. 1-2; www.franklin-electric.com.
Cliff Wyatt, "Monitoring Pumps," World Pumps, vol. 2004, Issue 459, Dec. 2004, pp. 17-21.
Flotec Owner's Manual, dated 2004. 44 pages.
Allen-Bradley; "1336 Plus II Adjustable Frequency AC Drive with Sensorless Vector User Manual;" Sep. 2005; pp. 1-212.
Franklin Electric; Constant Pressure in Just the Right Size;Aug. 2006; pp. 1-4; Bluffton, IN USA.
Danfoss, VLT® Aqua Drive, "The ultimate solution for Water, Wastewater, & Irrigation", May 2007, pp. 1-16.
Glentronics Home Page, dated 2007. 2 pages.
Franklin Electric; "Monodrive MonodriveXT Single-Phase Constant Pressure;" Sep. 2008; pp. 1-2; Bluffton, IN USA.
Goulds Pumps SPBB Battery Back-Up Pump Brochure, dated 2008. 2 pages.
9PX-42-Hayward Pool Systems; "Hayward EcoStar & EcoStar SVRS Variable Speed Pumps Brochure;" Civil Action 5:11-cv-00459D; 2010.
9PX22-Hayward Pool Products; "Wireless & Wired Remote Controls Brochure;" pp. 1-5; 2010; Elizabeth, NJ; cited in Civil Action 5:11-cv-00459D.
9PX20—Hayward Pool Products; "ProLogic Installation Manual (Rev.G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX23—Hayward Pool Products; Selected Pages from Hayward's WebsIte:/www.hayward-pool.com; pp. 1-27; cited in Civil Action 5:11-cv-00459D; Sep. 2011.
9PX28—Hayward Pool Products; "Selected Page from Hayward's Website Relating to EcoStar Pumps;" p. 1 cited in Civil Action 5:11-cv-00459D; Sep. 2011.
9PX29—Hayward Pool Products; "Selected Page from Hayward's Website Relating to EcoStar SVRS Pumps;" cited in Civil Action 5:11-cv-00459; Sep. 2011.
9PX30—Hayward Pool Systems; "Selected Pages from Hayward's Website Relating to Pro Logic Controllers;" pp. 1-5; Civil Action 5:11-cv-004590; Sep. 2011.
9PX5—Pentair; Selected Website Pages; pp. 1-29; cited in Civil Action 5:11-cv-00459D; Sep. 2011.
9PX6—Pentair; "IntelliFlo Variable Speed Pump" Brochure; 2011; pp. 1-9; cited in Civil Action 5:11-cv-00459D.
9PX7—Pentair; "IntelliFlo VF Intelligent Variable Flow Pump;" 2011; pp. 1-9; cited in Civil Action 5:11-cv-00459D.
9PX8—Pentair; "IntelliFlo VS+SVRS Intelligent Variable Speed Pump;" 2011; pp. 19; cited in Civil Action 5:11-cv-00459D.
9PX9—Sta-Rite; "IntelliPro Variable Speed Pump;" 2011; pp. 1-9; cited in Civil Action 5:11-cv-00459D.
Danfoss, Salt Drive Systems, "Increase oil & gas production, Minimize energy consumption", copyright 2011, pp. 1-16.
Docket Report for Case No. 5:11-cv-00459-D; Nov. 2012.
Have You Chatted With Your Pump Today? "Undated Article Reprinted with Permission of Grundfos Pump University; pp. 1-2; USA."
Balanced Flow Submersible System Informational Seminar; "pp. 1-22; Undated."

(56) References Cited

OTHER PUBLICATIONS

Balanced Flow System . . . The Future of Constant Pressure Has Arrived; "Undated Advertisement."
Goulds Pumps; "Balanced Flow System Variable Speed Submersible Pump" Specification Sheet; pp. 1-2; Jan. 2000; USA.
Goulds Pumps; "Hydro-Pro Water System Tank Installation, Operation & Maintenance Instructions;" pp. 1-30; Mar. 31, 2001; Seneca Falls, NY USA.
Goulds Pumps; "Model BFSS List Price Sheet;" Feb. 5, 2001.
Goulds Pumps; "Pumpsmart Control Solutions" Advertisement from Industrial Equipment News; Aug. 2002; New York, NY US.
Goulds Pumps; Advertisement from "Pumps & Systems Magazine;" Jan. 2002; Seneca Falls, NY.
Karl Johan Astrom and Bjorn Wittenmark—Lund Institute of Technology, Adaptive Control—Second Edition, book, Copyright 1995, 589 pages, Addison-Wesley Publishing Company, United States and Canada.
Texas Instruments, Digital Signal Processing Solution for AC Induction Motor, Application Note, BPRA043 (1996).
Microchip Technology, Inc., PICMicro Mid-Range MCU Family Reference Manual (Dec. 1997).
Texas Instruments, Zhenyu Yu and David Figoli, DSP Digital Control System Applications—AC Induction Motor Control Using Constant V/Hz Principle and Space Vector PWM Technique with TMS320C240, Application Report No. SPRA284A (Apr. 1998).
W.K. Ho, S.K. Panda, K.W. Lim, F.S. Huang—Department of Electrical Engineering, National University of Singapore, Gain-scheduling control of the Switched Reluctance Motor, Control Engineering Practice 6, copyright 1998, pp. 181-189, Elsevier Science Ltd.
"Understanding Constant Pressure Control"; pp. 1-3; Nov. 1, 1999.
Grundfos Pumps Corporation; "Grundfos SQ/SQE Data Book;" pp. 1-39; Jun. 1999; Fresno, CA USA.
Grundfos Pumps Corporation; "The New Standard in Submersible Pumps;" Brochure; pp. 1-8; Jun. 1999 Fresno, CA USA.
Per Brath—Danfoss Drives A/S, Towards Autonomous Control of HVAC Systems, thesis with translation of Introduction, Sep. 1999, 216 pages.
Texas Instruments, Electronic TMS320F/C240 DSP Controllers Reference Guide, Peripheral Library and Specific Devices, Jun. 1999, 474 pages.
Wen Technology, Inc., Unipower® HPL 110 Digital Power Monitor Installation and Operation, copyright 1999, pp. 1-20, Raleigh, North Carolina.
Wen Technology, Inc., Unipower® HPL 110, HPL420 Programming Suggestions for Centrifugal Pumps, copyright 1999, 4 pages, Raleigh, North Carolina.
"Water Pressure Problems" Published Article; The American Well Owner; No. 2, Jul. 2000.
Microchip Technology Inc., PICmicro® Advanced Analog Microcontrollers for 12-Bit ADC on 8-Bit MCUs, Convert to Microchip, brochure, Dec. 2000, 6 pages, Chandler, Arizona.
Pentair Pool Products, WhisperFlo Pump Owner's Manual, Jun. 5, 2001, 10 pages.
Robert S. Carrow; "Electrician's Technical Reference-Variable Frequency Drives;" Published by Delmar 2001; pp. 1-194.
Grundfos; "SmartFlo SQE Constant Pressure System;" Mar. 2002; pp. 1-4; Olathe, KS USA.
Jan Eric Thorsen—Danfoss, Technical Paper—Dynamic simulation of DH House Stations, presented by 7. Dresdner Femwarme-Kolloquium Sep. 2002, 10 pages, published in Euro Heat & Power Jun. 2003.
Pentair; "Pentair RS-485 Pool Controller Adapter" Published Advertisement from Pool & Spa News; Mar. 22, 2002 pp. 1-2.
Texas Instruments, TMS320F/C240 DSP Controllers Peripheral Library and Specific Devices, Reference Guide, Nov. 2002, 485 pages, printed in U.S.A.
Waterworld, New AC Drive Series Targets Water, Wastewater Applications, magazine, Jul. 2002, 5 pages, vol. 18, Issue 7.
Grundfos; "Grundfos SmartFlo SQE Constant Pressure System;" Mar. 2003; pp. 1-2; USA.
Pentair; "Pentair IntelliTouch Operating Manual;" May 22, 2003; pp. 1-60.
Shabnam Mogharabi; "Better, Stronger, Faster;" Pool and Spa News; pp. 1-5; Sep. 3, 2004; www/poolspanews.com.
Grundfos; "CU301 Installation & Operating Instructions;" Sep. 2005; pp. 1-30; Olathe, KS USA.
ITT Corporation; "Goulds Pumps Balanced Flow Constant Pressure Controller for 2 HP Submersible Pumps;" Jun. 2005; pp. 1-4 USA.
Pentair Pool Products; "IntelllFlo 4X160 a Breathrough in Energy-Efficiency and Service Life;" pp. 1-4; Nov. 2005; www/pentairpool.com.
ITT Corporation; "Goulds Pumps Balanced Flow;" Jul. 2006; pp. 1-8.
Pentair Water Pool and Spa, Inc.;"The Pool Pro's Guide to Breakthrough Efficiency, Convenience & Profitability;" pp. 1-8; Mar. 2006; wwwpentairpool.com.
"Lift Station Level Control" by Joe Evans PhD, www.pumped101.com, dated Sep. 2007. 5 pages.
ITT Corporation; "Goulds Pumps Balanced Flow Submersible Pump Controller;" Jul. 2007; pp. 1-12.
ITT Red Jacket Water Products RJBB/RJBB2 Battery Backup Sump Pumps; May 2007, 2 pages.
Pentair Water Ace Pump Catalog, dated 2007, 44 pages.
SJE-Rhombus; "SubCon Variable Frequency Drive;" Dec. 2008; pp. 1-2; Detroit Lakes, MN USA.
SJE-Rhombus; "Variable Frequency Drives for Constant Pressure Control;" Aug. 2008; pp. 1-4; Detroit Lakes, MN USA.
ITT Red Jacket Water Products Installation, Operation and Parts Manual, dated 2009, 8 pages.
SJE-Rhombus; "Constant Pressure Controller for Submersible Well Pumps;" Jan. 2009; pp. 1-4; Detroit Lakes, MN USA.
Liberty Pumps PC-Series Brochure, dated 2010, 2 pages.
The Basement Watchdog A/C—D/C Battery Backup Sump Pump System Instruction Manual and Safety Warnings, dated 2010, 20 pages.
The Basement Watchdog Computer Controlled A/C—DIC Sump Pump System Instruction Manual, dated 2010; 17 pages.
PX-138-Depositionof Dr. Douglas C. Hopkins; pp. 1-391; 2011; taken in Civil Action 10-cv-1662.
PX-141-Danfoss; "Whitepaper Automatic Energy Optimization;" pp. 1-4; 2011; cited in Civil Action 5:11-cv-00459.
PX-34-Pentair; "IntelliTouch Pool & Spa Control System User's Guide"; pp. 1-129; 2011; cited in Civil Action 5:11-cv-00459; 2011.
Rajwardhan Patil, et al., A Multi-Disciplinary Mechatronics Course with Assessment—Integrating Theory and Application through Laboratory Activities, International Journal of Engineering Education, copyright 2012, pp. 1141-1149, vol. 28, No. 5, Tempus Publications, Great Britain.
USPTO Patent Trial and Appeal Board, Paper 43—Final Written Decision, Case IPR2013-00287, U.S. Pat. No. 7,704,051 B2, Nov. 19, 2014, 28 pages.
USPTO Patent Trial and Appeal Board, Paper 47—Final Written Decision, Case IPR2013-00285, U.S. Pat. No. 8,019,479 B2, Nov. 19, 2014, 39 pages.
Schlumberger Limited, Oilfield Glossary, website Search Results for pump-off, copyright 2014, 1 page.
Texas Instruments, MSP430x33x—Mixed Signal Microcontrollers, SLAS 163 (Feb. 1998).
Load Controls Incorporated, product web pages including Affidavit of Christopher Butler of Internet Archive attesting to the authenticity of the web pages, dated Apr. 17, 2013, 19 pages.
Freescalle Semiconductors, Inc., HC05, M68HC05 Family, Understanding Small Microcontrollers, Rev 2.0, 1998.

* cited by examiner

METHOD OF CONTROLLING A PUMP AND MOTOR

RELATED APPLICATIONS

This application is a continuation of U.S. patent application Ser. No. 15/421,251, filed Jan. 31, 2017, which is a continuation of U.S. patent application Ser. No. 12/481,435, filed Jun. 9, 2009 and titled Method of Controlling a Pump and Motor, the entire contents of which are incorporated herein by reference.

BACKGROUND

Submersible well pumps are connected to above-ground drive systems that control the operation of the pump. Some conventional pump controllers include only start capacitors and relays to turn the pump on and off based on system pressure. These pump controllers have limited capabilities with respect to pump control, safety, and customization. Variable frequency drives (VFDs) have also been used to control submersible well pumps but with limited capabilities regarding user-friendly control and customization. Conventional drives have also generally been designed for use with particular types of motors and often cannot be used to retrofit motors that are already installed in the well, especially two-wire, single-phase motors.

SUMMARY

Some embodiments of the invention can provide a controller for a pump driven by a motor, where the pump is in fluid communication with a fluid system. The controller includes a variable frequency drive circuit that controls operation of the pump and a control panel connected to the variable frequency drive circuit. The control panel can include an automatic start button and a stop button. The variable frequency drive circuit can automatically operate in a line fill mode when the pump starts when the automatic start button is engaged and the pump can be disabled when the stop button is engaged.

According to some embodiments, a method of controlling a pump driven by a motor with the pump in fluid communication with a fluid system is provided. The method includes monitoring a pressure in the fluid system, monitoring and adjusting an operating frequency of the motor to maintain the pressure at a pressure set point, and, based on the monitored operating frequency, causing the pump to temporarily boost the pressure in the fluid system to a temporary boost set point for a first time period, where the temporary boost set point is greater than the pressure set point. The method also includes determining whether the temporarily boosted pressure in the fluid system stays above the pressure set point for a second time period and causing the pump to enter a sleep mode when the temporarily boosted pressure stays above the pressure set point through the second time period.

According to some embodiments, a controller for a pump driven by a motor is provided. The controller includes a control panel with a display, directional buttons, and an enter button, and a variable frequency drive circuit that controls operation of the pump. The variable frequency drive circuit is connected to the control panel and is configured to monitor a pressure in the fluid system and monitor and adjust an operating frequency of the motor to maintain the pressure at a pressure set point, where the pressure set point is programmable by a user using the directional buttons and the enter button. The variable frequency drive circuit is also configured to, based on the monitored operating frequency, cause the pump to temporarily boost the pressure in the fluid system to a temporary boost set point for a first time period, where the temporary boost set point is programmable by a user using the directional buttons and the enter button. The variable frequency drive circuit is further configured to determine whether the temporarily boosted pressure in the fluid system stays above the pressure set point for a second time period and cause the pump to enter a sleep mode when the temporarily boosted pressure stays above the pressure set point through the second time period.

DETAILED DESCRIPTION

Figure 1:
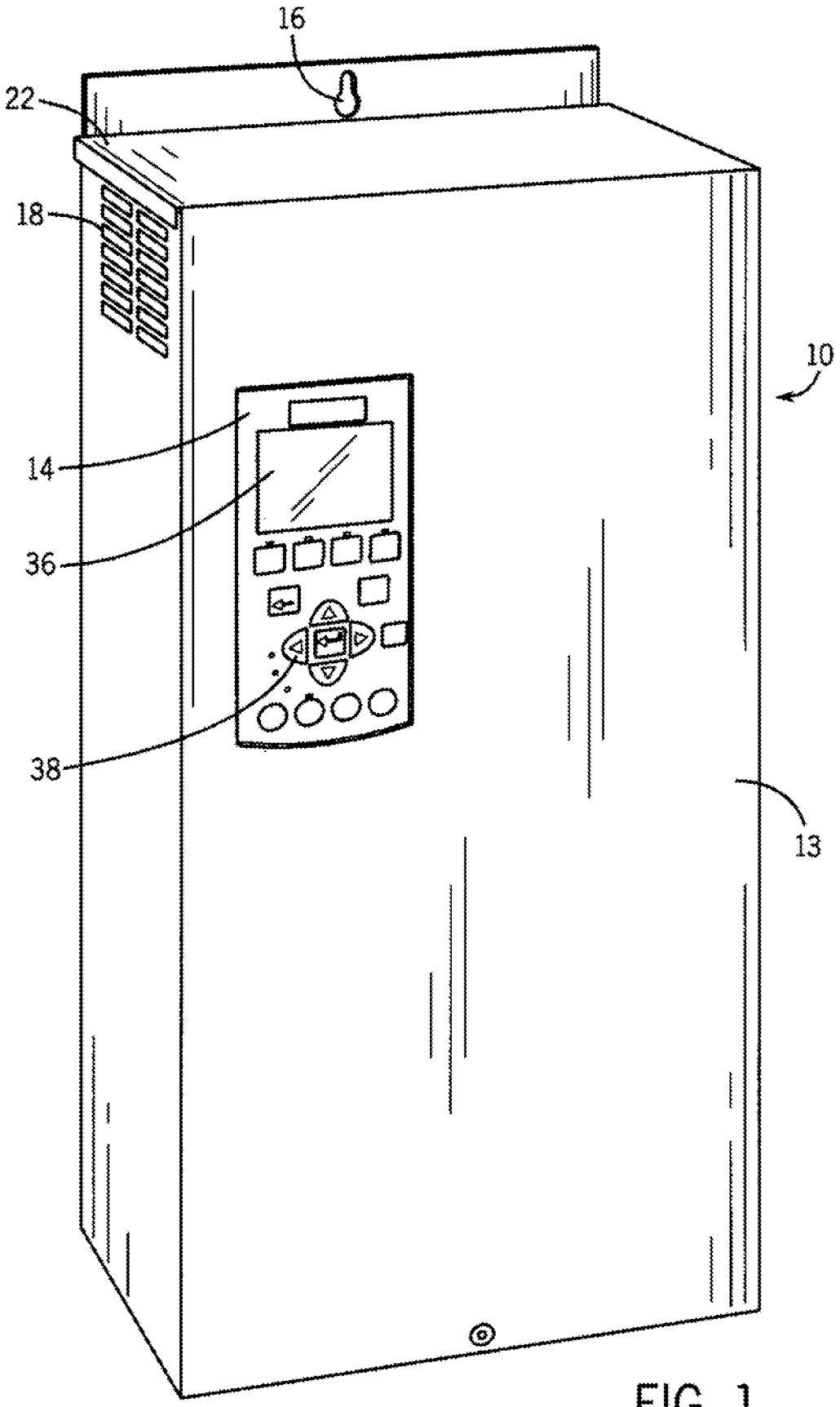
FIG. 1 is a perspective view of a variable frequency drive according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 5:
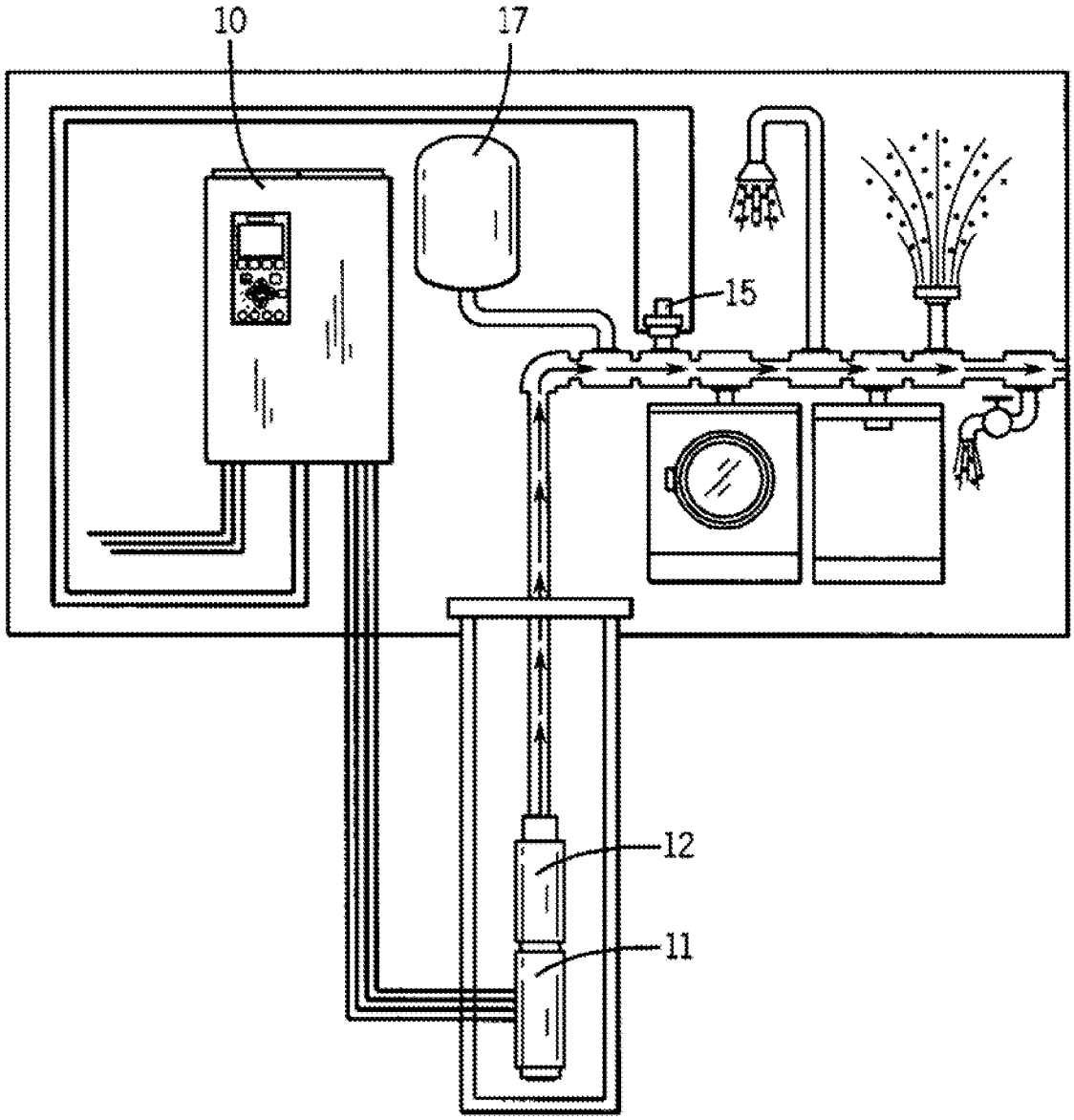
FIG. 5 is a schematic view of the variable frequency drive of FIG. 1 installed in a fluid system.

FIG. 1 illustrates a variable frequency drive (VFD, hereinafter "the drive") 10 according to one embodiment of the invention. In some embodiments, the drive 10 can be used to control the operation of an AC induction motor 11 that drives a water pump 12 (as shown in FIG. 5). The drive 10 can be used in a residential, commercial, or industrial pump system to maintain a substantially constant pressure. The motor 11 and pump 12 can be a submersible type or an above-ground type. The drive 10 can monitor certain operating parameters and control the operation of the motor 11 in response to the sensed conditions.

Figure 2:
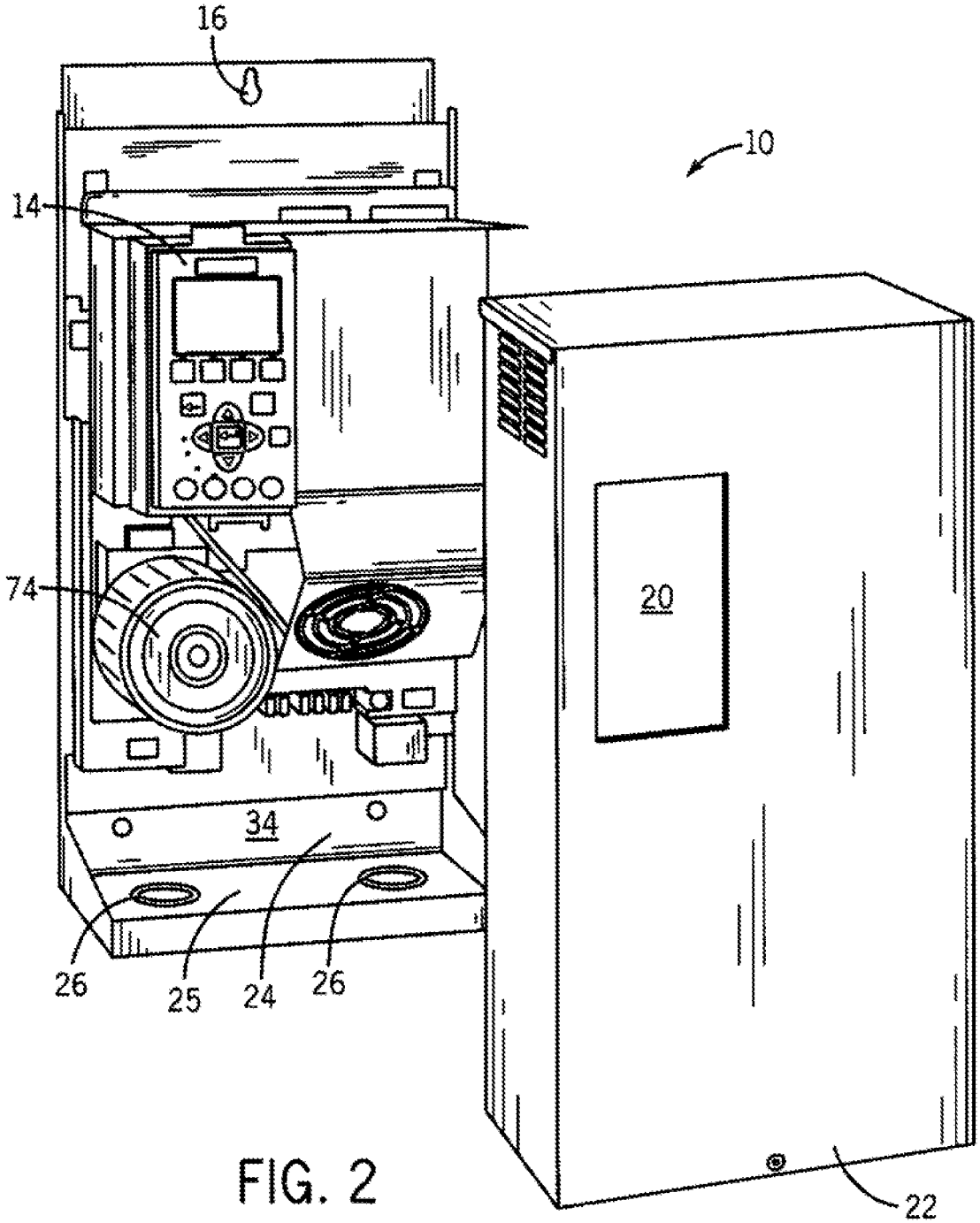
FIG. 2 is a perspective view of the variable frequency drive of FIG. 1 with a cover removed.

As shown in FIGS. 1 and 2, the drive 10 can include an enclosure 13 and a control pad 14. The enclosure 13 can be a NEMA 1 indoor enclosure or a NEMA 3R outdoor enclosure. In one embodiment, the enclosure 13 can have a width of about 9.25 inches, a height of about 17.5 inches, and a depth of about 6.0 inches. The enclosure 13 can include a keyhole mount 16 for fast and easy installation onto a wall, such as a basement wall. The enclosure 13 can include slots 18 through which air that cools the drive 10 can pass out of the enclosure 13. The control pad 14 can be positioned within the enclosure 13 for access through a rectangular aperture 20.

Figure 3:
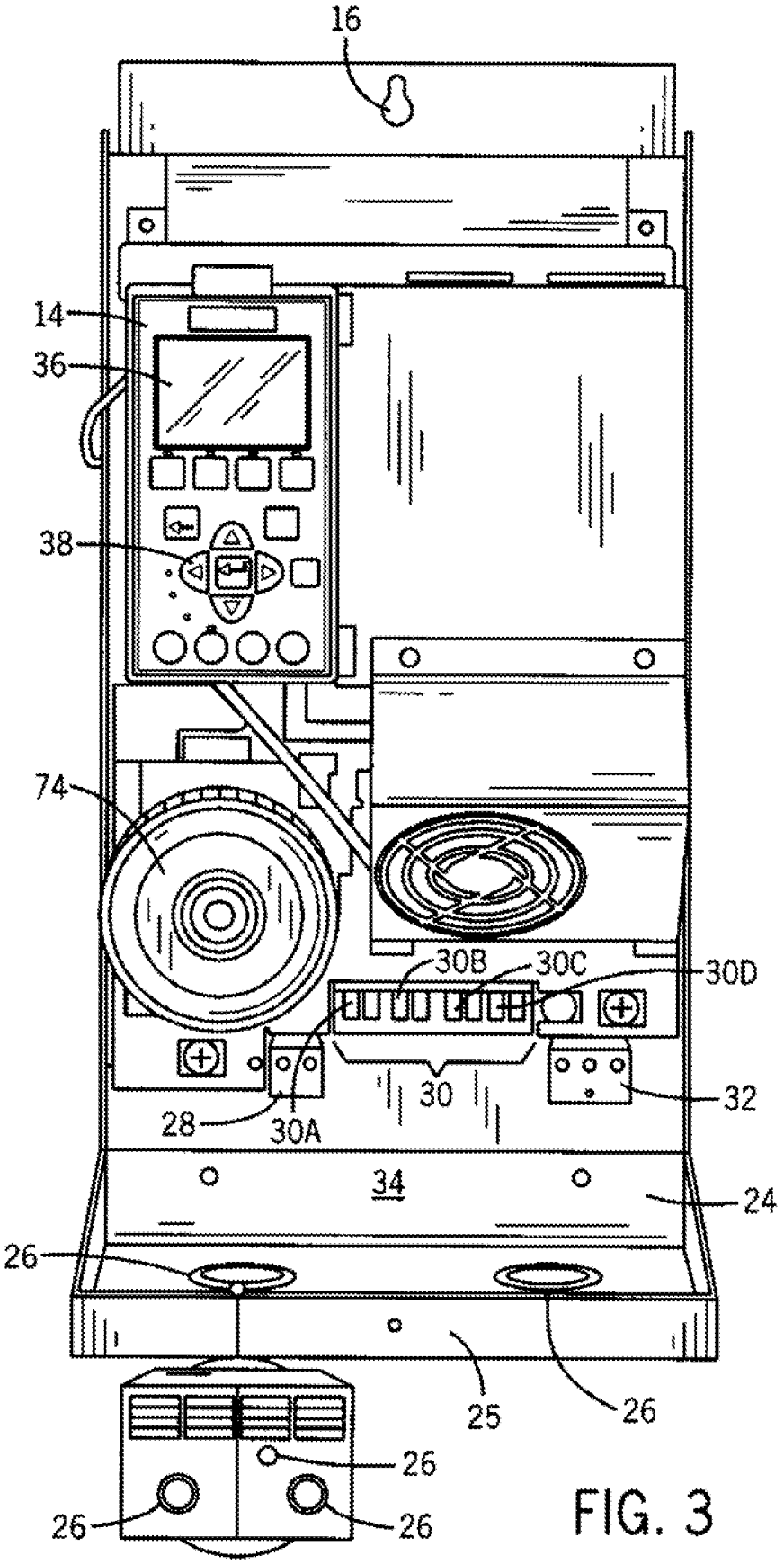
FIG. 3 is an interior view of the variable frequency drive of FIG. 1.

As shown in FIG. 2, the enclosure 13 can include a removable cover 22 with attached side panels. Removing the cover 22 allows access to a wiring area 24, which is located adjacent to a bottom panel 25 of the enclosure 13 with several conduit holes 26. As shown in FIGS. 2 and 3, the wiring area 24 is free of any electrical components or printed circuit board material that may impede any wiring. The wiring area 24 can provide access to an input power terminal block 28, input/output (I/O) spring terminals 30, and an output power terminal block 32. Each one of the conduit holes 26 can be aligned with one of the input power terminal block 28, the I/O spring terminals 30, and the output power terminal block 32. In addition, in some embodiments, the I/O spring terminals 30 can include digital output terminals 30A, digital input terminals 30B, I/O power supply terminals 30C, and analog input terminals 30D.

The wiring area 24 can include a wiring space 34 between the bottom panel 25 and the input power terminal block 28, the I/O spring terminals 30, and the output power terminal block 32. The wiring space 34 can be between about three inches and about six inches in height in order to allow enough room for an installer to access the input power terminal block 28, the I/O spring terminals 30, and the output power terminal block 32.

The input power terminal block 28, I/O spring terminals 30, and the output power terminal block 32 can be used to control the motor 11 and to provide output information in any number of configurations and applications. Various types of inputs can be provided to the drive 10 to be processed and used to control the motor 11. The analog input terminals 30D can receive analog inputs and the digital input terminals 30B can receive digital inputs. For example, any suitable type of run/enable switch can be provided as an input to the drive 10 (e.g., via the digital input terminals 30B). The run/enable switch can be part of a lawn irrigation system, a spa pump controller, a pool pump controller, a float switch, or a clock/timer. In some embodiments, the digital input terminals 30B can accept a variety of input voltages, such as voltages ranging from about 12 volts to about 240 volts, direct current (DC) or alternating current (AC).

Figure 6:
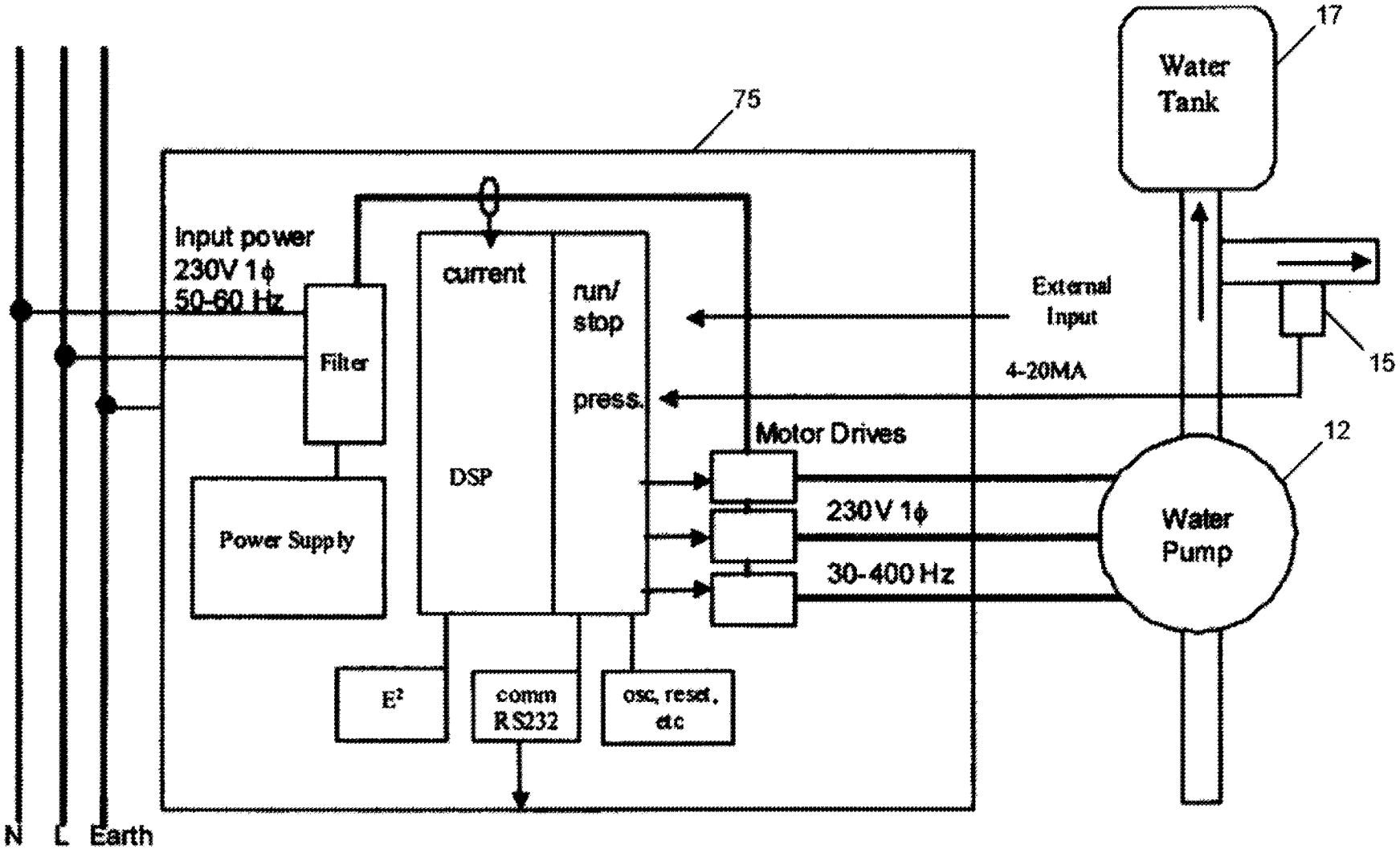
FIG. 6 is a schematic illustration of the variable frequency drive of FIG. 1.

The digital output terminals 30A can connect to digital outputs, such as relay outputs. Any suitable type of indicator device, status output, or fault alarm output can serve as a digital, or relay, output (e.g., be connected to the digital output terminals 30A). A status output can be used to control a second pump, for example, to run the second pump when the pump 12 is running. A fault alarm output can, for example, place a call using a pre-defined phone number, signal a residential alarm system, and/or shut down the pump 12 when a fault is determined. For example, when there is a pipe break fault (as described below with reference to FIG. 33), the digital output terminals 30A can energize a relay output, causing the pre-defined phone number to be automatically dialed. The input power terminal block 28, the I/O spring terminals 30, and the output power terminal block 32 can all be coupled to a drive circuit board (not shown), for connection to a controller 75 (as shown in FIG. 6) of the drive 10. Further, the input power terminal block 28 and/or the output power terminal block 32 can be removable and replaceable without replacing the drive circuit board or the entire drive 10.

Figure 4:
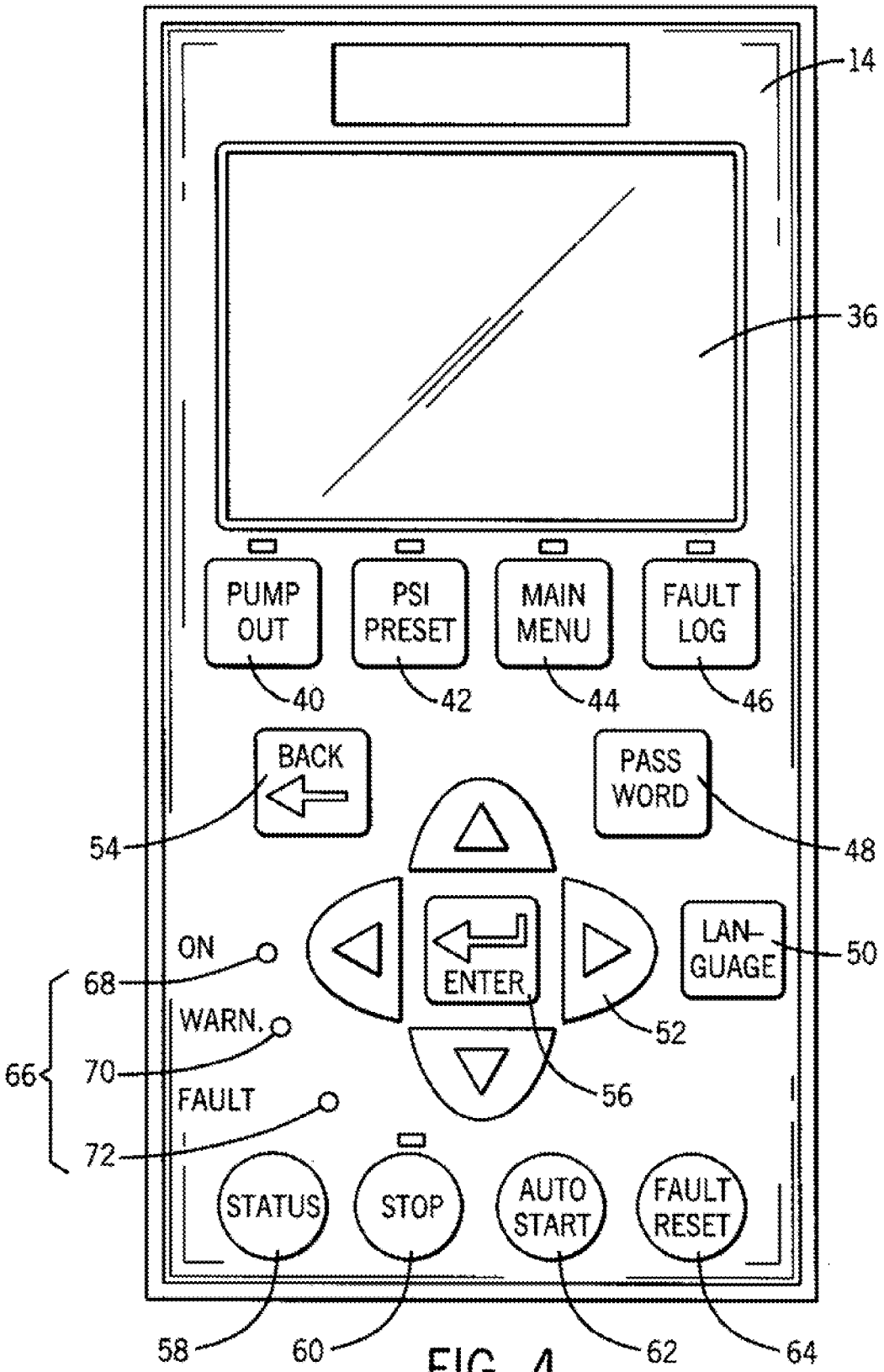
FIG. 4 is a front view of a control pad of the variable frequency drive of FIG. 1.

As shown in FIGS. 1-4, a control pad 14 of the drive 10 can include a backlit liquid crystal display 36 and several control buttons 38. As shown in FIG. 4, the control buttons 38 can include a pump-out button 40, a pressure preset button 42, a main menu button 44, and a fault log button 46. The control buttons 38 can also include a keypad lockout button 48 and a language button 50. The control pad 14 can include several directional buttons 52, a back button 54, and an enter button 56. The control pad 14 can further include a status button 58, a stop button 60, an automatic start button 62, and a fault reset button 64. Finally, the control pad 14 can include light emitting diode (LED) indicators 66, to indicate a status of the drive 10, such as an ON LED 68, a Warning LED 70, and a Fault LED 72.

As shown in FIGS. 2 and 3, the drive 10 can include an electromagnetic interference (EMI) filter 74. The EMI filter 74 can reduce electrical noise generated by the motor 11, especially noise that interferes with AM radio stations. The drive 10 can reduce electrical noise while simultaneously being compatible with a Ground Fault Circuit Interrupter (GFCI). An unintentional electric path between a source of current and a grounded surface is generally referred to as a "ground fault." Ground faults occur when current is leaking somewhere, and in effect, electricity is escaping to the ground.

The drive 10 can be compatible with a number of different types of motors 11, including, but not limited to, AC induction motors that are two-wire permanent split capacitor (PSC) single-phase motors; three-wire single-phase motors; or three-phase motors. The drive 10 can be connected to a previously-installed motor 11 in order to retrofit the controls for the motor 11. If the motor is a single-phase motor, the installer can use the control pad 14 to select either two-wire or three-wire. For a three-wire motor 11, the drive 10 can automatically generate a first waveform and a second waveform with the second waveform having a phase angle of about 90 degrees offset from the first waveform. In addition, the controller 75 (as shown in FIG. 6) can automatically set a minimum and maximum frequency allowance for the motor 11 depending on the selection.

The drive 10 can be programmed to operate after a simple start-up process by a user using the control pad 14. The start-up process can be a five-step process for a single-phase motor 11 and a four-step process for a three-phase motor 11. The start-up process for a single-phase motor 11 can include (1) entering a service factor current value, (2) selecting either a two-wire motor or a three-wire motor, (3) entering a current time, (4) entering a current date, and (5) engaging the pump-out button 40 or the automatic start button 62. The start-up process for a three-phase motor 11 can include (1) entering a service factor current value, (2) entering a current time, (3) entering a current date, and (4) engaging the pump-out button 40 or the automatic start button 62.

The pump-out button 40 can be used to enter the drive 10 in a pump out mode to clean out sand and dirt from a newly-dug well. The pump-out button 40 can be engaged once the pump 12 is installed in the new well and once the drive 10 is connected to the motor 11. The pump-out mode can provide an open discharge of sand and dirt from the well, for example, onto a lawn. In one embodiment, the drive 10 can operate the pump 12 in the pump out mode at about 45 Hertz (Hz). The pump out mode operation is further described below with respect to FIG. 7, and a pump-out button control operation is further described below with respect to FIG. 48.

The controller 75 can include software executed by a digital signal processor (DSP, as shown in FIG. 6) or a microprocessor and can perform real-time control including soft-start, speed regulation, and motor protection. The drive 10 can be controlled to maintain substantially constant water pressure in a water system that may or may not utilize a tank. To achieve this, the controller 75 can implement a classical Proportional/Integral/Derivative (PID) method using pressure error as an input. Pressure error can be calculated by subtracting an actual water pressure from the desired water pressure (i.e., a pressure set point). An updated speed control command can then be generated by multiplying the pressure error by a proportional gain, multiplying the integral of the pressure error by an integral gain, multiplying the derivative of the pressure error by a derivative gain, and summing the results. Thus, the controller 75 can increase or decrease the speed of the motor 11 to maintain a constant pressure set point. The PID mode is further described below with respect to FIG. 11.

The controller 75 can determine the actual water pressure value from an electronic pressure transducer 15 (e.g., in communication with the controller 75 via the analog input terminals 30D). In some embodiments, as shown in FIG. 5, the pressure transducer 15 can be located near a pressure tank 17 fluidly coupled to the pump 12.

If motor 11 is off (i.e., not being driven), water pressure can still be monitored, but no actions are taken until the pressure falls below a certain value (e.g., a low band pressure value). If the water pressure falls below the low band pressure, the controller 75 can restart the motor 11. In some embodiments, the low band pressure can be set, or defaulted, to 1-10 pounds per square inch (PSI) lower than the pressure set point. Once the motor 11 is restarted, normal operation with PID control (i.e., PID mode) can commence. In one embodiment, one of two conditions can trigger the controller 75 to turn the motor 11 off. A first condition can be if a sleep mode (described with respect to FIG. 12) is triggered. A second condition can be if the pressure exceeds a certain safety value (i.e., about 20 PSI above the pressure set point). Other conditions that can stop the drive 10 are various faults (described further below), the user pressing the stop button 60, and lack of a digital input for an optional run enable mode.

For normal operation, with the motor 11 being driven, the controller 75 can regulate pump speed in a continuous fashion using PID control as long as the pressure remains below the safety pressure value, such as about 20 PSI above the pressure set point. The drive 10 can stop the motor 11 whenever the actual pressure exceeds the safety pressure value. During normal operation, as long as water usage does not exceed the motor/pump capabilities, the pressure can remain constant at approximately the pressure set point. Large instantaneous changes in flow requirements can result in variations from the desired pressure band. For example, if flow is stopped, causing the pressure to quickly increase, the motor 11 can be stopped (i.e., set to 0 Hz). This can be considered an alternate sleep mode operation and is further described below with respect to FIG. 13.

Figure 7:
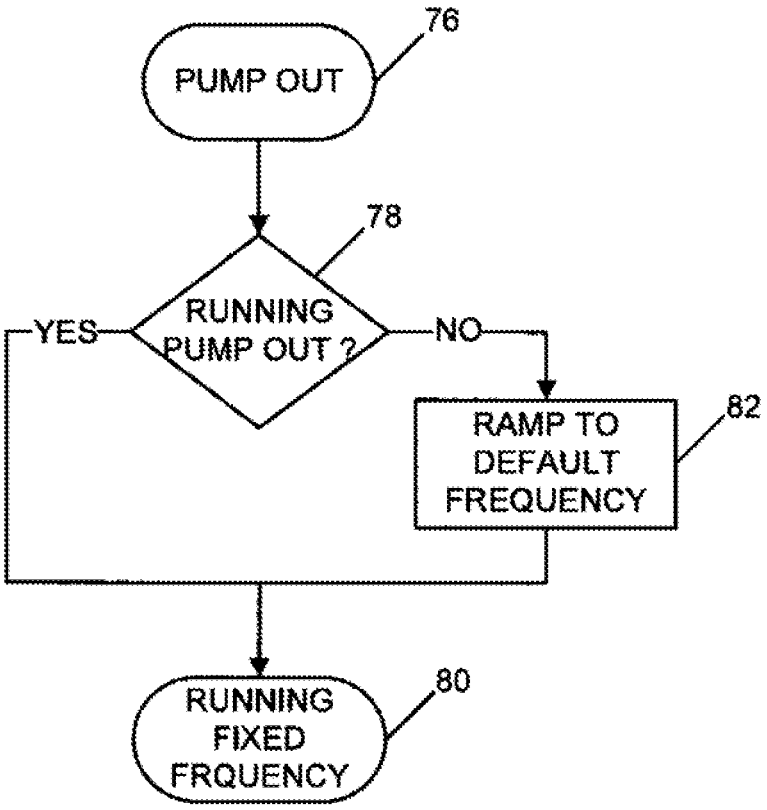
FIG. 7 is a flow chart illustrating a pump out operation.

FIGS. 7-15 are flow charts describing pump control according to some embodiments of the invention. The flow chart of FIG. 7 illustrates when the controller 75 receives a signal to run the pump in the pump out mode 76 (e.g., when the pump-out button 40 is pressed). The controller 75 first determines, at step 78, if the pump is already running in pump out mode. If so, the pump is being run at a correct, fixed frequency for pump out mode (step 80). If not, the controller 75, at step 82, ramps up the input frequency of power to the motor 11 to the correct frequency, then proceeds to step 80.

Figure 8:
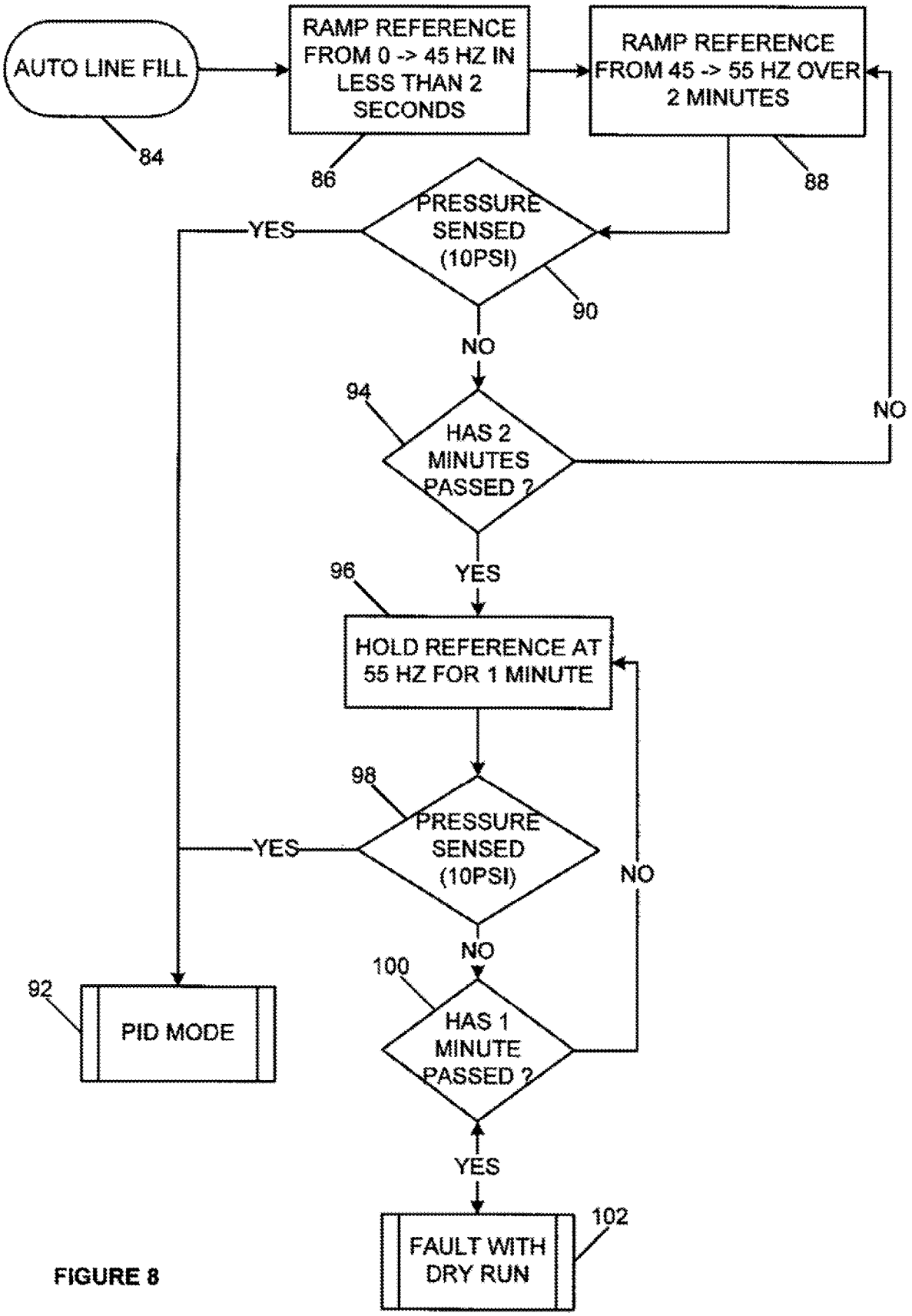
FIG. 8 is a flow chart illustrating an automatic line fill operation.

FIG. 8 illustrates an automatic line fill operation 84, according to some embodiments. This operation can automatically run at drive start-up (e.g., when the drive 10 is powered up, after a power interruption, when the motor 11 is restarted, or when the automatic start button 62 is pressed). Thus, the motor may be off (i.e., at 0 Hz) at the beginning of this operation. The controller 75 first can ramp up the frequency driving the motor from 0 Hz to about 45 Hz in less than a first time period, such as about two seconds (step 86). In a second time period, such as about two minutes, or about five minutes in some embodiments, the controller 75 can start to ramp up the frequency from, for example, about 45 Hz to about 55 Hz (step 88). During the second time period, the controller 75 determines the pressure via input from the pressure transducer 15 (step 90). If the sensed pressure has reached a minimum pressure, or pressure set point (e.g., about 10 PSI), indicating the line has been filled, the fill operation is completed and the controller 75 enters PID mode (step 92). However, if the sensed pressure is less than 10 PSI at step 90, the controller 75 determines if the second time period (e.g., about two minutes or about five minutes) has passed (step 94). If the second period has not passed, the controller 75 reverts back to step 88 and continues to ramp the motor frequency. If the second time period has passed, the controller 75 will hold the frequency at about 55 Hz for about one minute (step 96). The controller 75 then determines if the sensed pressure is about 10 PSI (step 98). If the sensed pressure is about 10 PSI, indicating the line has been filled, the fill operation is completed and the controller 75 enters PID mode (step 92). However, if the sensed pressure is still less than 10 PSI at step 90, the controller 75 determines if one minute has passed (step 100). If one minute has not passed, the controller 75 reverts back to step 96. If one minute has passed, a dry run fault is recognized and a dry run fault operation is executed (step 102) (e.g., the system is stopped).

In one alternative embodiment, step 88 can include setting the frequency to about 45 Hz for the second time period, and if the sensed pressure is less than 10 PSI after the second time period, repeating step 88 with the frequency set to about 50 Hz for another second time period. If the sensed pressure is still less than 10 PSI after the second time period while at 50 Hz, step 88 can be repeated with the frequency set to about 55 Hz for yet another second time period. If the sensed pressure is still less than 10 PSI after the second time period while at 55 Hz, the controller 75 can continue to step 96.

Figure 9:
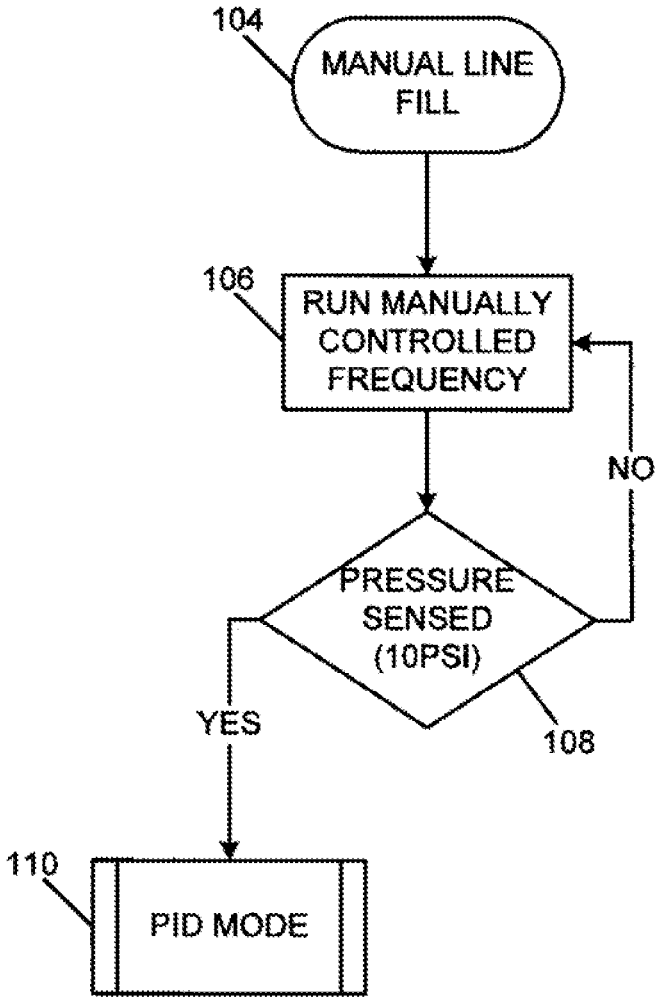
FIG. 9 is a flow chart illustrating a manual line fill operation.

FIG. 9 illustrates a manual line fill operation 104, according to some embodiments. The motor 11 is run at a manually-controlled frequency (e.g., entered by a user) at step 106. The motor 11 keeps running at this frequency until the sensed pressure reaches about 10 PSI (step 108). Once the sensed pressure has reached about 10 PSI, the controller 75 enters PID mode (step 110). In some embodiments, if the controller 75 does not enter PID mode within a time period (e.g., fifteen minutes), the drive 10 is stopped.

The manual fill line operation can be considered always enabled because it can be executed at any time during the auto line fill operation. For example, by using the up and down directional buttons 52 on the control pad 14, the user can interrupt the automatic line fill operation and adjust the frequency output to the motor 11, thus changing the motor speed. Once in manual line fill mode, the user can continue to change the speed as needed at any time. The motor 10 can continue at the new set frequency until the sensed pressure reaches about 10 PSI, and then it will proceed to PID mode, as described above. The manual fill line operation can be beneficial for both vertical or horizontal pipe fill applications. In addition, both the automatic fill line operation and the manual fill line operation can prevent common motor issues seen in conventional systems, such as motor overloading and the occurrence of water hammering.

Figure 10:
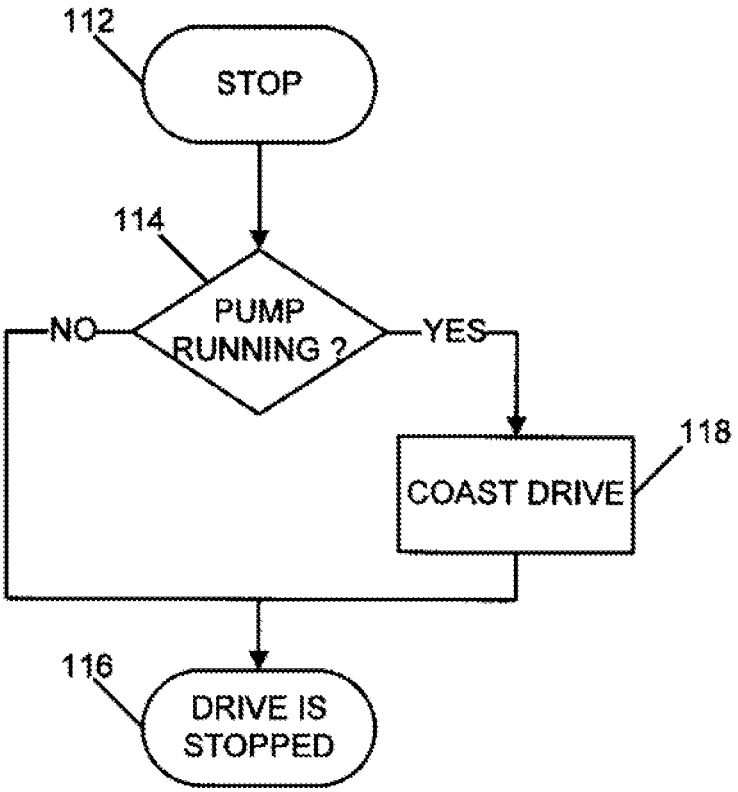
FIG. 10 is a flow chart illustrating a stop operation.

FIG. 10 illustrates a stop operation 112, according to some embodiments. The controller 75 determines if the pump is running (step 114). If the pump is not running (e.g., if the drive 10 is in sleep mode or a run enable command is not triggered), the drive 10 is stopped (step 116). If the pump is running, the motor is allowed to coast to a stop (i.e., 0 Hz) at step 118, then proceeds to step 116.

Figure 11:
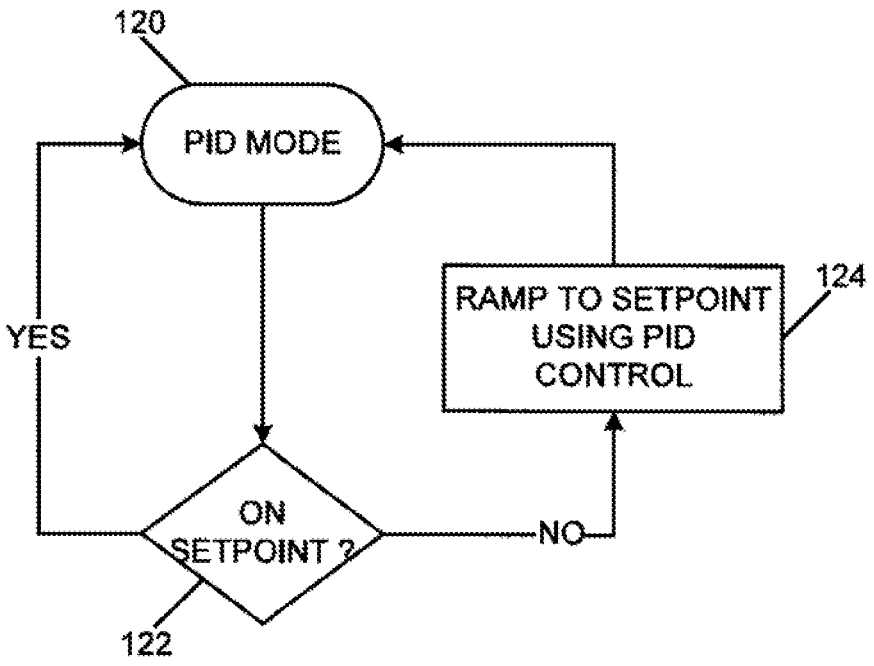
FIG. 11 is a flow chart illustrating a proportional/integral/derivative (PID) mode control operation.

FIG. 11 illustrates a PID mode operation 120, according to some embodiments. The controller 75 continuously determines if the pressure is at a programmed set point (step 122). If the pressure is not at the programmed set point, PID feedback control is used to ramp the frequency until the pressure reaches the set point (step 124).

Figure 12:
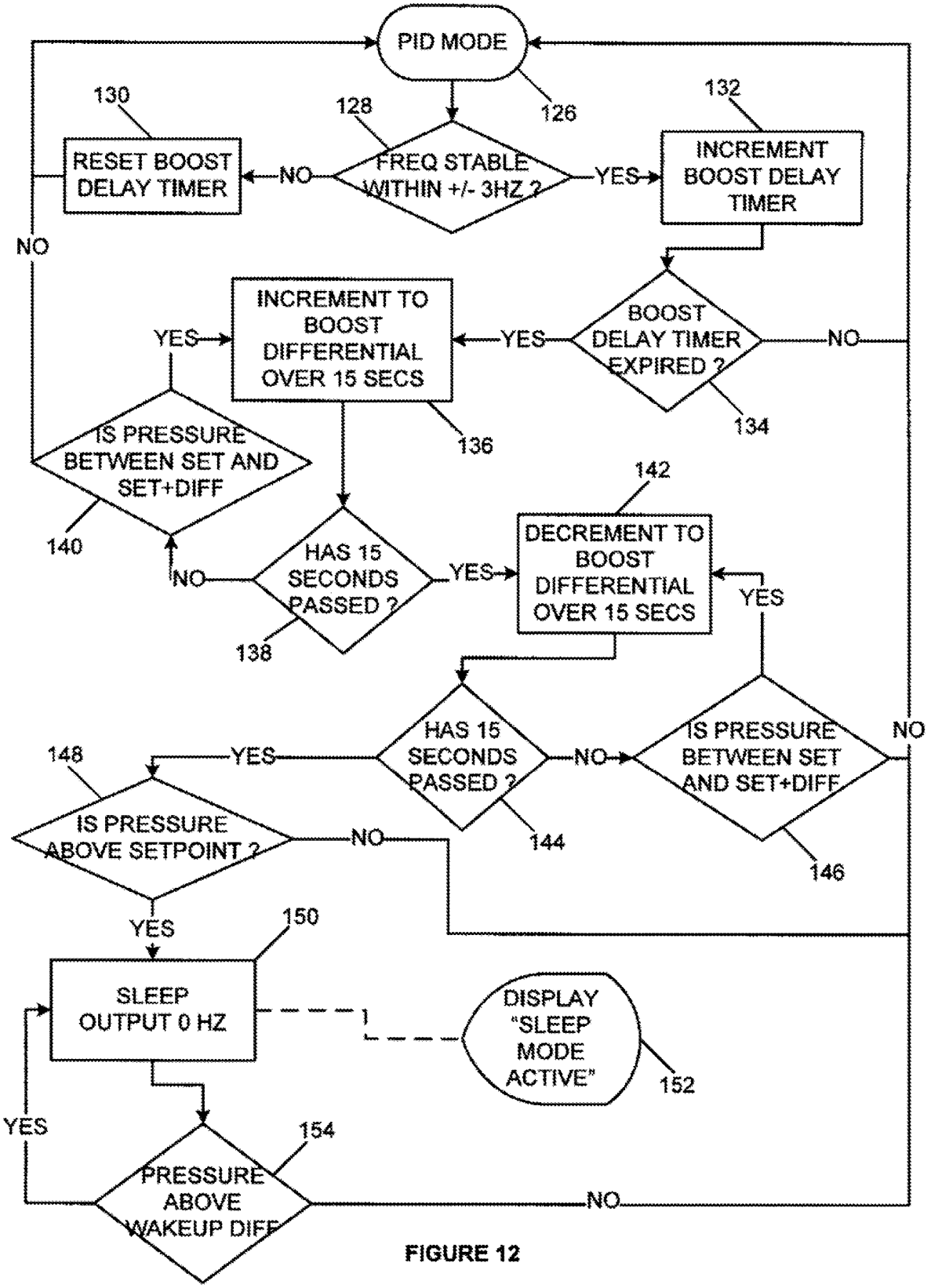
FIG. 12 is a flow chart illustrating a sleep mode operation.

FIG. 12 illustrates the controller 75, running in PID mode (at step 126), checking if the pump should enter a sleep mode. First, at step 128, the controller 75 determines if the frequency of the motor 11 is stable within about +/−3 Hz (e.g., at a steady-state frequency). If not (step 130), a boost delay timer is reset and the controller 75 reverts to step 126. If the frequency of the motor 11 is stable, the boost delay timer is incremented at step 132. If, at step 134 the boost delay timer is not expired after being incremented, the controller 75 reverts back to step 126. However, if, at step 134 the boost delay timer has expired, the controller 75 proceeds to step 136 and the pressure is boosted (e.g., about 3 PSI above the pressure set point) for a short period of time (e.g., about 15 seconds or about 30 seconds).

Until the short period of time has passed (step 138), the controller 75 determines if the pressure stays between the pressure set point (e.g., about 10 PSI) and the boosted pressure (step 140). If, in that short period of time, the pressure falls outside (i.e., below) the range between the pressure set point and the boosted pressure, the controller 75 reverts back to step 126. If, however, the pressure stays between the pressure set point and the boosted pressure, the controller 75 then decrements the pressure over another short period of time (step 142). Until the short period of time has passed (step 144), the controller 75 determines if the pressure stays between the pressure set point (e.g., the steady-state pressure) and the boosted pressure (step 146). If, in that short period of time, the pressure falls outside the range between the pressure set point and the boosted pressure, indicating that there is flow occurring, the controller 75 reverts back to step 126. If, however, the pressure stays between the pressure set point and the boosted pressure, indicating no flow, the controller 75 then determines if the pressure is above the pressure set point (step 148). If not, the controller 75 reverts back to step 126. If the pressure is above the pressure set point, the pump enters the sleep mode causing the motor frequency to coast down to 0 Hz (step 150) and a "sleep mode active" message to be displayed on the liquid crystal display 36 (step 152). While in sleep mode, at step 154, the controller 75 continuously determines if the pressure stays above a wakeup differential pressure (e.g., about 5 PSI below the pressure set point). If the pressure drops below the wakeup differential pressure, the controller 75 reverts back to step 126.

In some embodiments, the controller 75 will only proceed from step 126 to step 128 if the pressure has been stable for at least a minimum time period (e.g., one or two minutes). Also, when the controller 75 cycles from step 128 to step 130 and back to step 126, the controller 75 can wait a time period (e.g., one or two minutes) before again proceeding to step 128. In some embodiments, the controller 75 can determine if the motor speed is stable at step 128. In addition, the controller 75 can perform some steps of FIGS. 11 and 12 simultaneously.

By using the sleep mode operation, a separate device does not need to be purchased for the drive 10 (e.g., a flow meter). Further, the sleep mode operation can self-adjust for changes in pump performance or changes in the pumping system. For example, well pump systems often have changes in the depth of the water in the well both due to drawdown as well as due to time of year or drought conditions. The sleep mode operation can be executed independent of such changes. In addition, the sleep mode operation does not require speed conditions specific to the pump being used.

Figure 13:
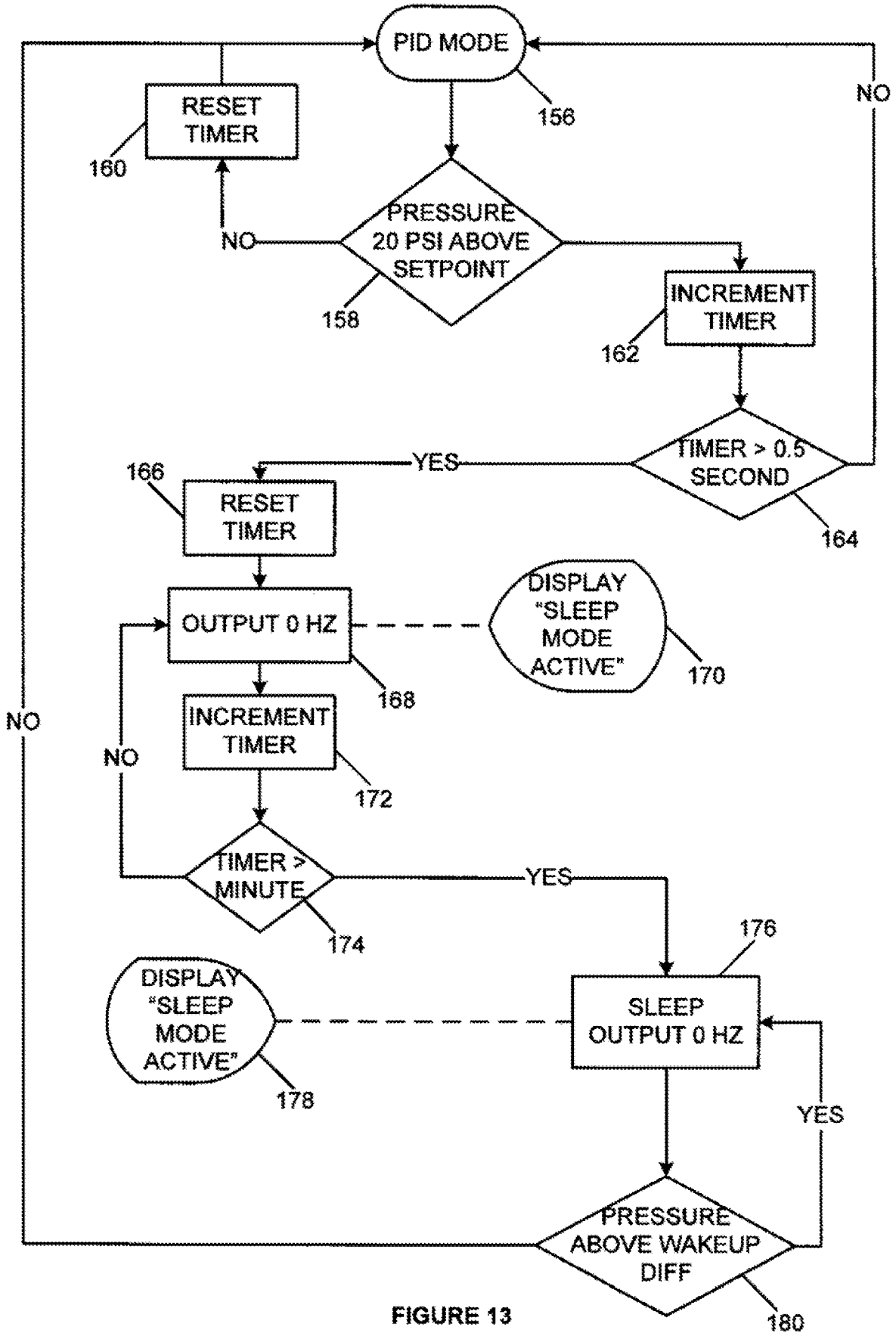
FIG. 13 is a flow chart illustrating an alternate sleep mode operation.

FIG. 13 illustrates the controller 75, running in PID mode, checking if the pump should enter an alternate sleep mode 156. First, at step 158, the controller 75 determines if pressure is at a preset value above the pressure set point (e.g., 20 PSI above the pressure set point). If not (step 160), a timer is reset and the controller 75 reverts to step 156. If the pressure is 20 PSI above the pressure set point, the timer is incremented at step 162. If, at step 164 the timer is less than a value, such as 0.5 seconds, the controller 75 reverts back to step 156. However, if, at step 164 the timer has exceeded 0.5 seconds, the controller 75 proceeds to step 166 and the timer is reset. The controller 75 then sets the motor frequency to 0 Hz (step 168) and displays a "sleep mode active" message 170 on the liquid crystal display 36. The controller 75 then again increments the timer (step 172) until the time reaches another value, such as 1 minute (step 174), and then proceeds to step 176. At step 176, the controller 75 keeps the motor frequency at 0 Hz and displays a "sleep mode active" message 178 on the liquid crystal display 36 as long as the pressure is above a wakeup differential pressure (step 180). If the pressure drops below the wakeup differential pressure (e.g., water is being used), the controller 75 reverts back to step 156.

Figure 14:
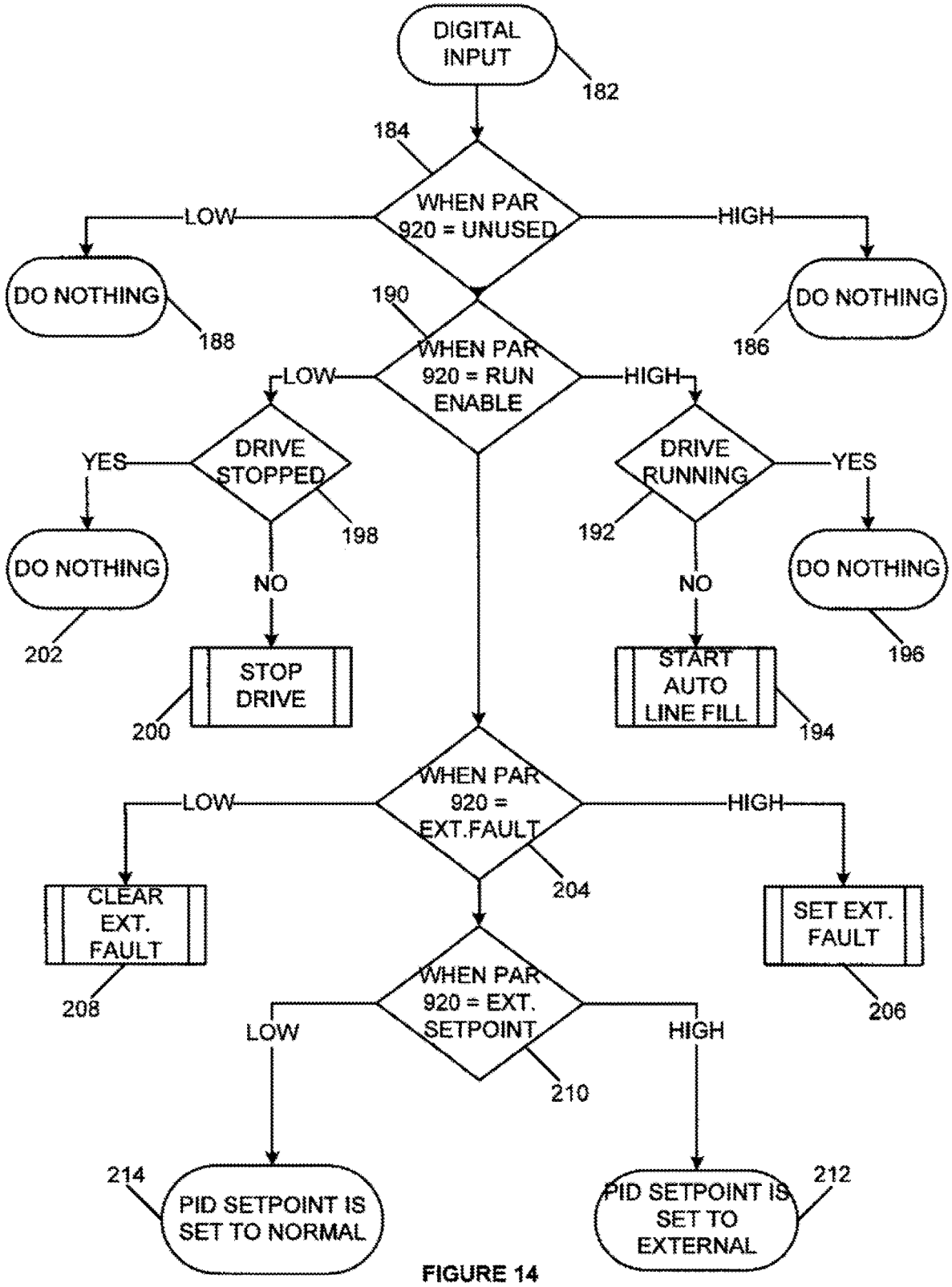
FIG. 14 is a flow chart illustrating a digital input control operation.

FIG. 14 illustrates an example of controller operation using the digital input. The controller 75 first recognizes a digital input (step 182). If an external input parameter is unused (step 184), the controller 75 takes no action whether the input is high or low (steps 186 and 188, respectively). If the external input parameter is set to a run enabled mode (step 190) and the input is high (e.g., indicating allowing the drive 10 to be run), the controller 75 determines if the drive 10 is running (step 192). If the drive 10 is running, the controller 75 can take no action (step 196) and continue in its current mode of operation. If the drive 10 is not running, the controller 75 can start an auto line fill operation (step 194), as described with reference to FIG. 8 (e.g., similar to actions taken if the auto start button 62 is pressed). If the external input parameter is set to a run enabled mode (step 190) and the input is low (e.g., indicating to stop the drive 10), the controller 75 can check if the drive 10 is stopped (step 198). If the drive 10 is not stopped, the controller 75 can execute a stop operation (step 200), as described with reference to FIG. 10. If the drive 10 is stopped, the controller 75 can take no action (step 202). If the external input parameter is set to an external fault mode (step 204) and the input is high (e.g., indicating an external fault), the controller 75 can perform an external fault operation (step 206), as described with reference to FIG. 47. If the external input parameter is set to an external fault mode (step 204) and the input is low (e.g., indicating there is no external fault), the controller 75 can clear any external fault indications (step 208). If the external input parameter is set to an external set point mode (step 210) and the input is high, the controller 75 sets the PID set point to "external" (step 212), for example, so that the digital input controls the pressure set point for PID pressure control. If the external input parameter is set to an external set point mode (step 210) and the input is low, the controller 75 sets the PID set point to "normal" (step 214), for example, so that the digital input has no control over the pressure set point for PID pressure control.

Figure 15:
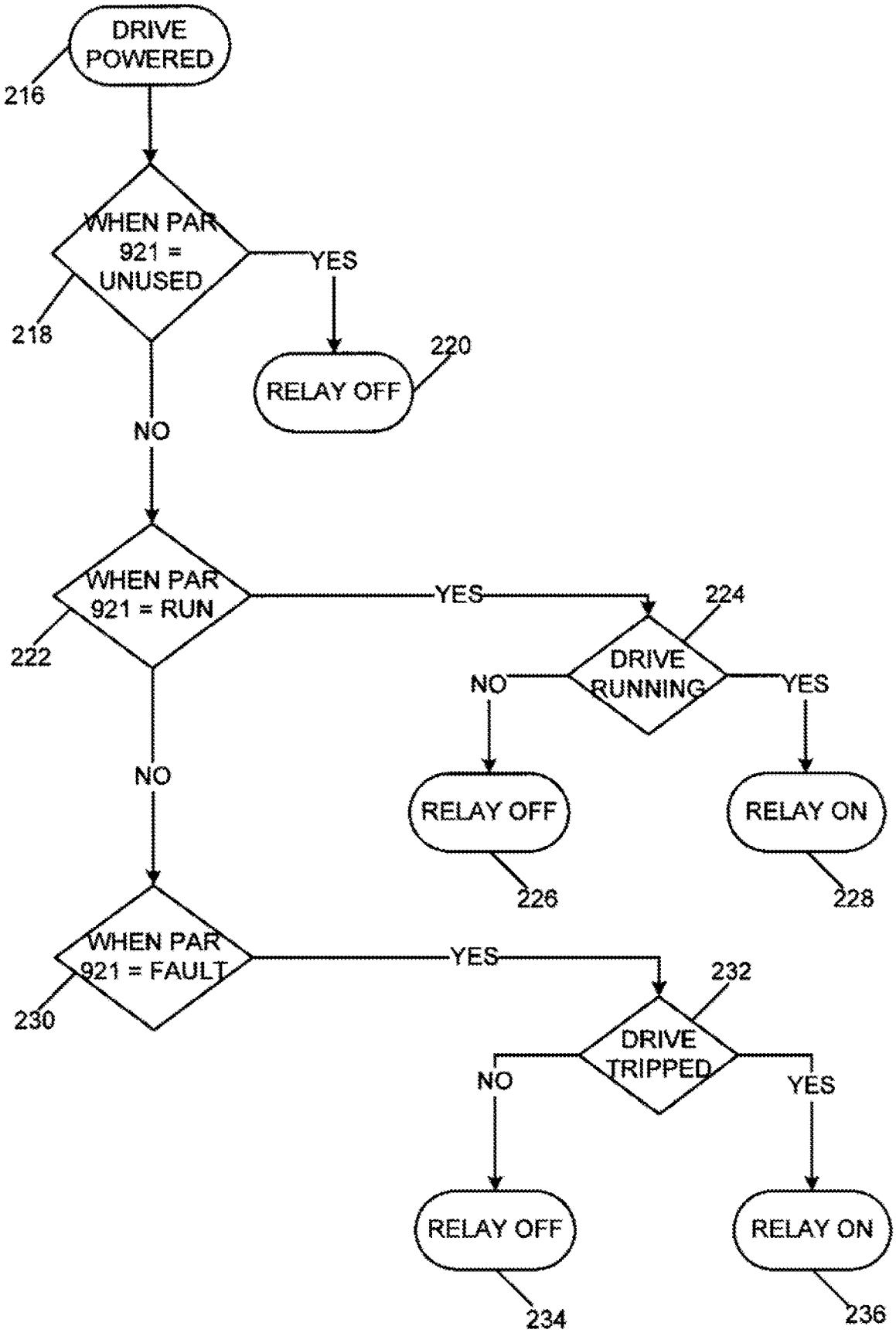
FIG. 15 is a flow chart illustrating a relay output control operation.

FIG. 15 illustrates controller operation of a relay output. When the drive 10 is powered (step 216), the controller 75 determines if a relay output parameter is unused (step 218). If so, the controller 75 turns the relay off (step 220). If not, the controller 75 determines if the relay output parameter is set to a run mode (step 222). If the relay output parameter is set to a run mode (at step 222), the controller 75 determines if the drive 10 is running (step 224). The controller 75 will then turn the relay off if the drive 10 is not running (step 226) or turn the relay on if the drive 10 is running (step 228). If the relay output parameter is not set to a run mode (at step 222), the controller 75 determines if the relay output parameter is set to a fault mode (step 230). If so, the controller 75 determines, at step 232, if the drive 10 is tripped (e.g., a fault has occurred and the drive 10 has been stopped). The controller 75 will then turn the relay off if the drive 10 has not been tripped (step 234) or turn the relay on if the drive 10 has been tripped (step 236). For example, if an alarm is the relay output, the alarm can be activated if the drive 10 has been tripped to indicate the fault condition to the user.

Figure 16:
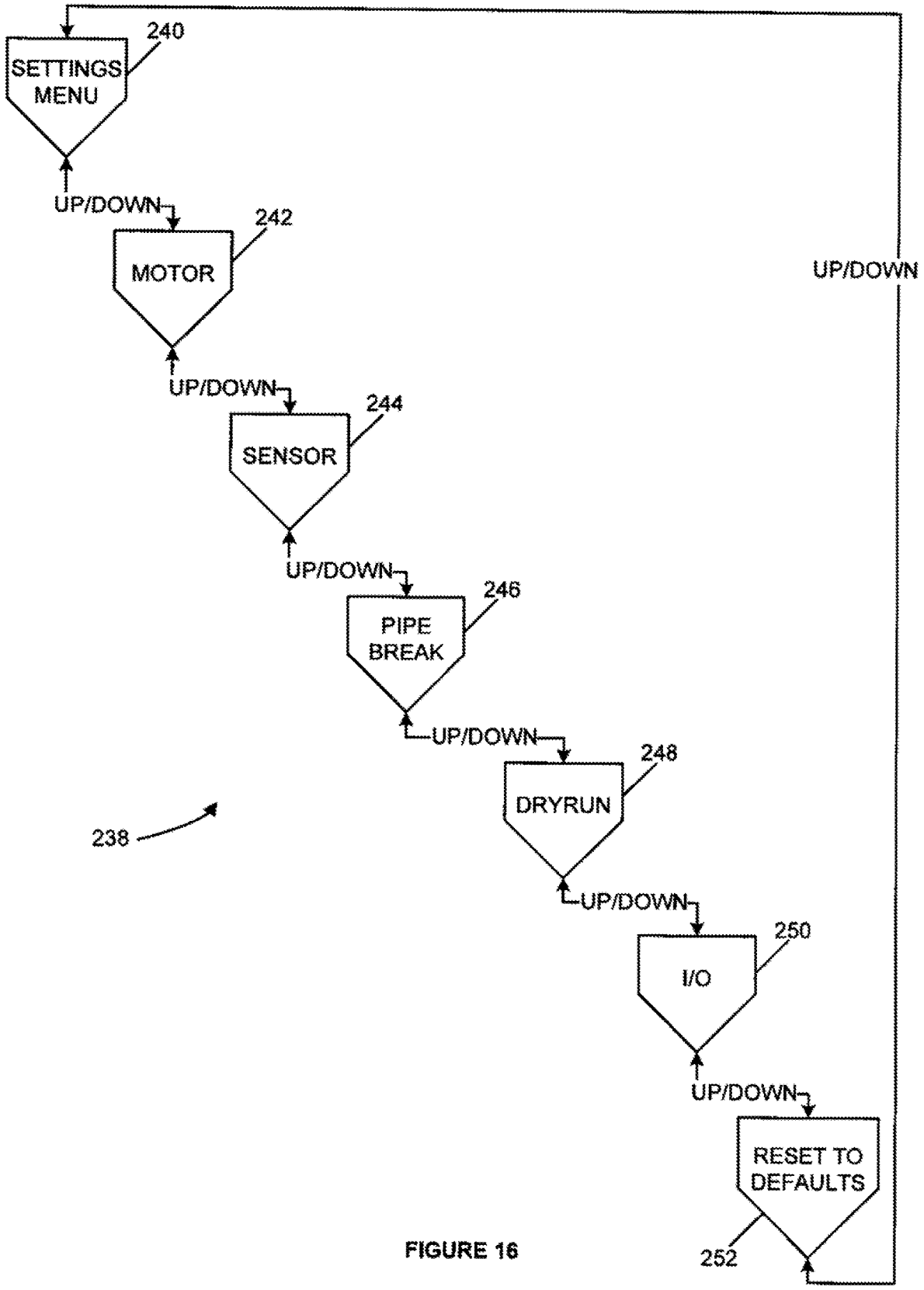
FIG. 16 is a flow chart illustrating a main menu.

FIGS. 16-29 are flow charts describing menu operations according to some embodiments of the invention. FIG. 16 illustrates a main menu 238 of the controller 75. The main menu 238 can include the following parameters: settings menu 240, motor 242, sensor 244, pipe break 246, dry run 248, I/O (input/output) 250, and reset to defaults 252. The user can view the main menu 238 on the liquid crystal display 36 using the main menu button 44 on the control pad 14. The user can then toggle up and down through the parameters of the main menu 238 using the directional buttons 52. The user can select a parameter using the enter button 56.

Figure 17:
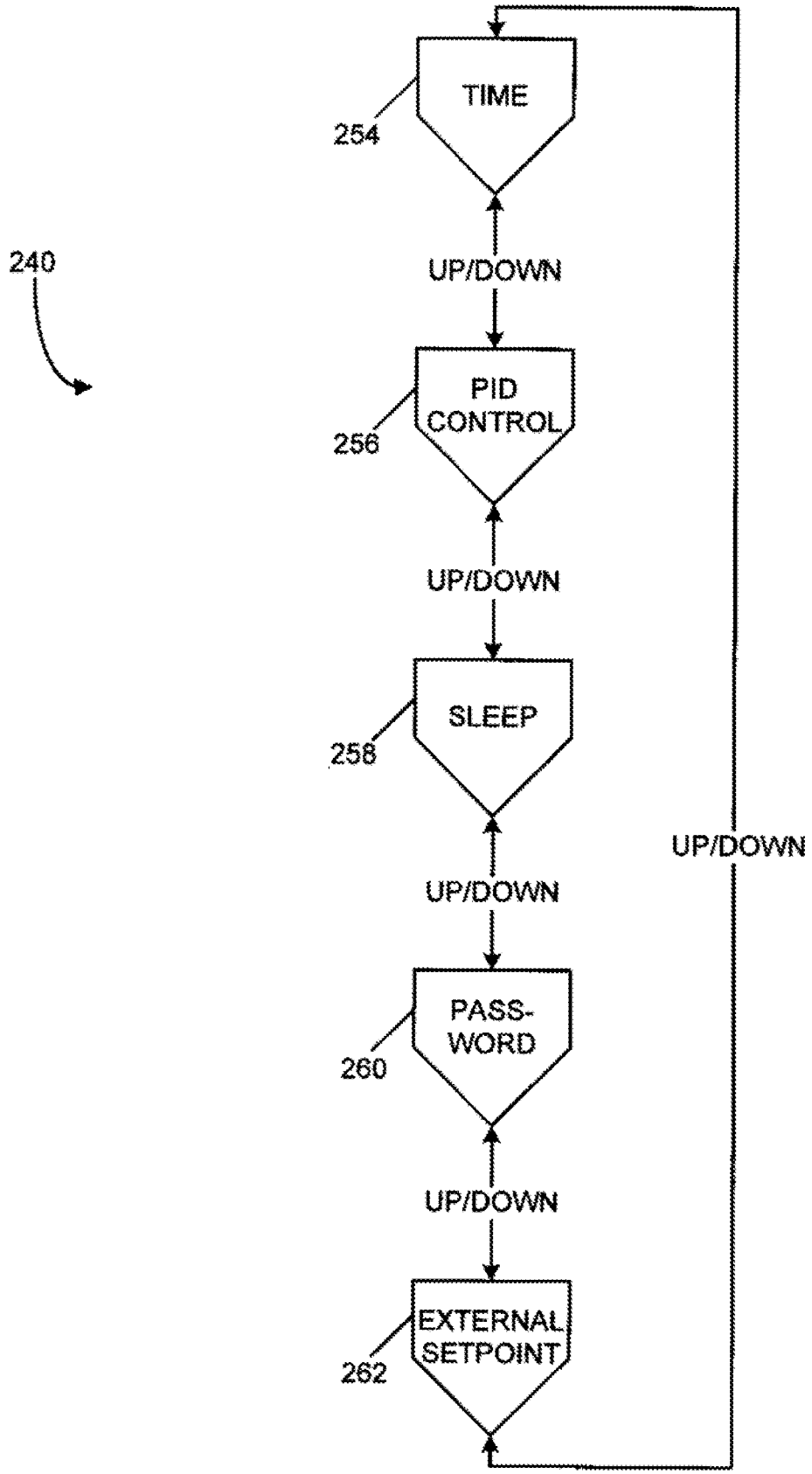
FIG. 17 is a flow chart illustrating a settings menu.

From the main menu 238, the user can select the settings menu 240. The user can toggle up and down through the settings menu 240 to view the following parameters, as shown in FIG. 17: time 254, PID control 256, sleep 258, password 260, and external set point 262.

Figure 18:
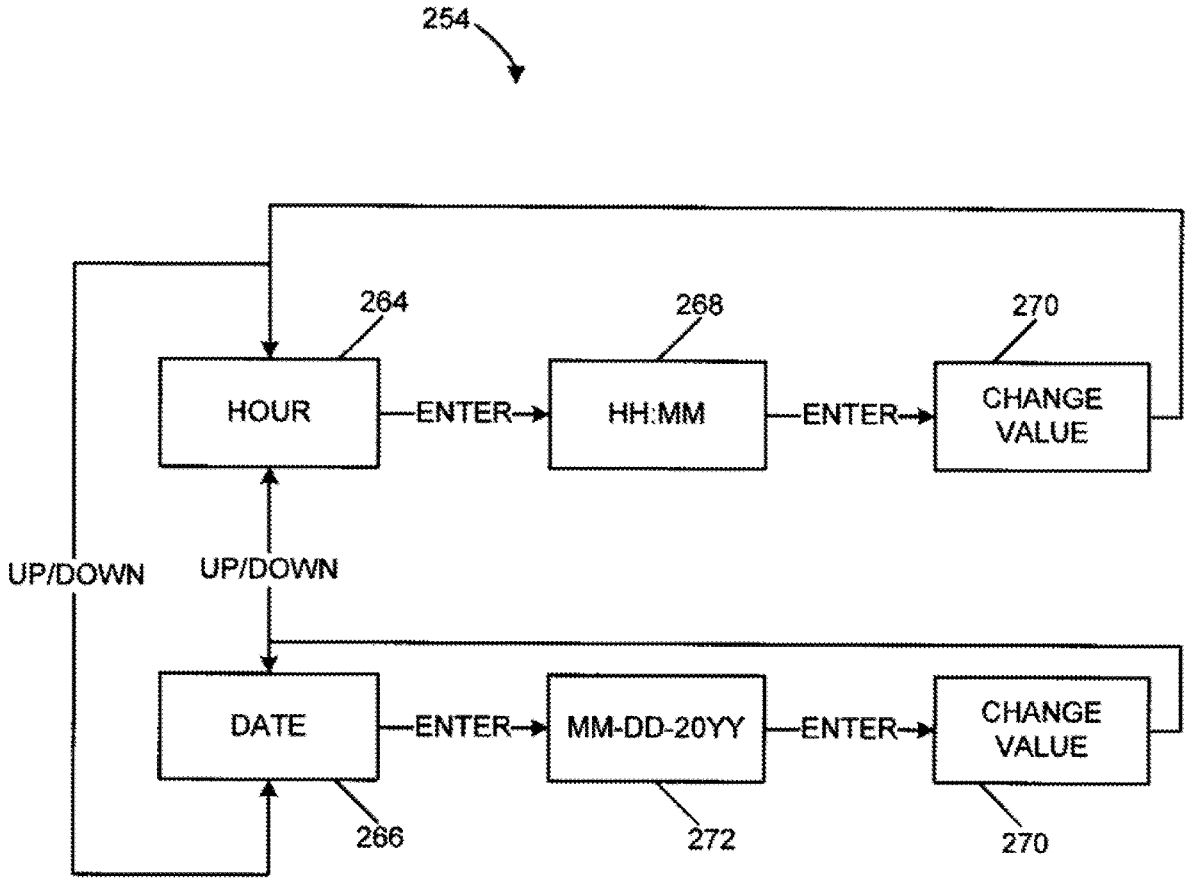
FIG. 18 is a flow chart illustrating a time parameter menu.

FIG. 18 illustrates the user's options after selecting the time parameter 254 from the settings menu 240. The user can toggle up and down between setting a current hour 264 or a date 266. If the user selects the hour parameter 264, the user can enter a current time 268, and a time value for the controller 75 will be changed according to the user's input 270. If the user selects the date parameter 266, the user can enter a current date 272 and a date value for the controller 75 will be changed according to the user's input 270.

Figure 19:
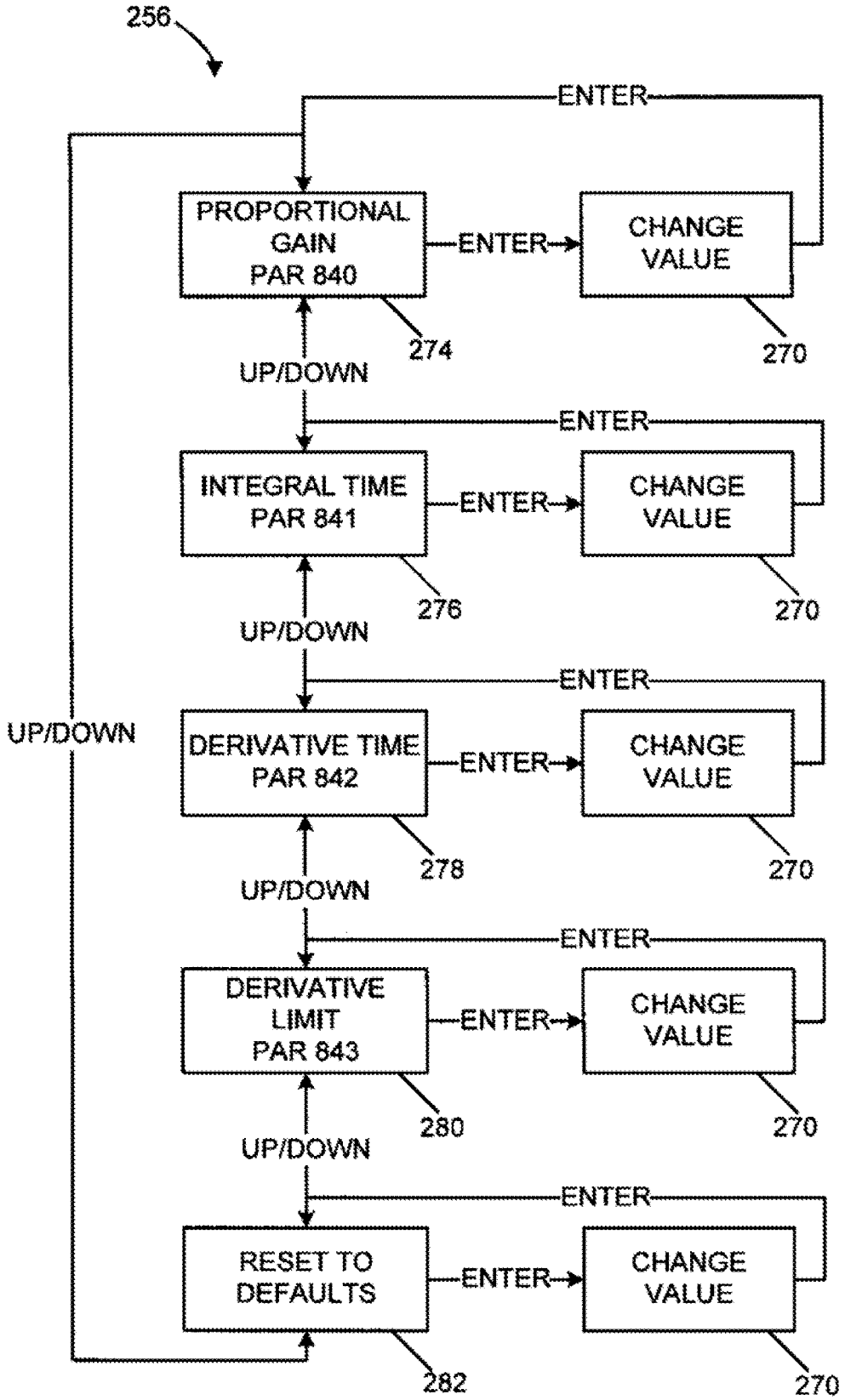
FIG. 19 is a flow chart illustrating a PID control parameter menu.

FIG. 19 illustrates the user's options after selecting the PID control parameter 256 from the settings menu 240. The following parameters can be chosen after selecting PID control 256: proportional gain 274, integral time 276, derivative time 278, derivative limit 280, and restore to defaults 282. The user can select any of the parameters 274-282 to modify one or more preferences associated with the parameters, and appropriate values for the controller 75 will be changed 270.

Figure 20:
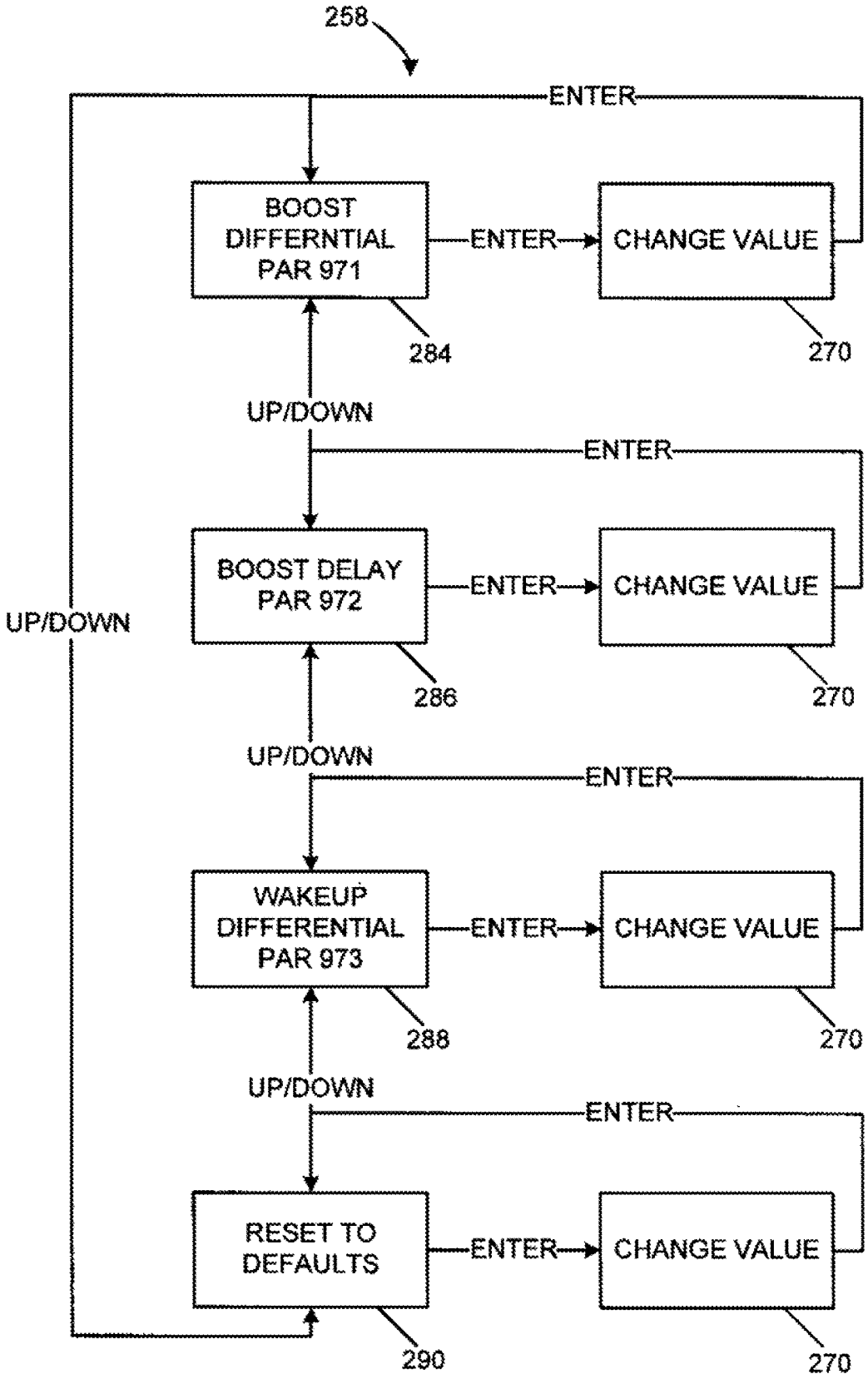
FIG. 20 is a flow chart illustrating a sleep parameter menu.

FIG. 20 illustrates the user's options after selecting the sleep parameter 258 from the settings menu 240. The following parameters can be chosen after selecting sleep 258: boost differential 284, boost delay 286, wakeup differential 288, and restore to defaults 290. The user can select any of the parameters 284-290 to modify one or more preferences associated with the parameters, and appropriate values for the controller 75 will be changed 270. The parameters can be set to modify or adjust the sleep mode operation described with reference to FIG. 12.

Figure 21:
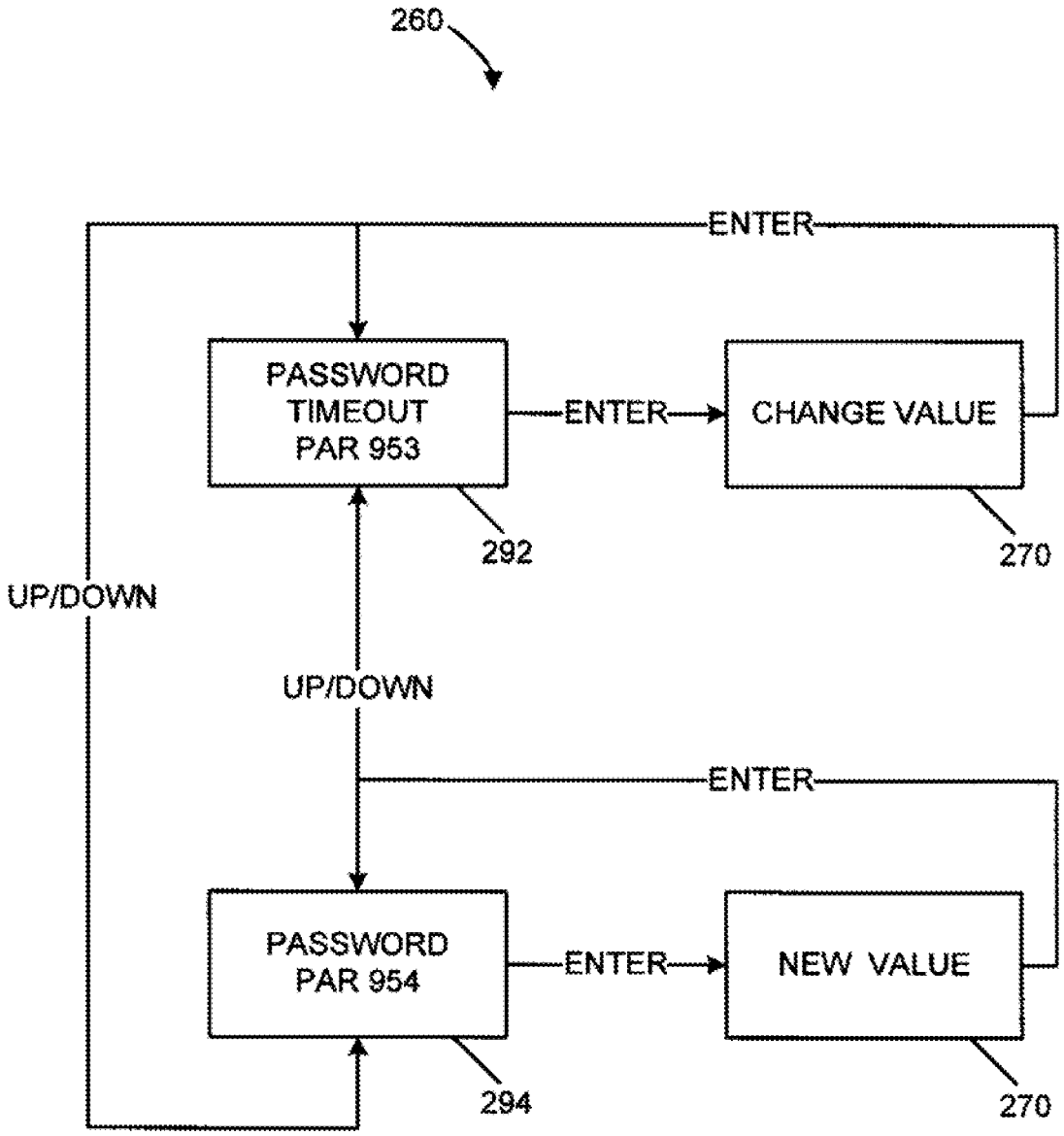
FIG. 21 is a flow chart illustrating a password parameter menu.

FIG. 21 illustrates the user's options after selecting the password parameter 260 from the settings menu 240. The following parameters can be chosen after selecting password 260: password timeout 292 and password 294. The user can select any of the parameters 292-294 to modify one or more preferences associated with the parameters, and appropriate values for the controller 75 will be changed 270. The password timeout parameter 292 can include a timeout period value. If the control pad 14 is not accessed within the set timeout period, the controller 75 175 can automatically lock the control pad 14 (i.e., enter a password protection mode). To unlock the keys, or leave the password protection mode, the user must enter the password that is set under the password parameter 294. This is further described below with reference to FIG. 56.

Figure 22:
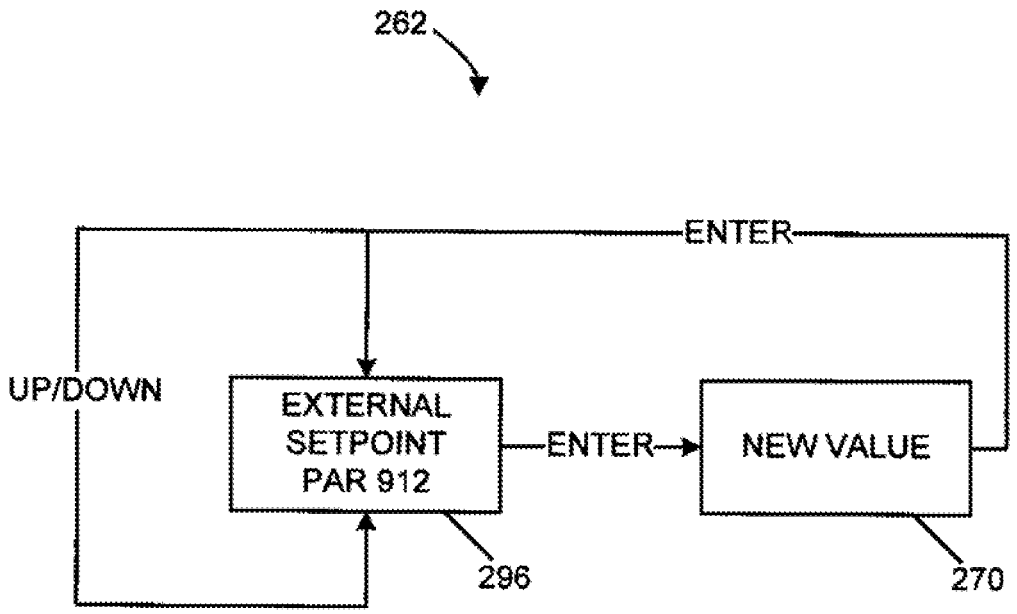
FIG. 22 is a flow chart illustrating an external set point parameter menu.

FIG. 22 illustrates the user's options after selecting the external set point parameter 262 from the settings menu 240. The user can select the external set point parameter 296 to modify one or more preferences associated with the parameter 296, and appropriate values for the controller 75 will be changed 270.

Figure 23:
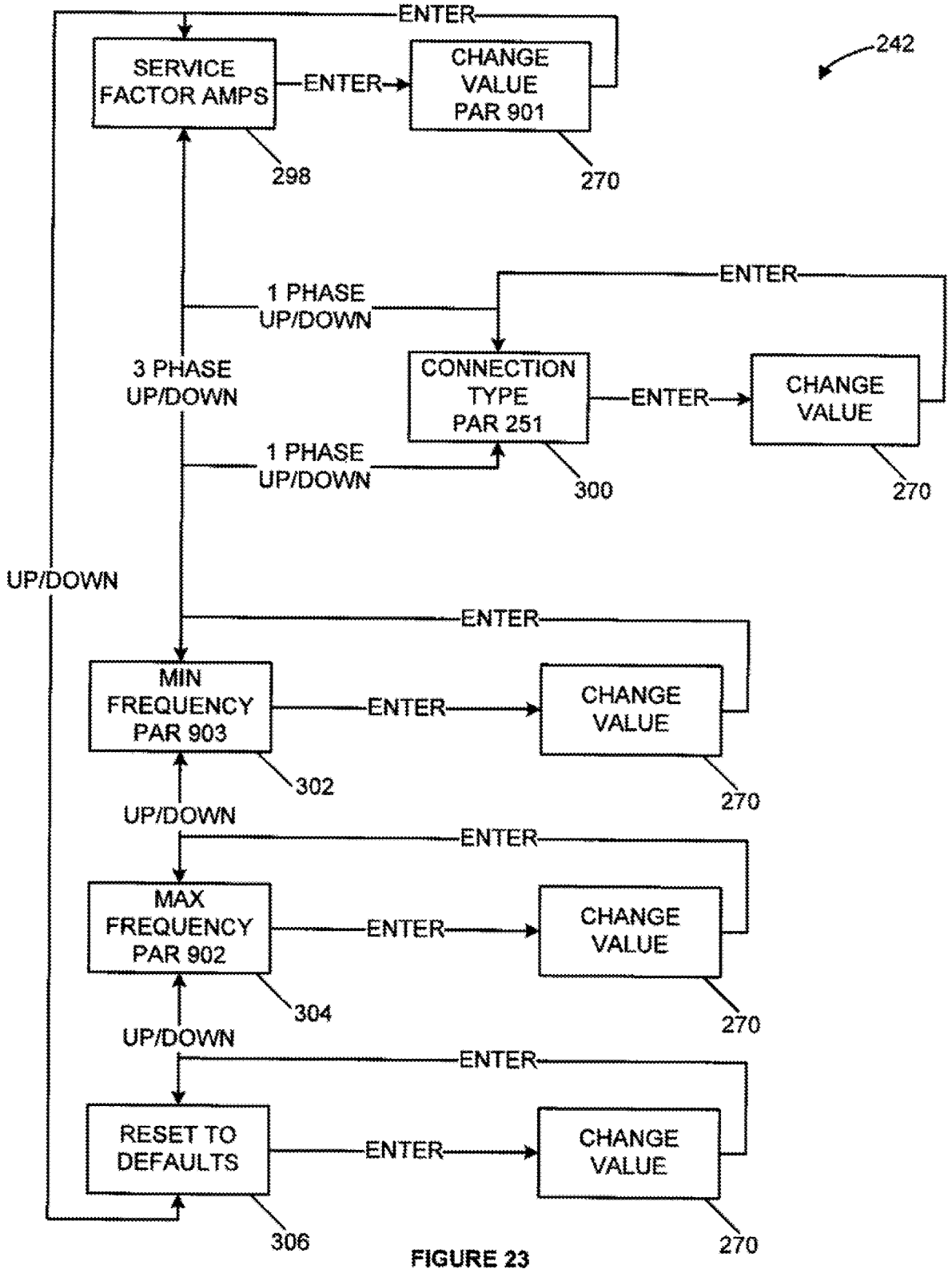
FIG. 23 is a flow chart illustrating a motor parameter menu.

FIG. 23 illustrates the user's options after selecting the motor parameter 242 from the main menu 238. The following parameters can be chosen after selecting motor 242: service factor amps 298, connection type 300, minimum frequency 302, maximum frequency 304, and restore to defaults 306. The connection type parameter 300 may only be available if the drive 10 is being used to run a single-phase motor. If the drive 10 is being used to run a three-phase motor, the connection type parameter 300 may not be provided. The user can select any of the parameters 298-306 to modify one or more preferences associated with the parameters, and appropriate values for the controller 75 will be changed 270.

Figure 24:
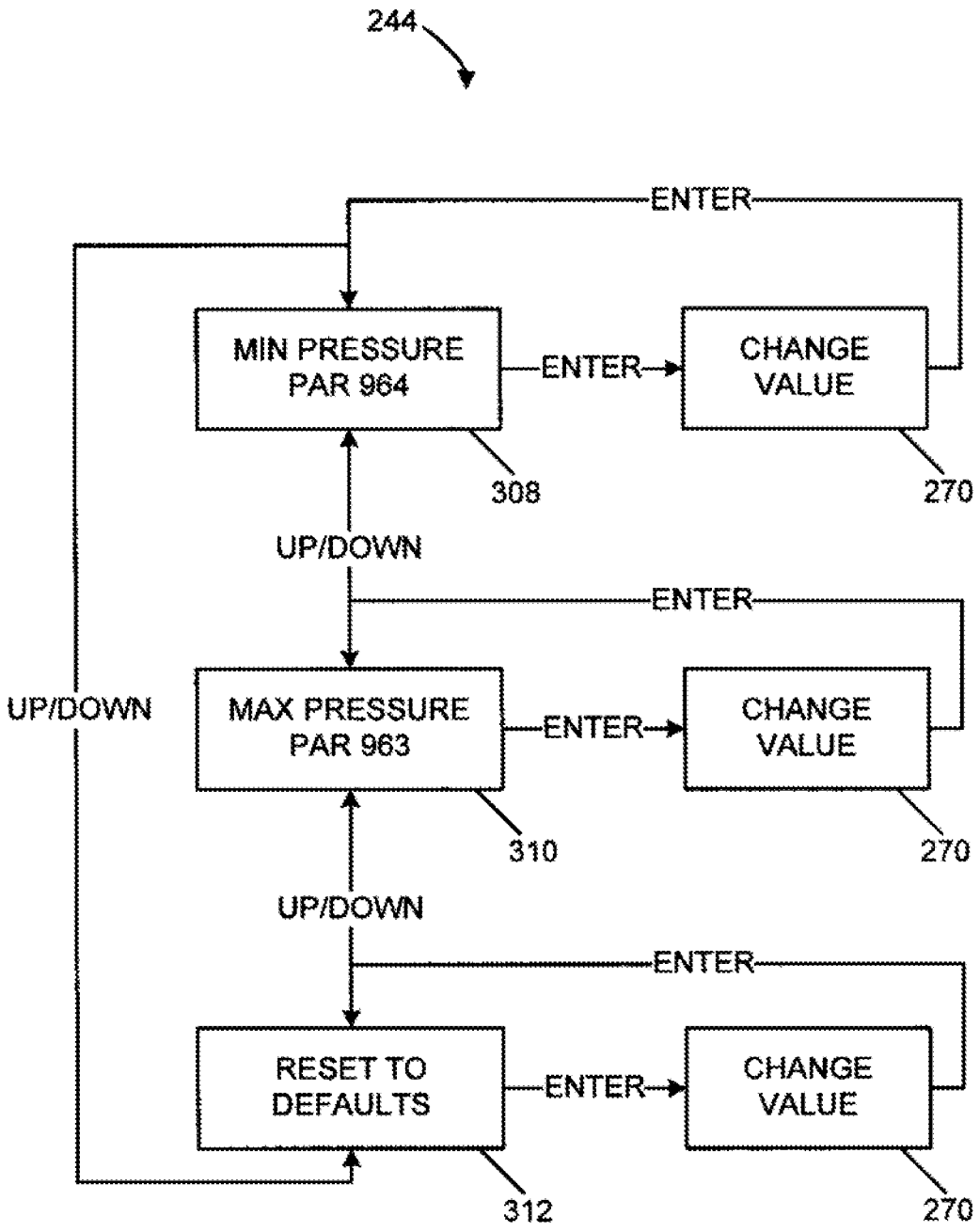
FIG. 24 is a flow chart illustrating a sensor parameter menu.

FIG. 24 illustrates the user's options after selecting the sensor parameter 244 from the main menu 238. The following parameters can be chosen after selecting sensor 244: minimum pressure 308, maximum pressure 310, and restore to defaults 312. The user can select any of the parameters 308-312 to modify one or more preferences associated with the parameters, and appropriate values for the controller 75 will be changed 270.

Figure 25:
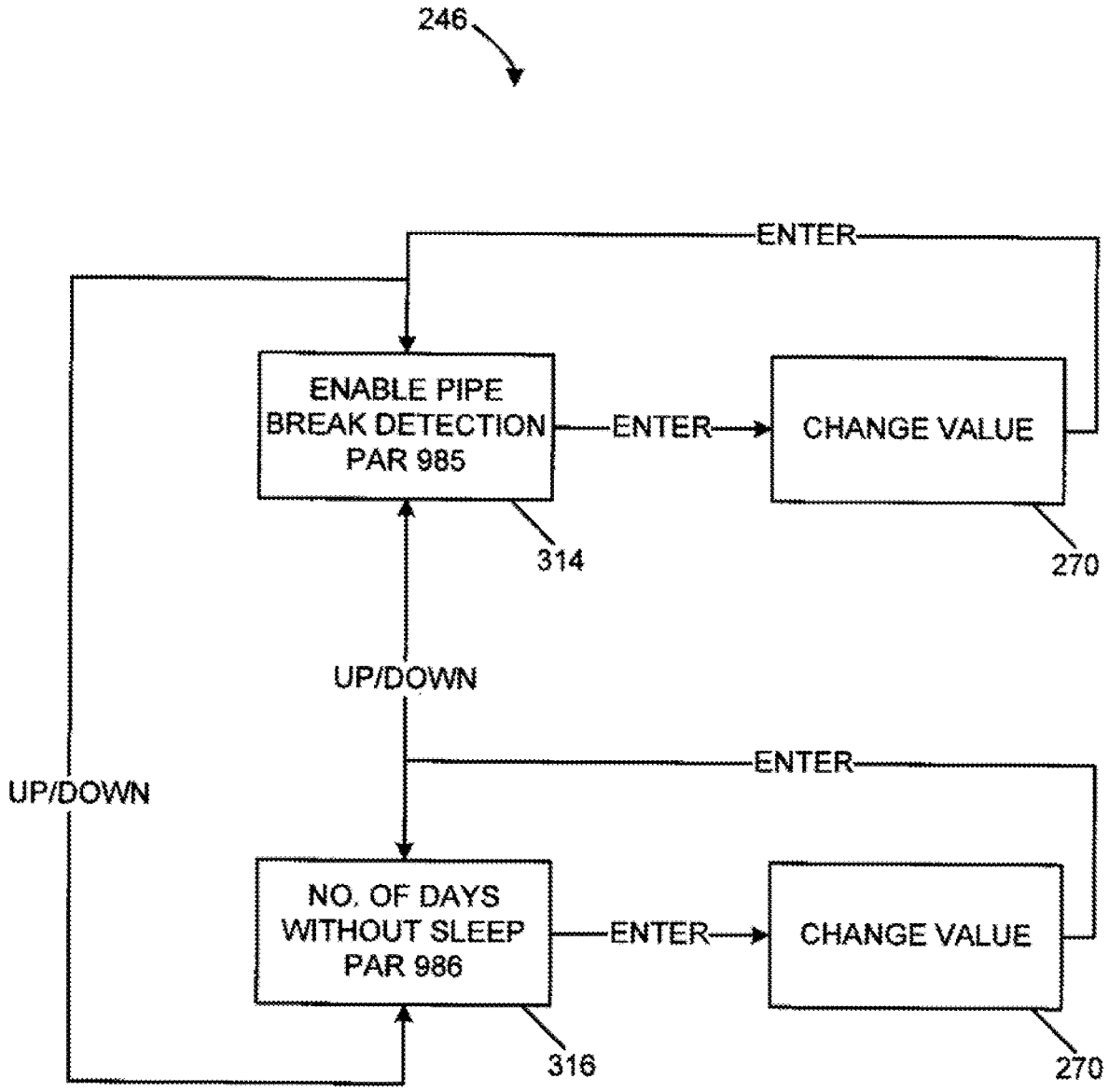
FIG. 25 is a flow chart illustrating a pipe break parameter menu.

FIG. 25 illustrates the user's options after selecting the pipe break parameter 246 from the main menu 238. The following parameters can be chosen after selecting pipe break 246: enable pipe break detection 314 and number of days without sleep 316. The user can select either of the parameters 314-316 to modify one or more preferences associated with the parameters, and appropriate values for the controller 75 will be changed 270. In some embodiments, the number of days without sleep parameter 316 can include values in the range of about four hours to about fourteen days. The enable pipe break detection parameter 314 can allow the user to enable or disable pipe break detection.

Figure 26:
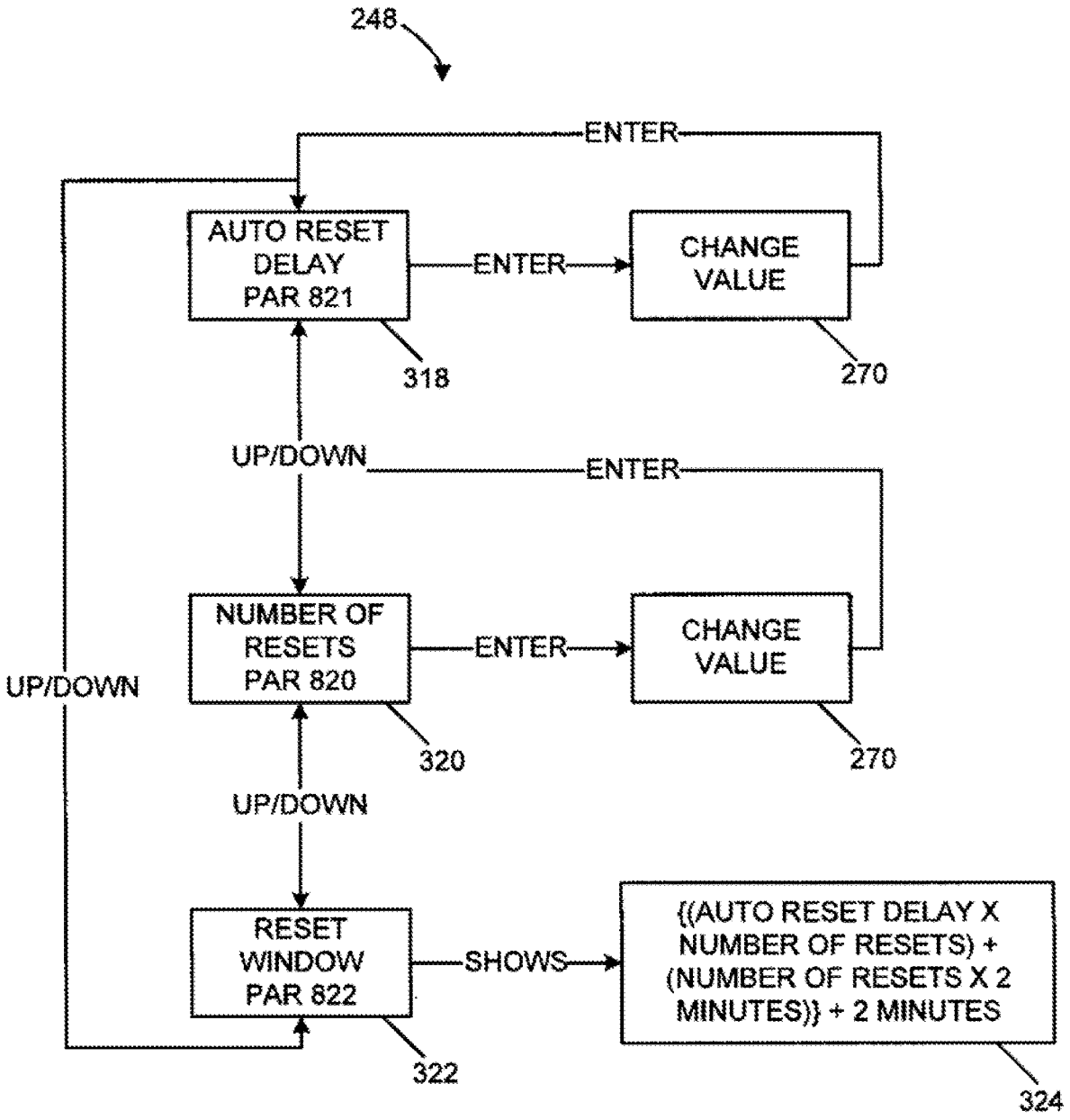
FIG. 26 is a flow chart illustrating a dry run parameter menu.

FIG. 26 illustrates the user's options after selecting the dry run parameter 248 from the main menu 238. The following parameters can be chosen after selecting dry run 248: auto reset delay 318, number of resets 320, and reset window 322. The user can select either of the parameters 318-320 to modify one or more preferences associated with the parameters, and appropriate values for the controller 75 will be changed 270. The user can select the reset window parameter 322 to view a value 324 indicating a reset window of the controller 75. The reset window value can be based from the values chosen for the auto reset delay 318 and the number of resets 320. Thus, the reset window parameter 322 can be a view-only (i.e., non-adjustable) parameter.

Figure 27:
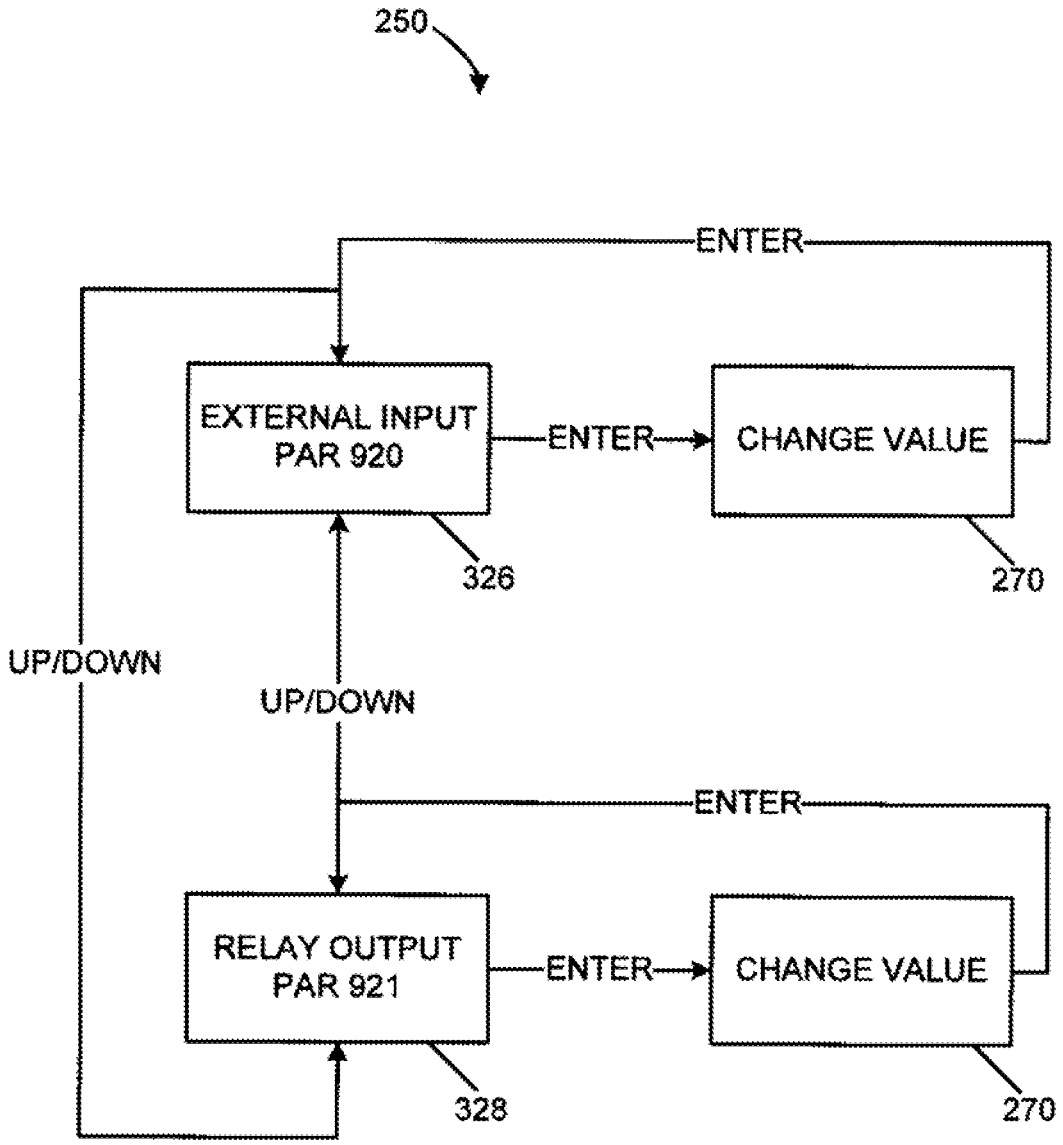
FIG. 27 is a flow chart illustrating an input/output parameter menu.

FIG. 27 illustrates the user's options after selecting the I/O parameter 250 from the main menu 238. The following parameters can be chosen after selecting I/O 250: external input 326 and relay output 328. The user can select either of the parameters 326-328 to modify one or more preferences associated with the parameters, and appropriate values for the controller 75 will be changed 270.

Figure 28:
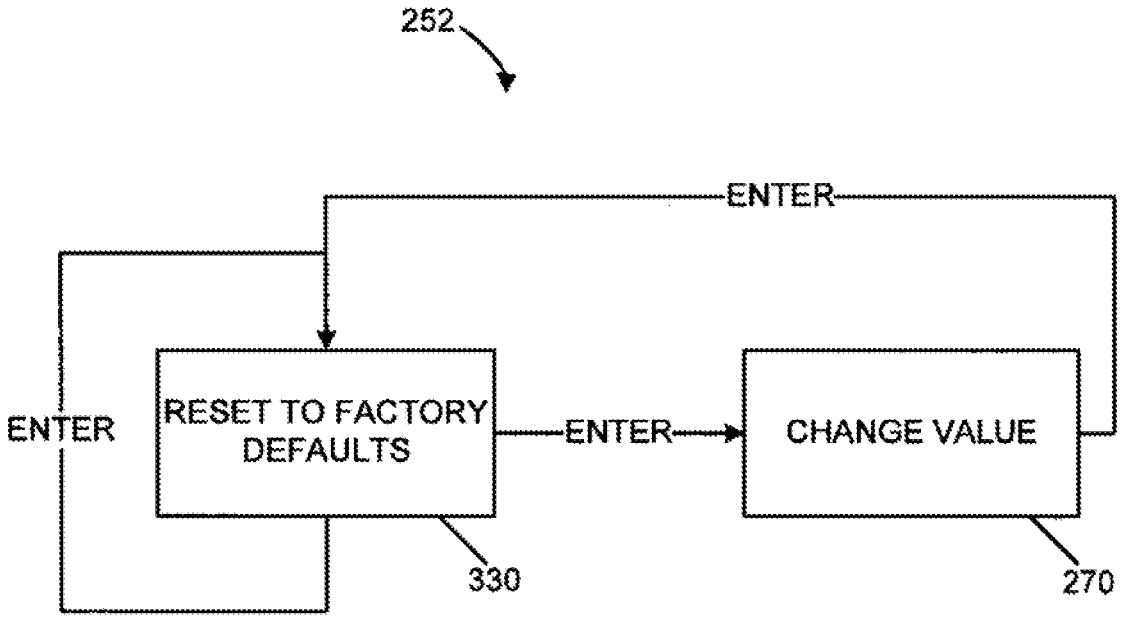
FIG. 28 is a flow chart illustrating a reset parameter menu.

FIG. 28 illustrates the user's options after selecting the reset to defaults parameter 252 from the main menu 238. The user can select the parameter 330 to change all values to factory default values 270.

Figure 29:
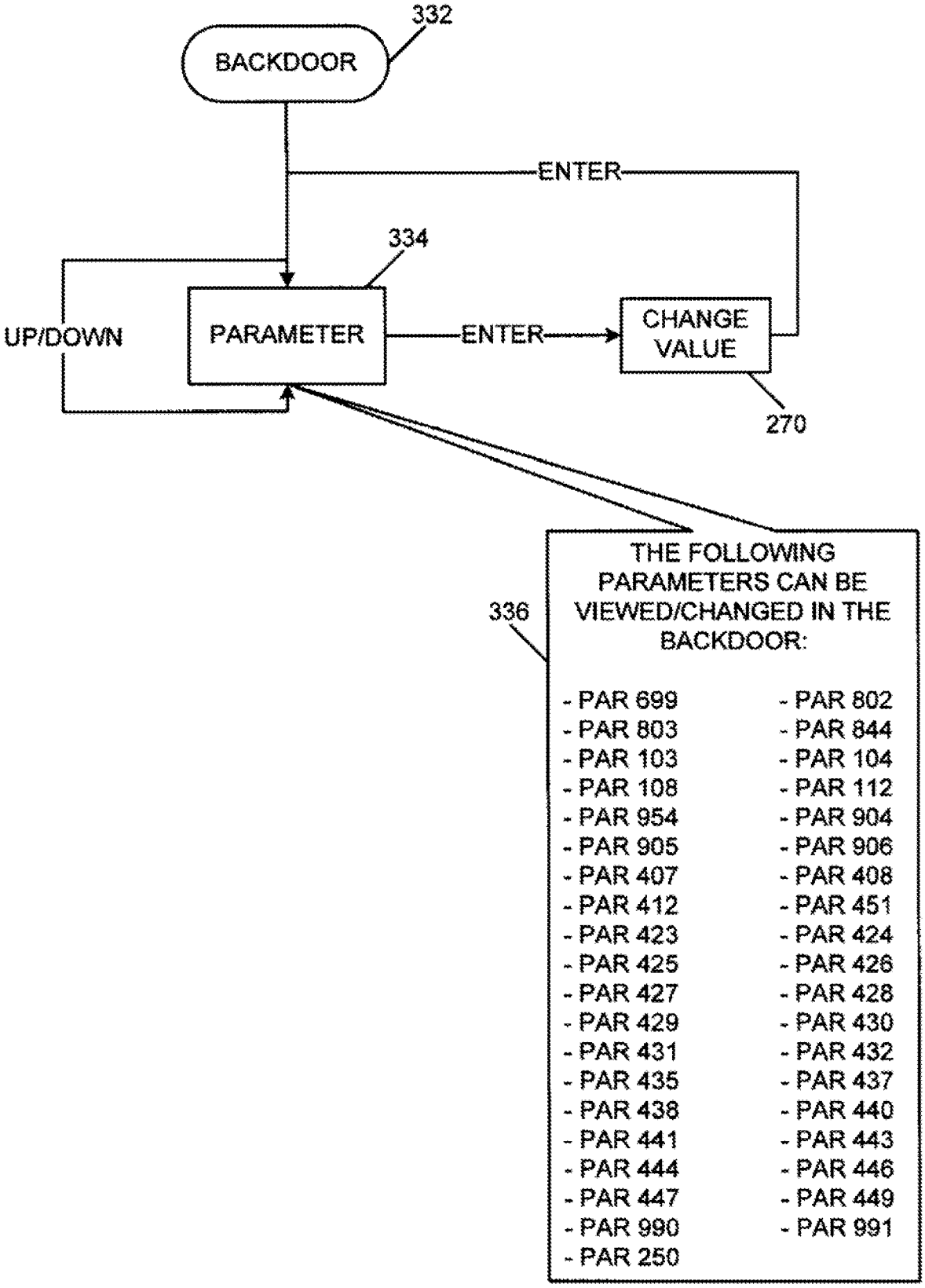
FIG. 29 is a flow chart illustrating a backdoor parameter menu.

FIG. 29 illustrates a backdoor parameter 332, according to some embodiments. With the backdoor parameter 332, the user can choose a parameter 334 not normally accessible through other menus. The user can select the parameter 334 to modify one or more preferences associated with the parameter, and appropriate values for the controller 75 will be changed 270. The parameter 334 that the user selects can be from a list of parameters 336. The list of parameters 336 can include one or more of the parameters disclosed above as well as other parameters.

Figure 30:
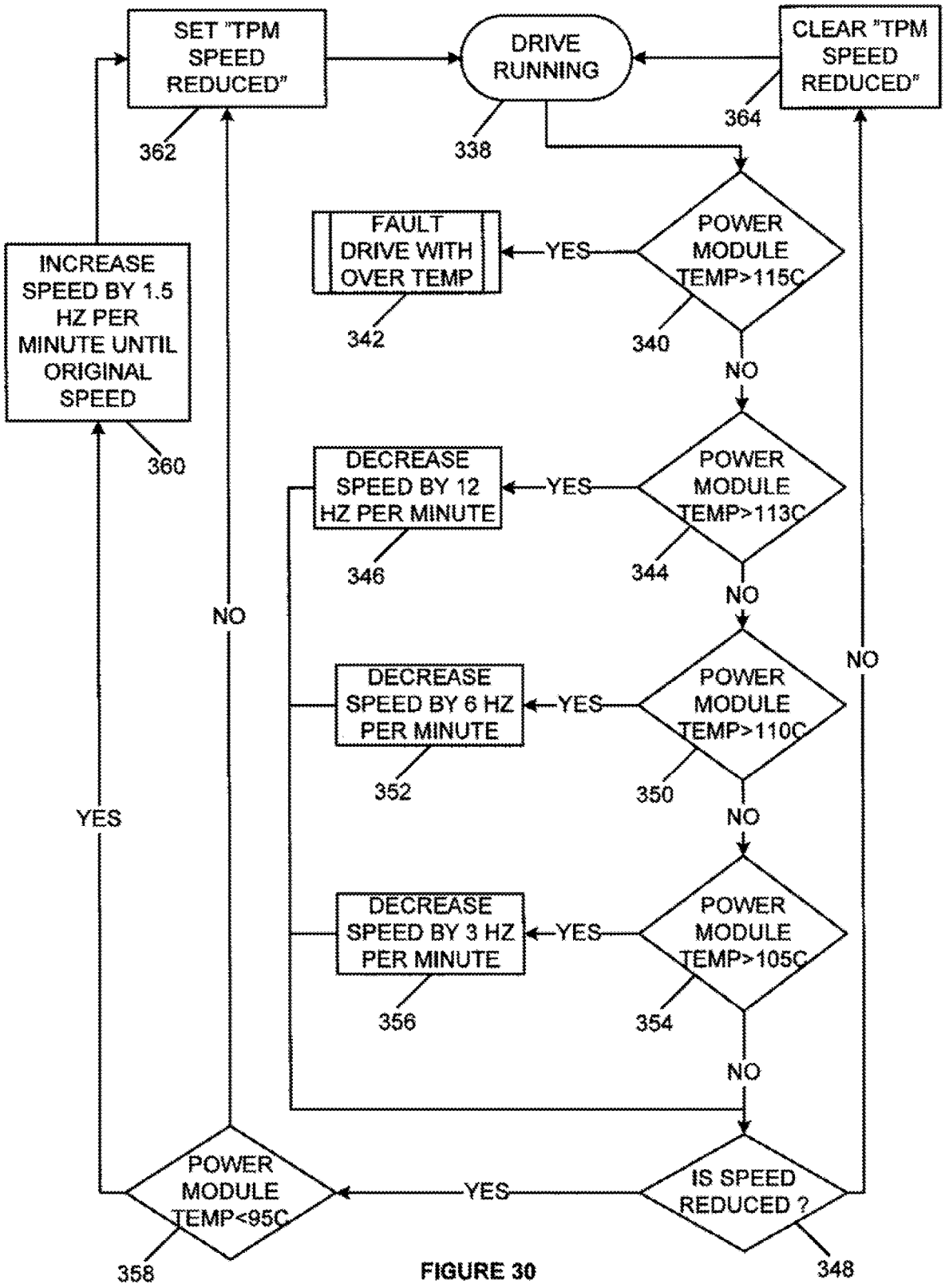
FIG. 30 is a flow chart illustrating an overheat prevention operation.

FIGS. 30-47 are flow charts describing drive warnings and faults according to some embodiments of the invention. FIG. 30 illustrates an overheat prevention operation of the controller 75. When the drive 10 is running (step 338), the controller 75 first determines, at step 340, if a power module temperature is greater than a first temperature (e.g., 115 degrees Celsius). If so, an overheat fault operation is executed (step 342). If not, the controller 75 then determines, at step 344, if the power module temperature is greater than a second temperature (e.g., about 113 degrees Celsius). If so, the controller 75, at step 346, decreases the speed of the motor by a first value (e.g., about 12 Hz per minute) and continues to step 348. If not, the controller 75 then determines, at step 350, if the power module temperature is greater than a third temperature (e.g., about 110 degrees Celsius). If so, the controller 75, at step 352, decreases the speed of the motor by a second value (e.g., about 6 Hz per minute) and continues to step 348. If not, the controller 75 then determines, at step 354, if the power module temperature is greater than a fourth temperature (e.g., about 105 degrees Celsius). If so, the controller 75, at step 356, decreases the speed of the motor by a third value (e.g., about 3 Hz per minute) and continues to step 348. If not, the controller 75 proceeds to step 348. At step 348, the controller 75 determines if the speed has been reduced (i.e., if the controller 75 performed steps 346, 352, or 356). If so, the controller 75, at step 358, determines if the power module temperature is less than a fifth value (e.g., about 95 degrees Celsius). If the power module temperature is less than the fifth value, then the controller 75 increases the speed of the motor by a fourth value (e.g., about 1.5 Hz per minute) until the motor's original speed is reached (step 360) and a warning message "TPM: Speed Reduced" is displayed (step 362). If the power module temperature is greater than the fifth value, the controller 75 proceeds straight to step 362. From step 362, the controller 75 reverts back to step 338, and repeats the above process. If, at step 348, the controller 75 determines that the speed has not been reduced (i.e., the controller 75 did not performed steps 346, 352, or 356), then the "TPM: Speed Reduced" warning message is cleared (step 364), the controller 75 reverts back to step 338, and the above operation is repeated. In some embodiments, the power module being monitored can be the drive 10 itself or various components of the drive 10 (e.g., a heat sink of the controller 75, the motor 11, or the pump 12).

Figure 31:
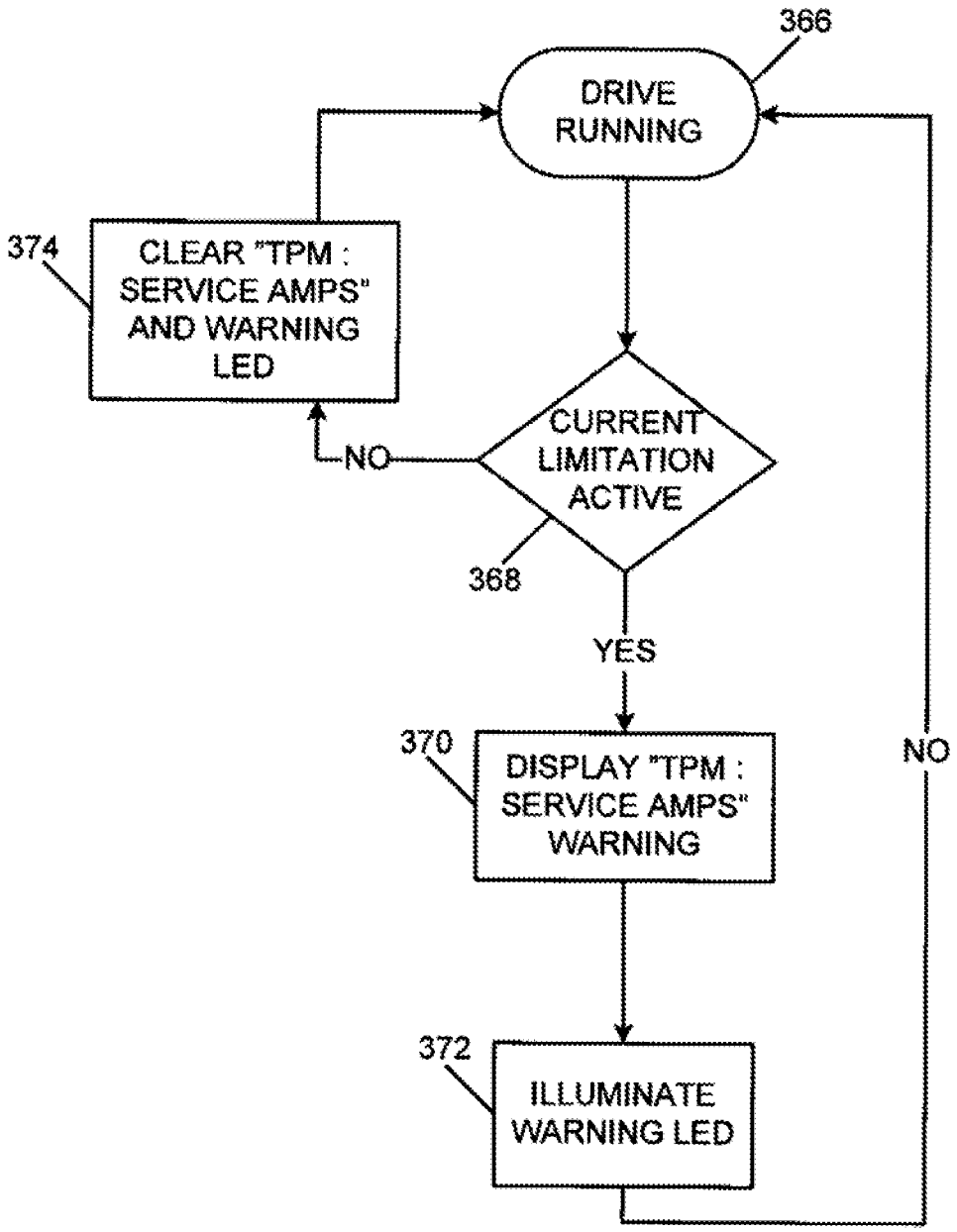
FIG. 31 is a flow chart illustrating an overcurrent prevention operation.

FIG. 31 illustrates an overcurrent prevention operation of the controller 75. When the drive 10 is running (step 366), the controller 75 determines, at step 368, if the drive current is being limited (e.g., because it is above the reference service factor amps parameter 298 in FIG. 23). If so, a warning message "TPM: Service Amps" is displayed (step 370) and the Warning LED 70 is illuminated (step 372). The controller 75 then reverts back to step 366 where the operation is repeated. If the drive current is not being limited, the "TPM: Service Amps" warning message and the Warning LED 70 are cleared (step 374).

Figure 32:
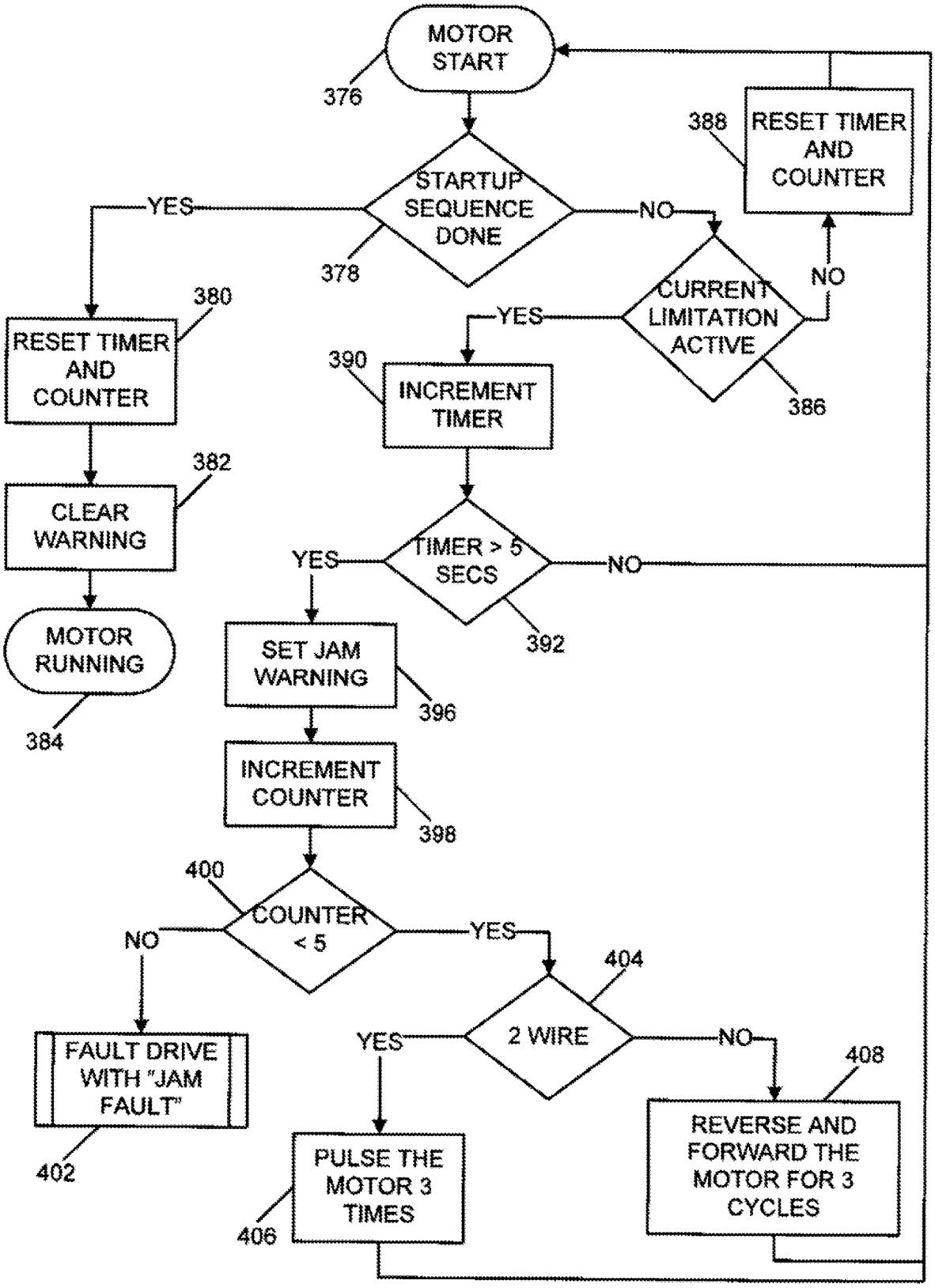
FIG. 32 is a flow chart illustrating a jam prevention operation.

FIG. 32 illustrates a jam prevention operation of the controller 75. When the motor is triggered to start (step 376), the controller 75 determines, at step 378, if a startup sequence is completed. If so, a timer and a counter are reset (step 380), any warning messages are cleared (step 382), and the motor is operating (step 384). If the startup sequence is not completed at step 378, then the controller 75 proceeds to step 386 to check if current limitation is active. If not, the timer and the counter can be reset (step 388), and the controller 75 can proceed back to step 376. If the controller 75 detects that current limitation is active at step 386, then the timer is incremented (step 390). If the timer has not reached five seconds, at step 392, the controller 75 reverts back to step 376. However, if the timer has reached five seconds, at step 392, the controller 75 proceeds to step 396. The controller 75 sets a jam warning (step 396) and increments the counter (step 398). If the counter is greater than five, at step 400, the controller 75 executes a jam fault operation (step 402). If the counter is not greater than five, the controller 75 determines if it is controlling a two-wire motor (step 404). If yes, the controller 75 pulses the motor about three times (step 406), then proceeds back to step 376. If the motor is not a two-wire (e.g., if the motor is a three-wire motor), the controller 75 executes a series of three forward-reverse cycles (step 408), then proceeds back to step 376.

Figure 33:
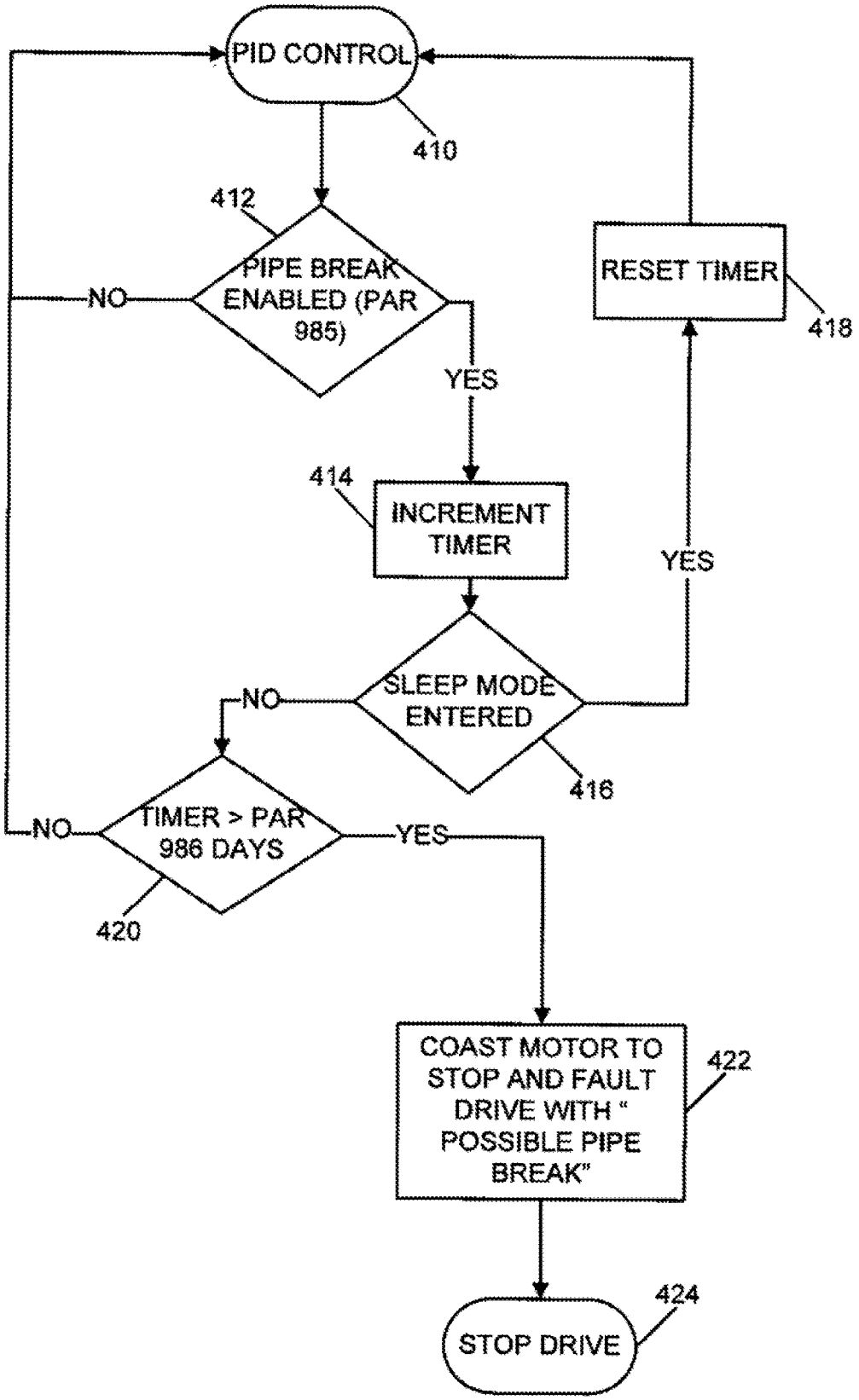
FIG. 33 is a flow chart illustrating a pipe break prevention operation.

FIG. 33 illustrates a line or pipe break fault operation of the controller 75. During PID control (step 410), the controller 75 determines if a pipe break parameter (e.g., pipe break detection parameter 314 from FIG. 25) is enabled (step 412). The controller 75 continues back to step 410 until the parameter is enabled. If the controller 75 determines that the parameter is enabled at step 412, a timer is incremented (step 414), and the controller 75 determines if the pump is in sleep mode (step 416). If the pump is in sleep mode, the timer is reset (step 418) and the controller 75 reverts back to step 410. If the pump is not in sleep mode, the controller 75, at step 420, determines if the timer has been incremented above a certain number of days (e.g., as set by the number of days without sleep parameter 316). If the timer has not exceeded the set number of days, then the controller 75 proceeds back to step 410. If the timer has exceeded the set number of days, the motor is coasted to a stop and a "possible pipe break" fault message is displayed (step 422), causing the drive 10 to be stopped (step 424).

Figure 34:
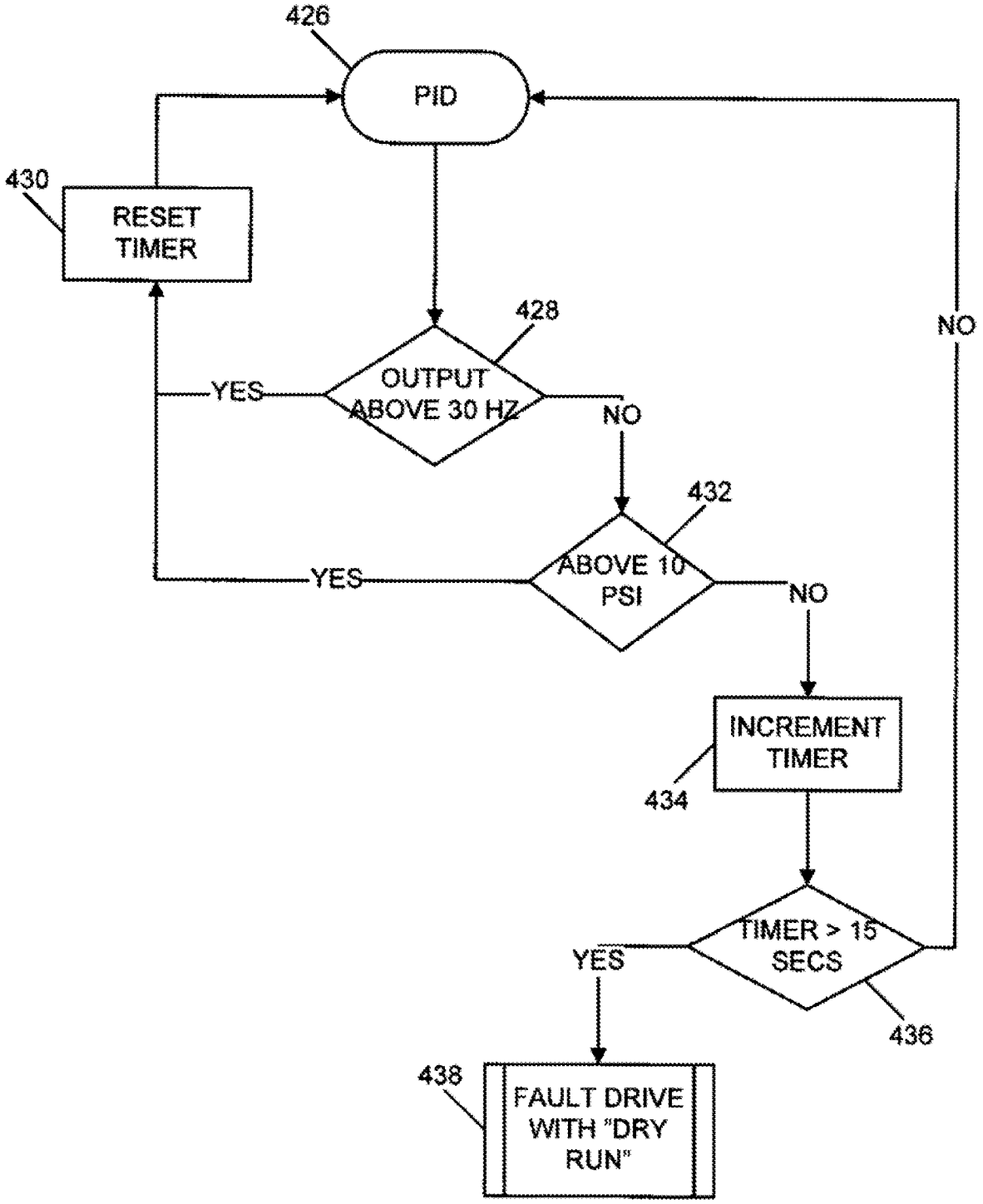
FIG. 34 is a flow chart illustrating a dry run detection operation.

FIG. 34 illustrates a dry run detection operation of the controller 75. During PID control (step 426), the controller 75 determines, at step 428, if the frequency output to the motor is greater than a frequency preset value (e.g., about 30 Hz). If so, a timer is reset (step 430) and the controller 75 reverts back to step 426. If the frequency is under the frequency preset value, the controller 75 then determines, at step 432, if the pressure is greater than a pressure preset value (e.g., about 10 PSI). If so, the timer is reset (step 430) and the controller 75 reverts back to step 426. If the pressure is under 10 PSI, the timer is incremented (step 434) and the controller 75 determines if the timer has reached 15 seconds (step 436). If not, the controller 75 reverts back to step 426. However, if the timer has reached 15 seconds, the controller 75 determines that a dry run has occurred and executes a dry run fault operation (step 438). The preset value in step 428 can be checked to ensure the motor 11 is operating at a normal operating frequency (e.g., above 30 Hz).

Figure 35:
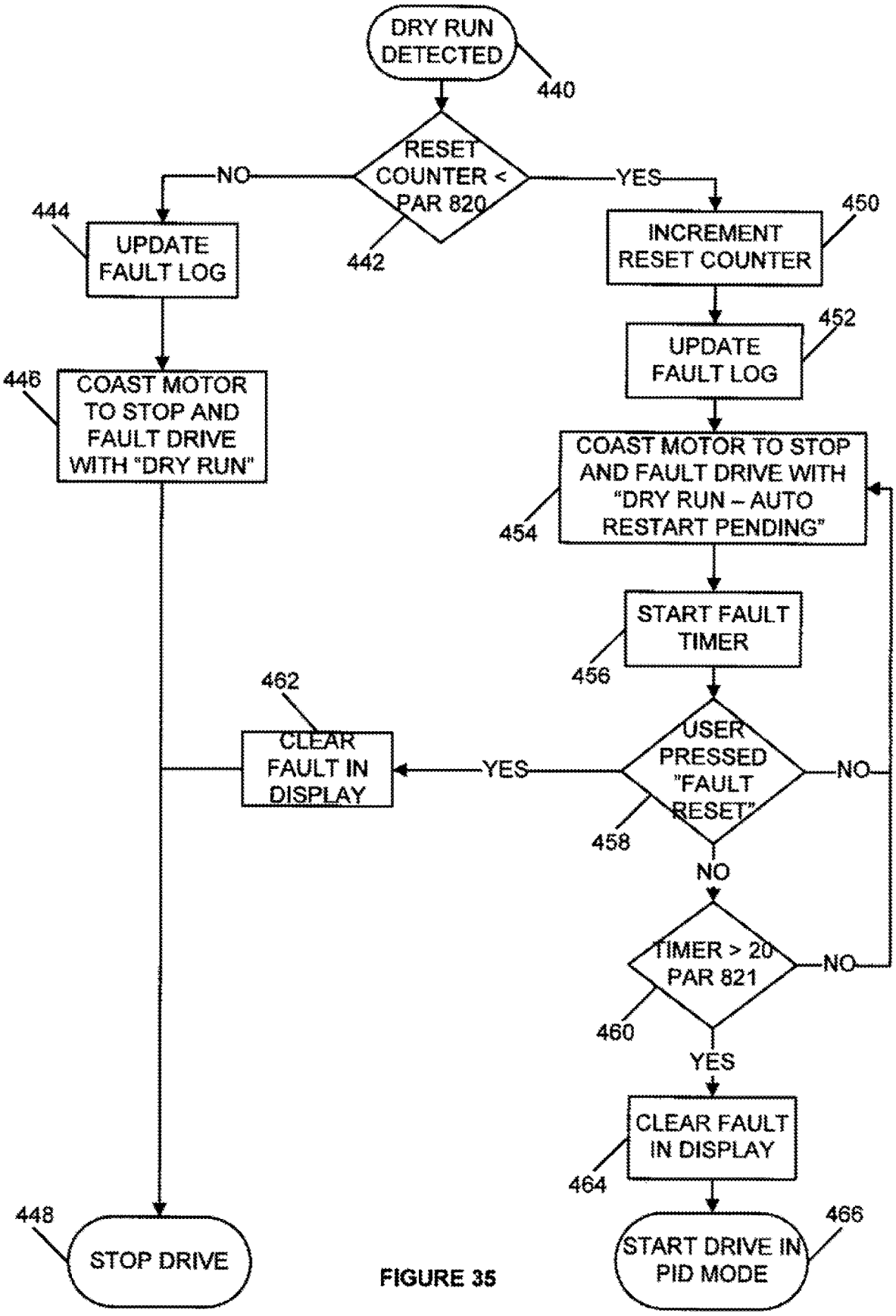
FIG. 35 is a flow chart illustrating a dry run fault operation.

FIG. 35 illustrates a dry run fault operation of the controller 75. The controller 75 can proceed to step 440 if step 438 of FIG. 34 was reached. From step 440, the controller 75 can check if a reset counter value is less than a set value (e.g., the value set under the number of resets parameter 320 of FIG. 26) at step 442. If the reset counter is not less than the set value, the controller 75 can update a fault log (step 444), coast the motor to a stop and display a "Dry Run" fault message (step 446), so that the drive 10 is stopped (step 448). If, at step 442, the reset counter is less than the set value, the reset counter is incremented (step 450) and the fault log is updated (step 452). The controller 75 can then coast the motor to a stop and display a "Dry Run—Auto Restart Pending" fault message (step 454), then start a fault timer (step 456), and continuously check if the user has pressed the fault reset button 64 (step 458) or if a timer has exceeded a time value (step 460). The time value can be the auto reset delay parameter 318 (shown in FIG. 26) set by the user. If the user presses the fault reset button 64, the controller 75 will proceed from step 458 to step 462 and clear the fault message displayed, then stop the drive 10 (step 448). If the timer exceeds the time value, the controller 75 will proceed from step 460 to step 464 and clear the fault message displayed, then restart the drive 10 in PID mode (step 466).

Figure 36:
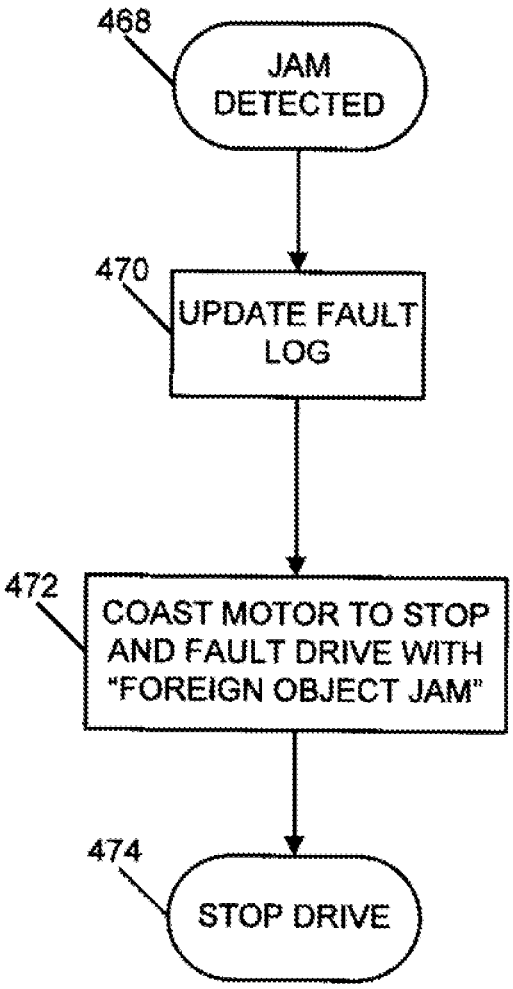
FIG. 36 is a flow chart illustrating a jam fault operation.

FIG. 36 illustrates a jam fault operation of the controller 75. When a jam has been detected (step 468), the fault log is updated (step 470). After step 470, the motor is coasted to a stop and a "Foreign Object Jam" fault message is displayed (step 472), then the drive 10 is stopped (step 474).

Figure 37:
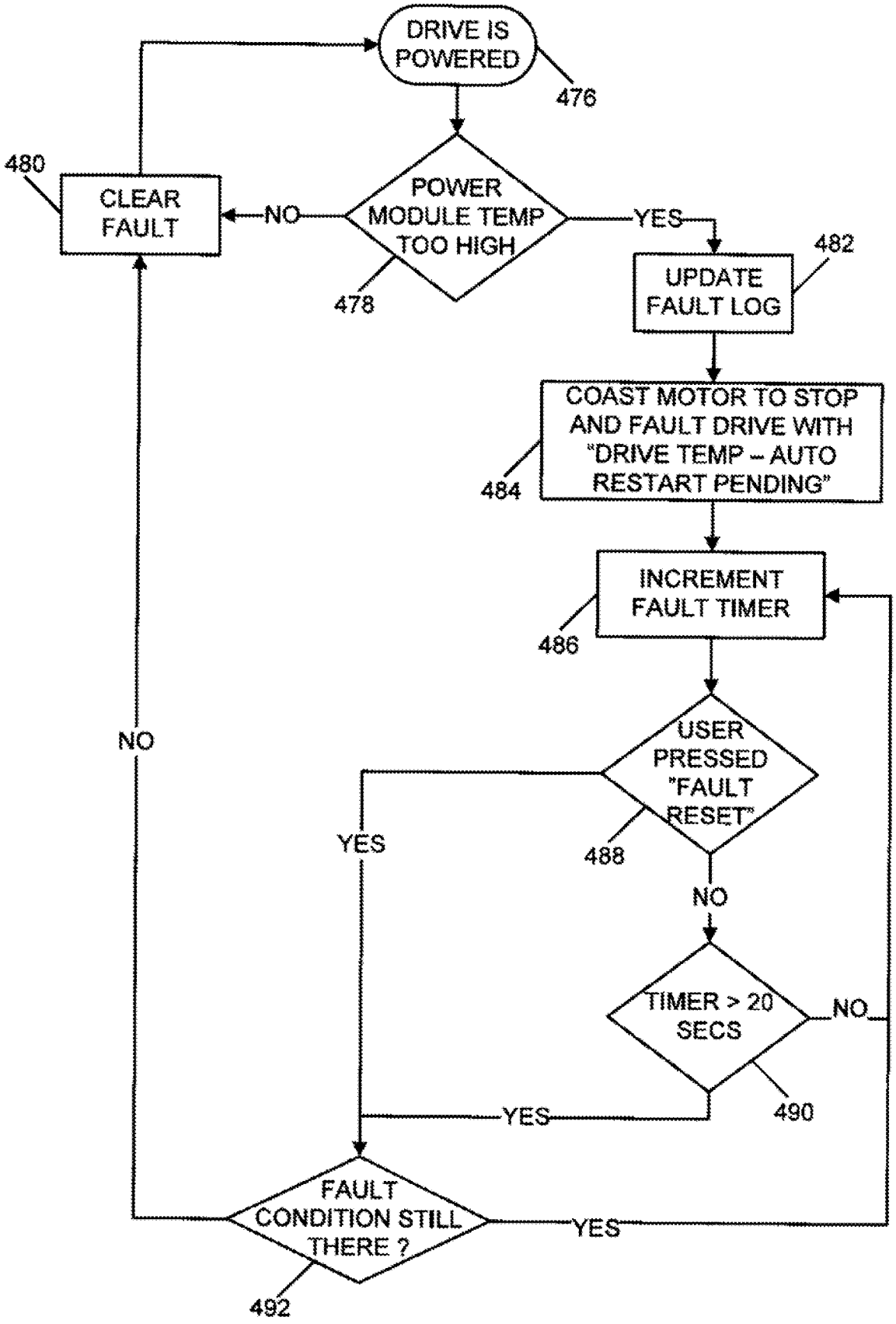
FIG. 37 is a flow chart illustrating an overtemperature fault operation.

FIG. 37 illustrates an overtemperature fault operation of the controller 75. When the drive 10 is powered (step 476), the controller 75 determines if the power module temperature is too high (step 478), for example, using the overheat prevention operation in FIG. 30. If the power module temperature is not too high, the fault is cleared (step 480) and the controller 75 reverts back to step 476. If the power module temperature is too high, the fault log is updated (step 482), the motor is coasted to a stop and a "Drive Temp—Auto Restart Pending" fault message is displayed (step 484), and a fault timer is incremented (step 486). The controller 75 then continuously determines if the user has pressed the fault reset button 64 (step 488) until the timer has been incremented past a value (step 490). If the user has pressed the fault reset button 64 or if the timer has incremented past the value, the controller 75 proceeds from step 488 or step 490, respectively, to step 492 to check if the fault condition is still present. If the fault condition is still present, the controller 75 reverts back to step 486. If the fault condition is not present, the controller 75 clears the fault (step 480) and reverts back to step 476.

Figure 38:
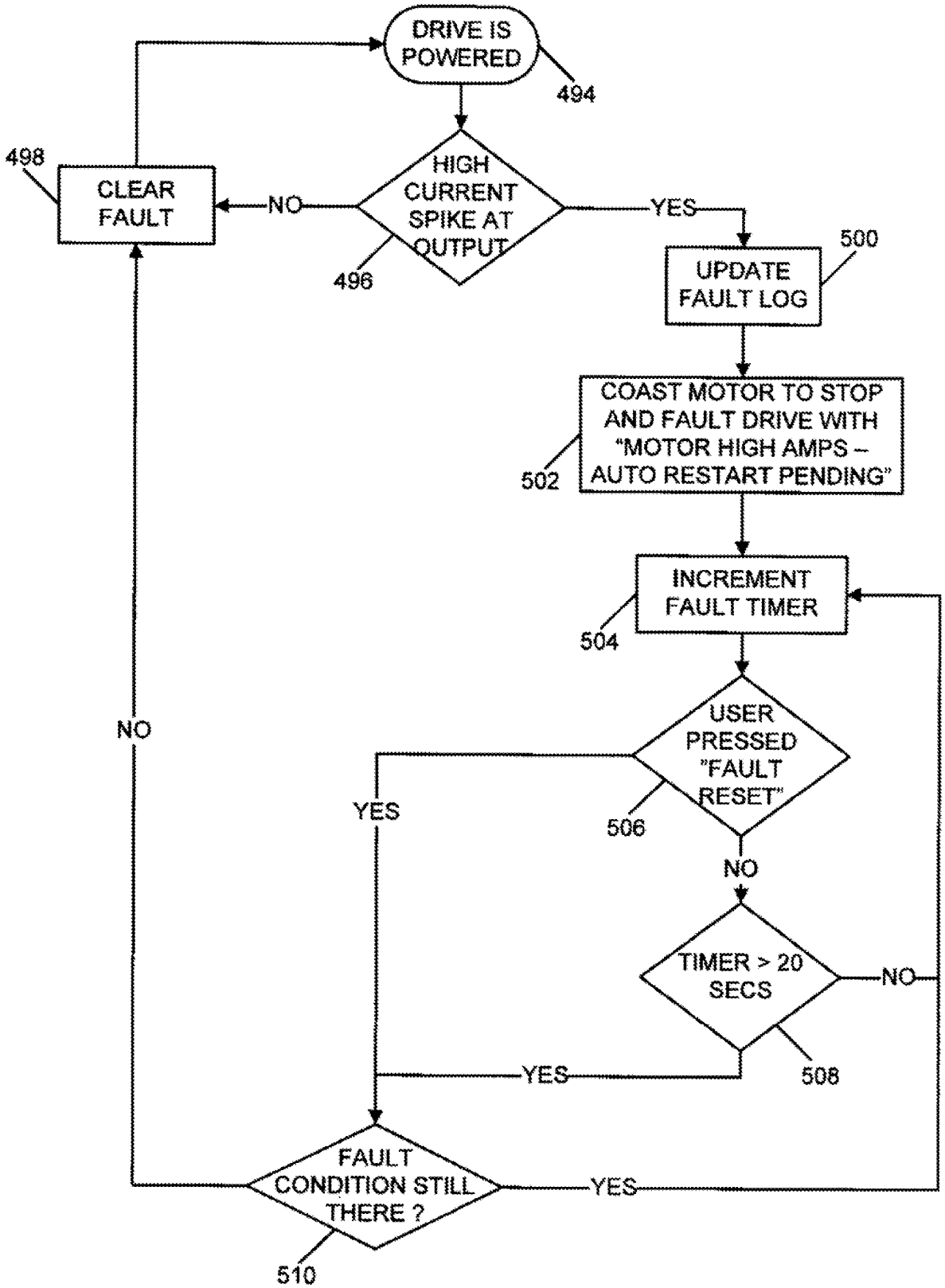
FIG. 38 is a flow chart illustrating an overcurrent fault operation.

The motor 11 and pump 12 combination can satisfy typical performance requirements as specified by the pump manufacturer while maintaining current under service factor amps as specified for the motor 11. Performance can match that of a typical capacitor start/capacitor run control box for each motor HP offering. If the motor 11 performs outside of such specifications, the controller 75 can generate a fault and stop the motor 11. For example, FIG. 38 illustrates an overcurrent fault operation of the controller 75. When the drive 10 is powered (step 494), the controller 75 determines if there is a high current spike (step 496), for example, using the overcurrent prevention operation of FIG. 31. If there is no high current spike, the fault is cleared (step 498) and the controller 75 reverts back to step 494. If there a high current spike, the fault log is updated (step 500), the motor is coasted to a stop and a "Motor High Amps—Auto Restart Pending" fault message is displayed (step 502), and a fault timer is incremented (step 504). The controller 75 then continuously determines if the user has pressed the fault reset button 64 (step 506) until the timer has been incremented past a value (step 508). If the user has pressed the fault reset button 64 or if the timer has incremented past the value, the controller 75 proceeds from step 506 or step 508, respectively, to step 510 to check if the fault condition is still present. If the fault condition is still present, the controller 75 reverts back to step 504. If the fault condition is not present, the controller 75 clears the fault (step 498) and reverts back to step 494.

Figure 39:
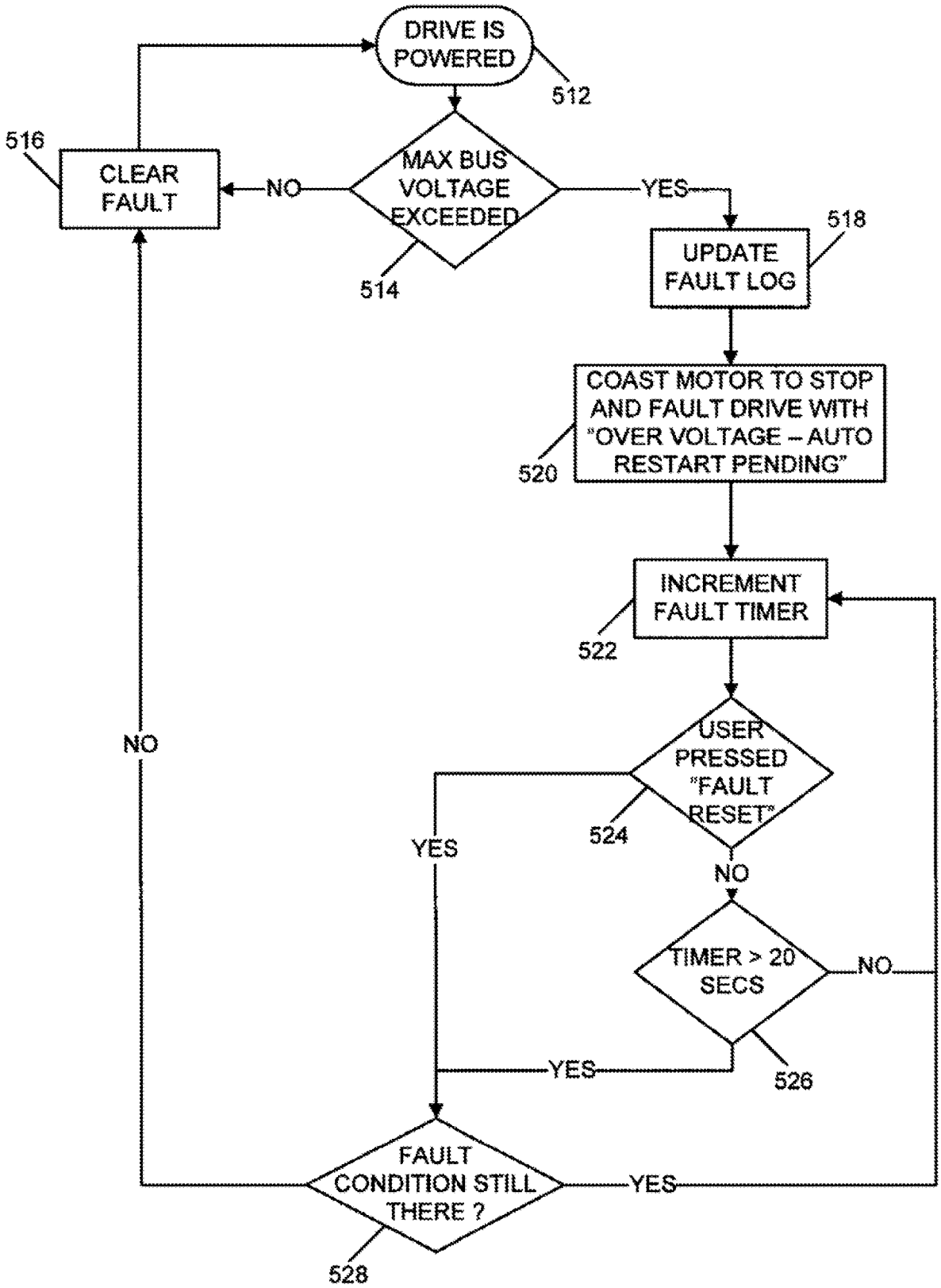
FIG. 39 is a flow chart illustrating an overvoltage fault operation.

FIG. 39 illustrates an overvoltage fault operation of the controller 75. When the drive 10 is powered (step 512), the controller 75 determines if a maximum bus voltage has been exceeded (step 514). If the bus voltage has not exceeded the maximum value, the fault is cleared (step 516) and the controller 75 reverts back to step 512. If the bus voltage has exceeded the maximum value, the fault log is updated (step 518), the motor is coasted to a stop and an "Over Voltage—Auto Restart Pending" fault message is displayed (step 520), and a fault timer is incremented (step 522). The controller 75 then continuously determines if the user has pressed the fault reset button 64 (step 524) until the timer has been incremented past a value (step 526). If the user has pressed the fault reset button 64 or if the timer has incremented past the value, the controller 75 proceeds from step 524 or step 526, respectively, to step 528 to check if the fault condition is still present. If the fault condition is still present, the controller 75 reverts back to step 522. If the fault condition is not present, the controller 75 clears the fault (step 516) and reverts back to step 512.

Figure 40:
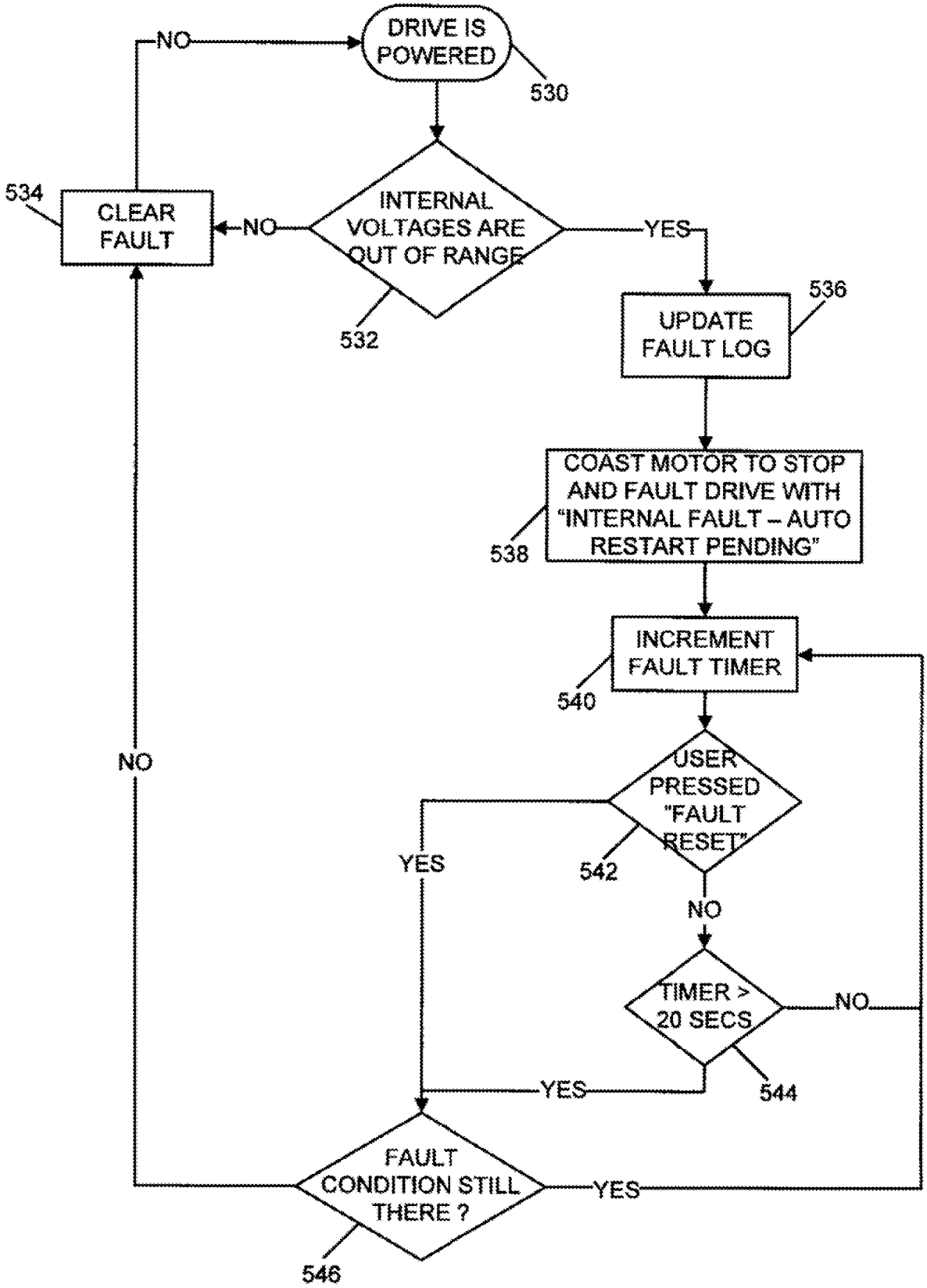
FIG. 40 is a flow chart illustrating an internal fault operation.

FIG. 40 illustrates an internal fault operation of the controller 75. When the drive 10 is powered (step 530), the controller 75 determines if any internal voltages are out of range (step 532). If the internal voltages are not out of range, the fault is cleared (step 534) and the controller 75 reverts back to step 530. If the internal voltages are out of range, the fault log is updated (step 536), the motor is coasted to a stop and an "Internal Fault—Auto Restart Pending" fault message is displayed (step 538), and a fault timer is incremented (step 540). The controller 75 then continuously determines if the user has pressed the fault reset button 64 (step 542) until the timer has been incremented past a value (step 544). If the user has pressed the fault reset button 64 or if the timer has incremented past the value, the controller 75 proceeds from step 542 or step 544, respectively, to step 546 to check if the fault condition is still present. If the fault condition is still present, the controller 75 reverts back to step 540. If the fault condition is not present, the controller 75 clears the fault (step 534) and reverts back to step 530.

Figure 41:
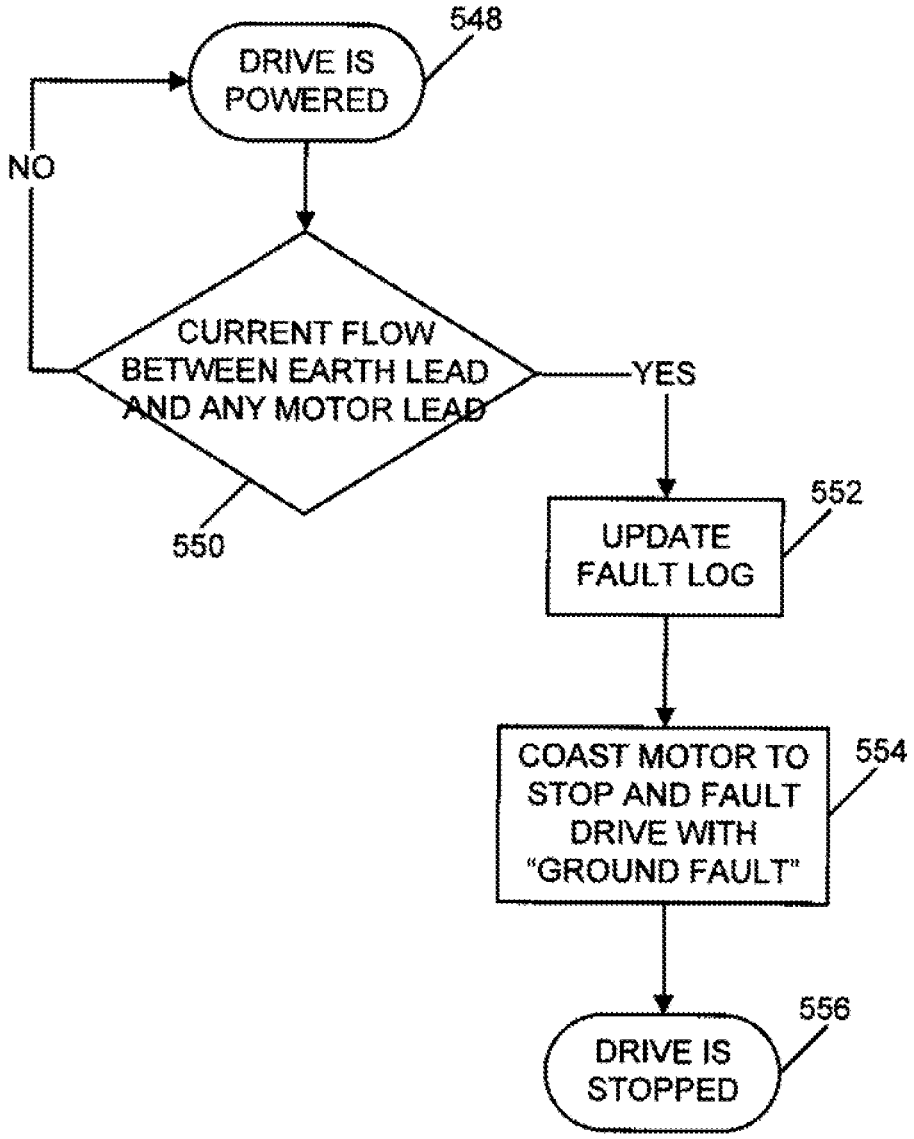
FIG. 41 is a flow chart illustrating a ground fault operation.

FIG. 41 illustrates a ground fault operation of the controller 75. When the drive 10 is powered (step 548), the controller 75 continuously determines if there is current flow between an earth, or ground, lead and any motor lead (step 550). If so, the fault log is updated (step 552), the motor is coasted to a stop and a "Ground Fault" fault message is displayed (step 554), and the drive 10 is stopped (step 556).

Figure 42:
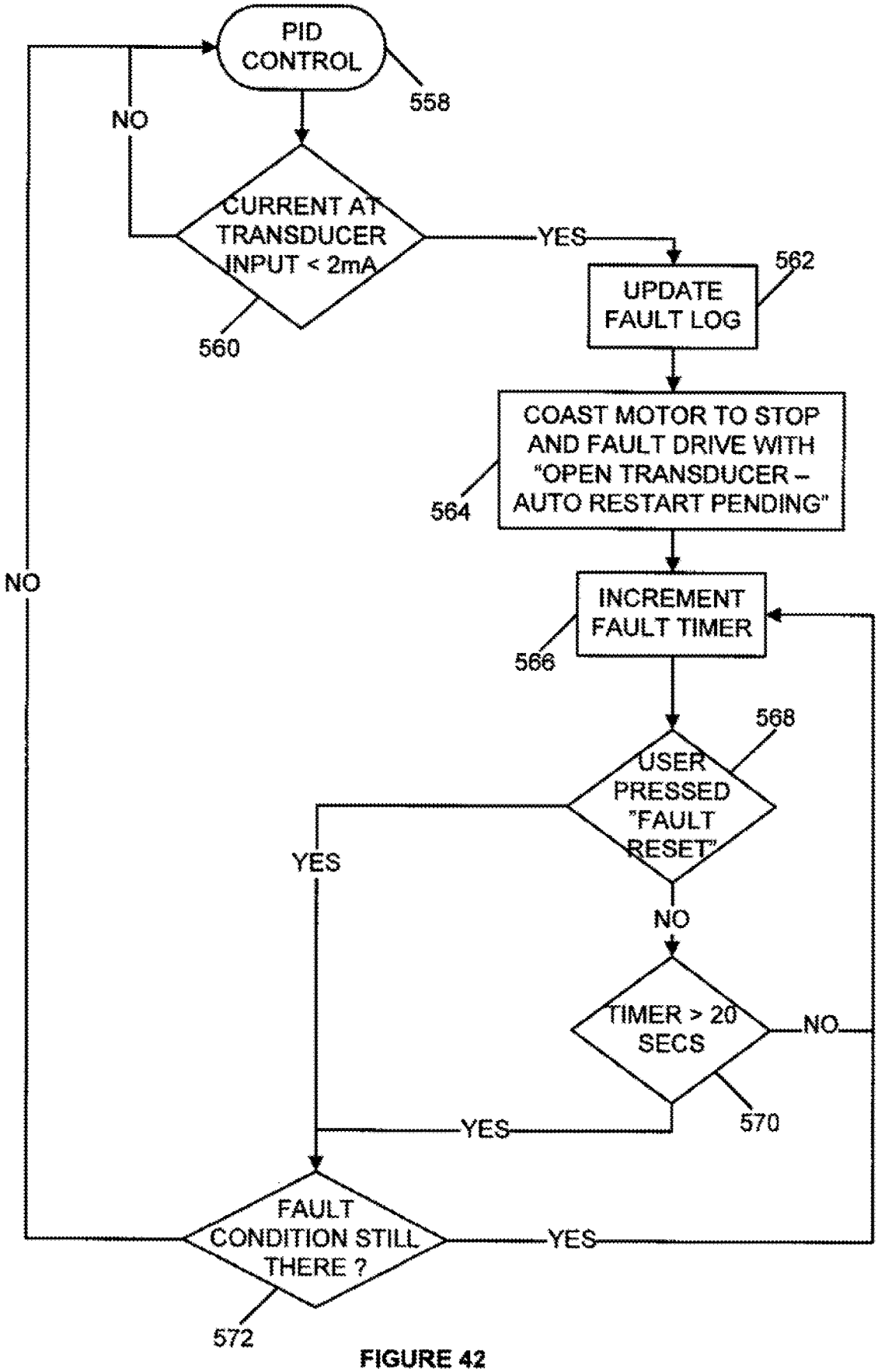
FIG. 42 is a flow chart illustrating an open transducer fault operation.

FIG. 42 illustrates an open transducer fault operation of the controller 75. While in PID mode (step 558), the controller 75 determines if a current measured at the transducer input is less than a value, such as 2 milliamps (step 560). If the current is not less than the value, the controller 75 reverts back to step 558. If the current is less than the value, the fault log is updated (step 562), the motor is coasted to a stop and an "Open Transducer—Auto Restart Pending" fault message is displayed (step 564), and a fault timer is incremented (step 566). The controller 75 then continuously determines if the user has pressed the fault reset button 64 (step 568) until the timer has been incremented past a value (step 570). If the user has pressed the fault reset button 64 or if the timer has incremented past the value, the controller 75 proceeds from step 568 or step 570, respectively, to step 572 to check if the fault condition is still present. If the fault condition is still present, the controller 75 reverts back to step 566. If the fault condition is not present, the controller 75 reverts back to step 558.

Figure 43:
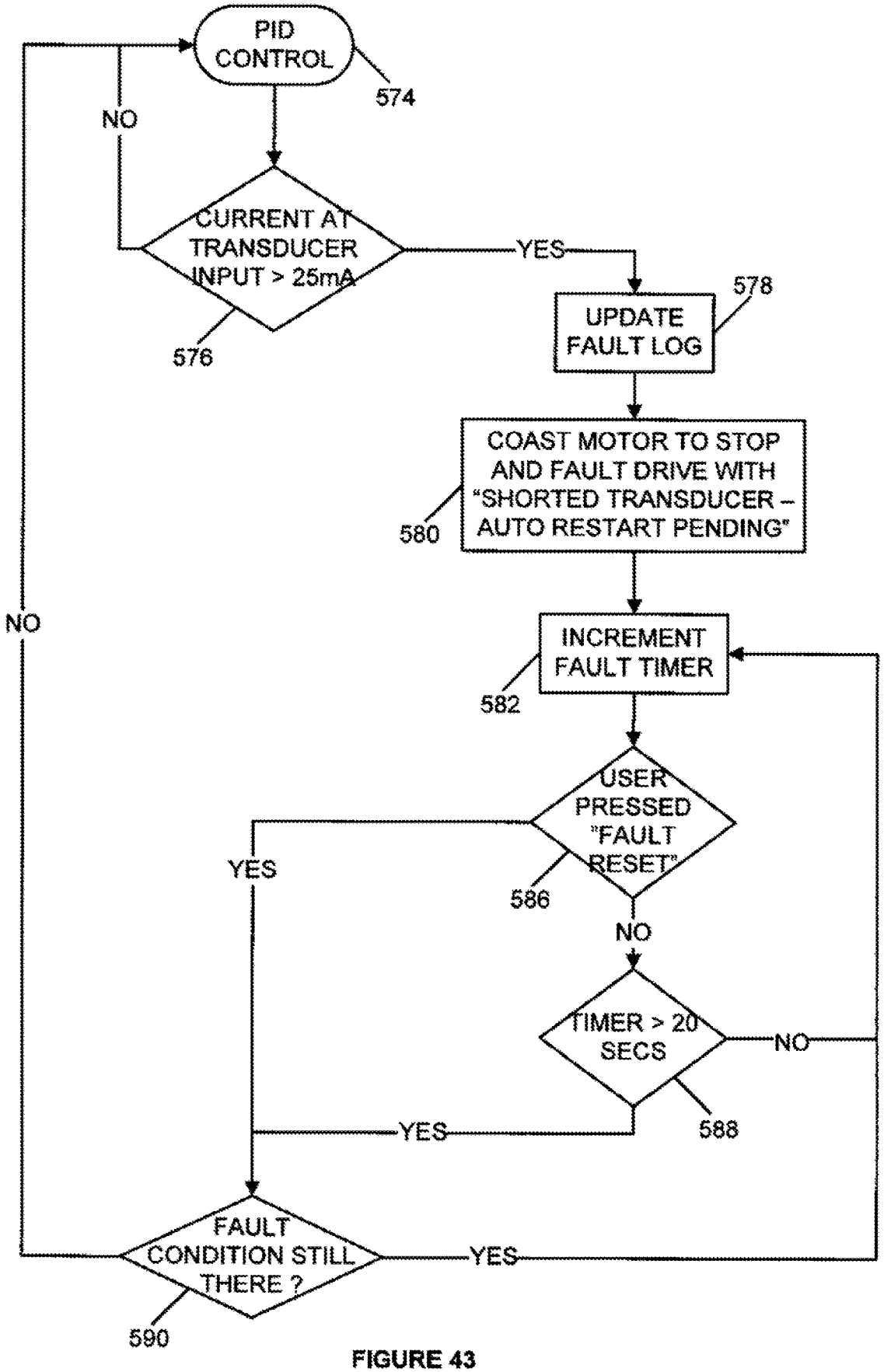
FIG. 43 is a flow chart illustrating a shorted transducer fault operation.

FIG. 43 illustrates a shorted transducer fault operation of the controller 75. While in PID mode (step 574), the controller 75 determines if a current measured at the transducer input is greater than a value, such as 25 milliamps (step 576). If the current is not greater than the value, the controller 75 reverts back to step 574. If the current is greater than the value, the fault log is updated (step 578), the motor is coasted to a stop and a "Shorted Transducer—Auto Restart Pending" fault message is displayed (step 580), and a fault timer is incremented (step 582). The controller 75 then continuously determines if the user has pressed the fault reset button 64 (step 586) until the timer has been incremented past a value (step 588). If the user has pressed the fault reset button 64 or if the timer has incremented past the value, the controller 75 proceeds from step 586 or step 588, respectively, to step 590 to check if the fault condition is still present. If the fault condition is still present, the controller 75 reverts back to step 582. If the fault condition is not present, the controller 75 reverts back to step 574.

Figure 44A:
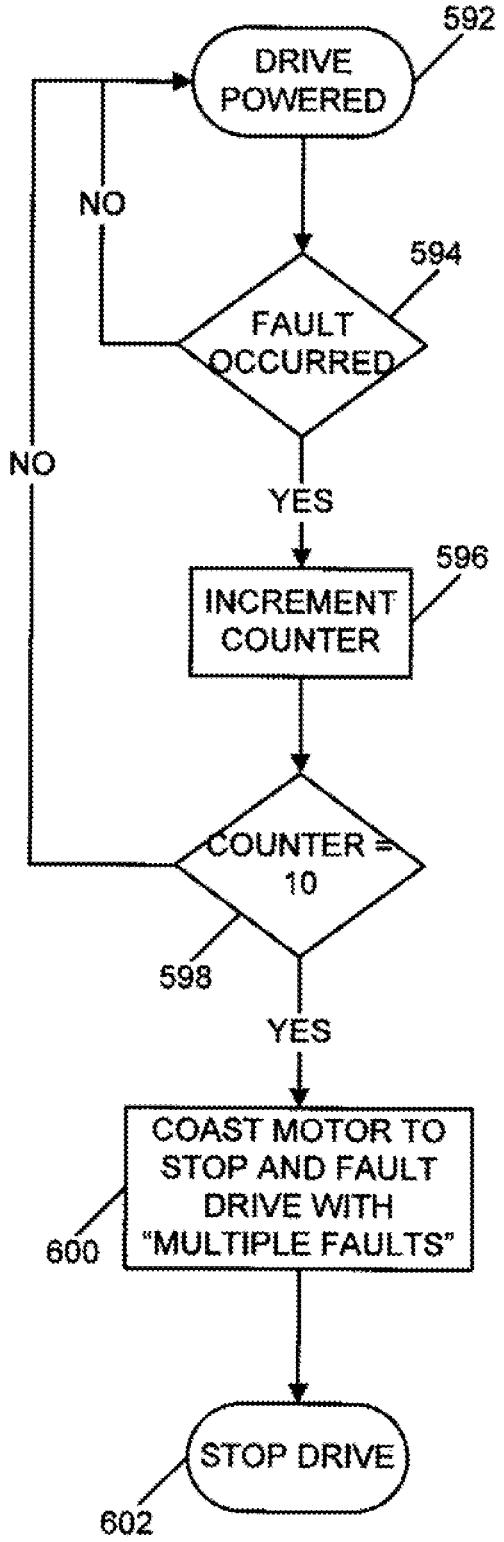
FIGS. 44A-44B are flow charts illustrating a multiple faults operation.
Figure 44B:
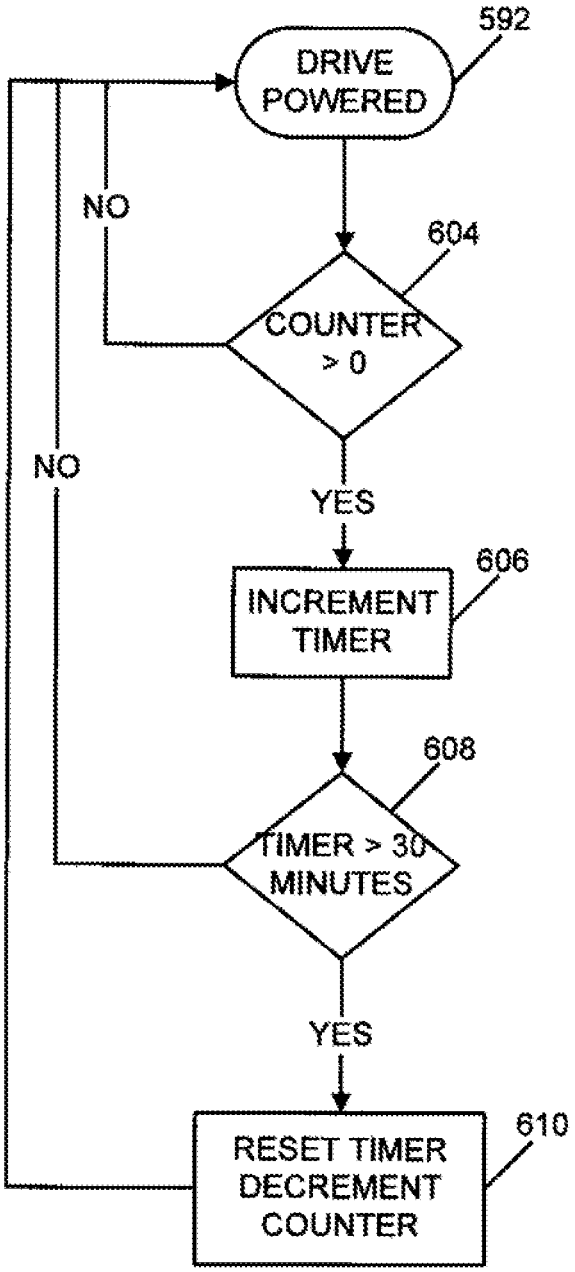

FIGS. 44A-44B illustrate a multiple faults operation of the controller 75. Referring to FIG. 44A, when the drive 10 is powered (step 592), the controller 75 continuously determines if a fault has occurred (step 594). If a fault has a occurred, a counter is incremented (step 596) and the controller 75 determines if the counter has reached a value, such as ten (step 598). If the counter has reached the value, the motor is coasted to a stop and a "Multiple Faults" fault message is displayed (step 600), and the drive 10 is stopped (step 602). The steps of FIG. 44B serve to provide a time frame for which the counter can reach the value. When the drive 10 is powered (step 592), the controller 75 continuously determines if the counter (i.e., the counter in step 596 of FIG. 44A) has been incremented (step 604). If so, a timer is incremented (step 606). The controller 75 continues to increment the timer as long as the counter is above zero until the timer reaches a value, such as thirty minutes (step 608). Once the timer has reached the value, the counter is decremented and the timer is reset (step 610).

Figure 45:
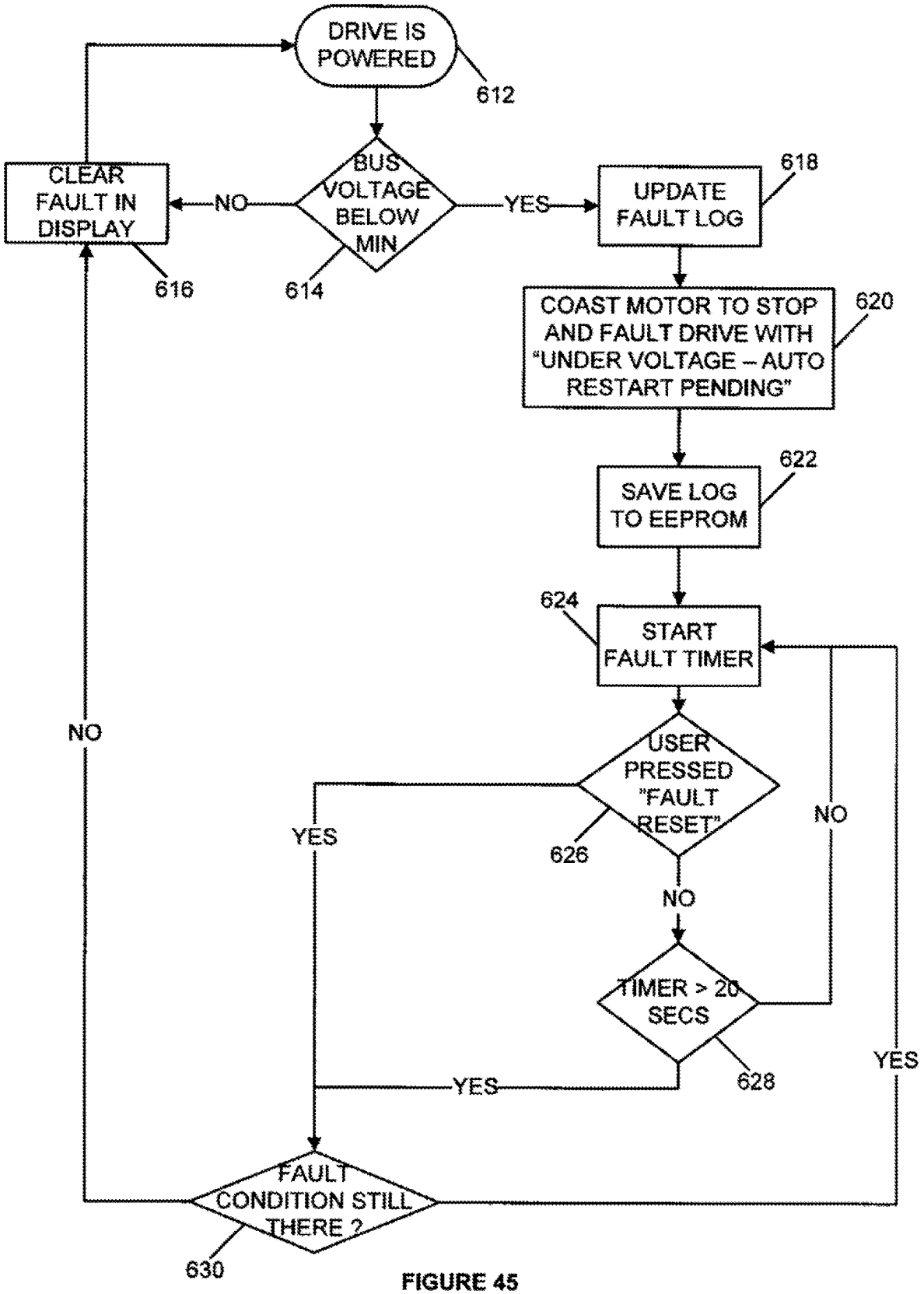
FIG. 45 is a flow chart illustrating an undervoltage fault operation.

FIG. 45 illustrates an undervoltage fault operation of the controller 75. When the drive 10 is powered (step 612), the controller 75 determines if the bus voltage is below a minimum value (step 614). If the bus voltage is not below the minimum value, the fault is cleared (step 616) and the controller 75 reverts back to step 612. If the bus voltage is below the minimum value, the fault log is updated (step 618), the motor is coasted to a stop and an "Under Voltage—Auto Restart Pending" fault message is displayed (step 620), the fault log is saved in memory, such as the device's electrically erasable programmable read-only memory, or EEPROM (step 622) and a fault timer is incremented (step 624). The controller 75 then continuously determines if the user has pressed the fault reset button 64 (step 626) until the timer has been incremented past a value (step 628). If the user has pressed the fault reset button 64 or if the timer has incremented past the value, the controller 75 proceeds from step 626 or step 628, respectively, to step 630 to check if the fault condition is still present. If the fault condition is still present, the controller 75 reverts back to step 624. If the fault condition is not present, the controller 75 clears the fault (step 616) and reverts back to step 612.

Figure 46:
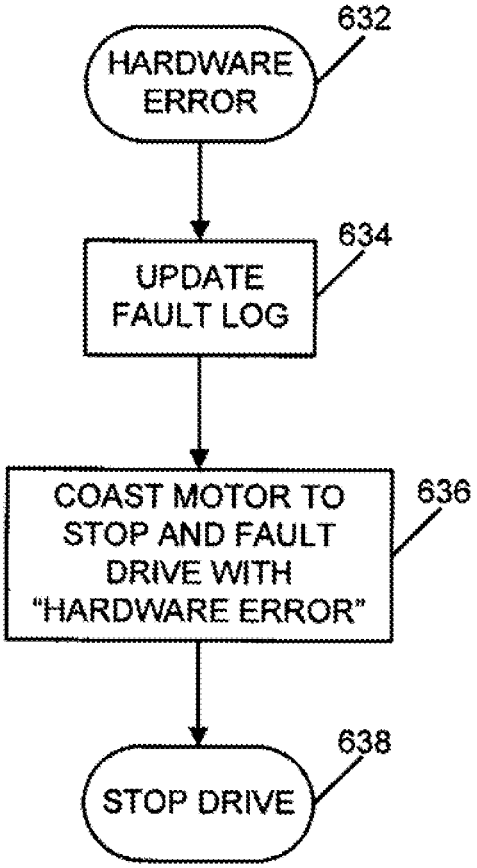
FIG. 46 is a flow chart illustrating a hardware fault operation.

FIG. 46 illustrates a hardware fault operation of the controller 75. When the controller 75 recognizes a hardware error (step 632), the fault log is updated (step 634). After step 634, the motor is coasted to a stop and a "Hardware Error" fault message is displayed (step 636), then the drive 10 is stopped (step 638).

Figure 47:
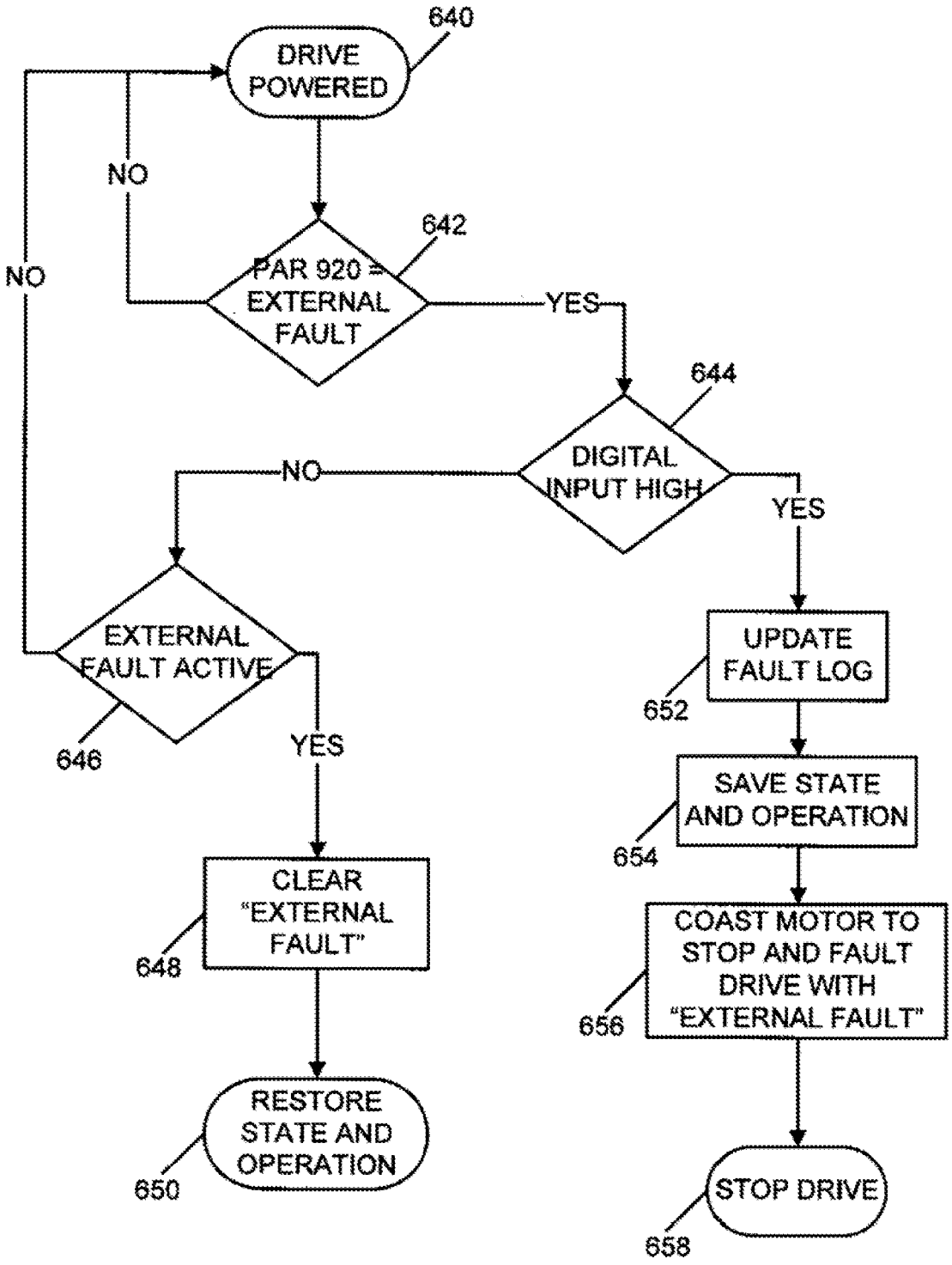
FIG. 47 is a flow chart illustrating an external fault operation.

FIG. 47 illustrates an external fault operation of the controller 75. When the drive 10 is powered (step 640), the controller 75 continuously determines if an external fault parameter is present, for example, from a relay input at the input power terminal block 28 or the digital input/output (I/O) spring terminals 30 (step 642). If so, the controller 75 determines if a digital input is high (step 644). If the digital input is not high, the controller 75 determines if the external fault is active (step 646). If the external fault is not active, the controller 75 reverts back to step 640. If the external fault is active, the controller 75 clears an "external fault" fault message (if it is being displayed) at step 648 and the device's previous state and operation are restored (step 650). If, at step 644, the digital input is high, the fault log is updated (step 652) and the device's current state and operation are saved (step 654). Following step 654, the motor is coasted to a stop and a "External Fault" fault message is displayed (step 656), then the drive 10 is stopped (step 658).

Figure 48:
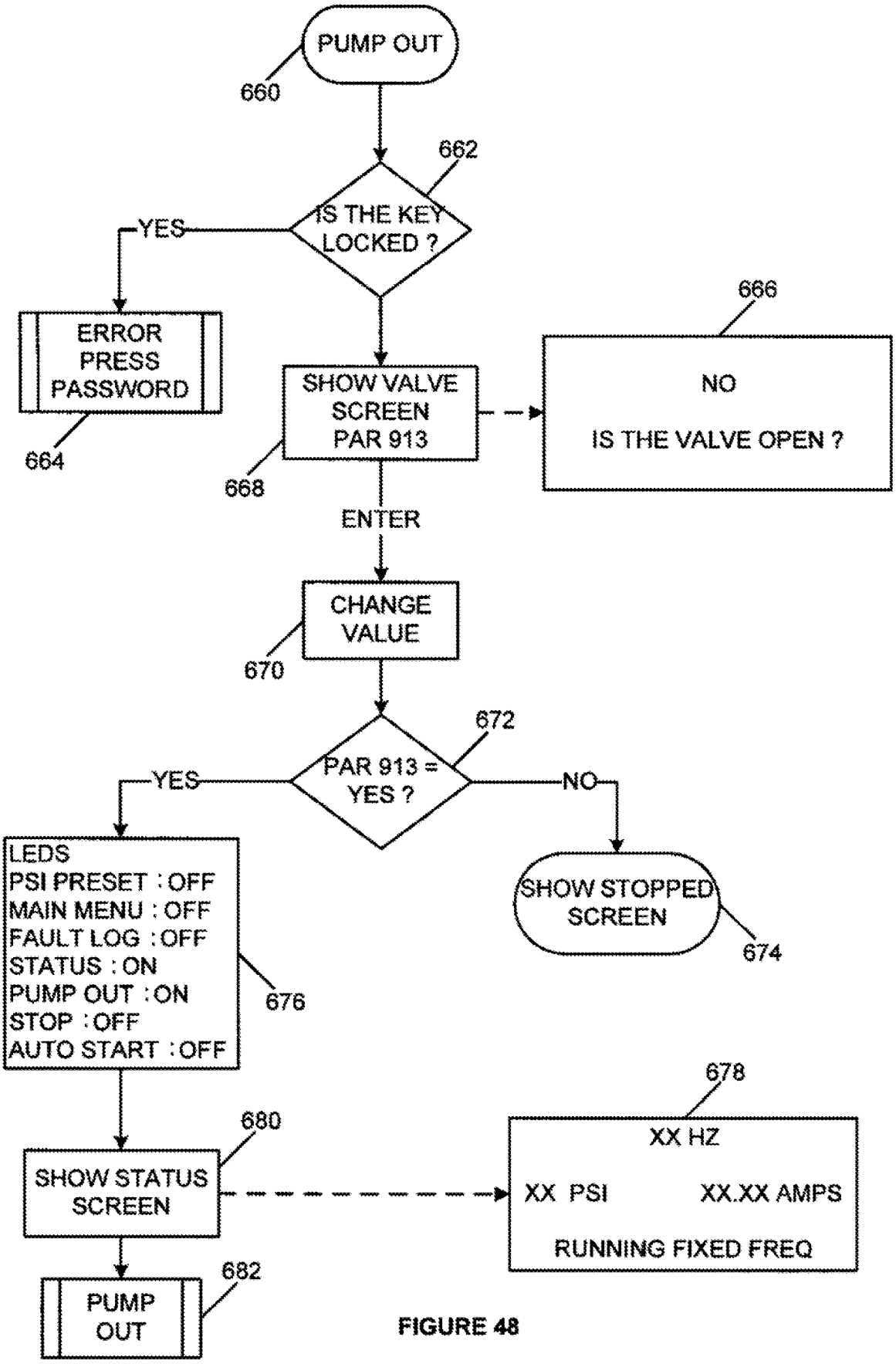
FIG. 48 is a flow chart illustrating a pump out button control operation.

FIGS. 48-63 are flow charts describing control operations for the control pad 14 according to some embodiments of the invention. FIG. 48 illustrates a pump-out button control operation, according to some embodiments. When the pump-out button 40 is pressed (step 660), the controller 75 first determines if the control pad 14 is locked, or in the password protection mode (step 662). If so, the controller 75 executes a keys locked error operation (step 664). If not, a valve screen 666 is displayed (step 668) asking the user if a valve is open. Once the user chooses if the valve is open or not and presses enter, a valve parameter value is changed (step 670). The controller 75 then determines, at step 672, if the valve parameter value is yes (i.e., if the valve is open). If the valve parameter is not yes (i.e., if the user selected that the valve was not open), a stopped screen is displayed (step 674), indicating that the pump 12 is stopped. If the valve parameter is yes, the controller 75 sets LED indicators 66 on or off accordingly (step 676), displays a status screen 678 (step 680), and runs the pump out operation to drive the motor 11 in the pump out mode (step 682). The status screen 678 can include information about the pump 12, such as motor frequency, pressure, and motor current during the pump out mode.

Figure 49:
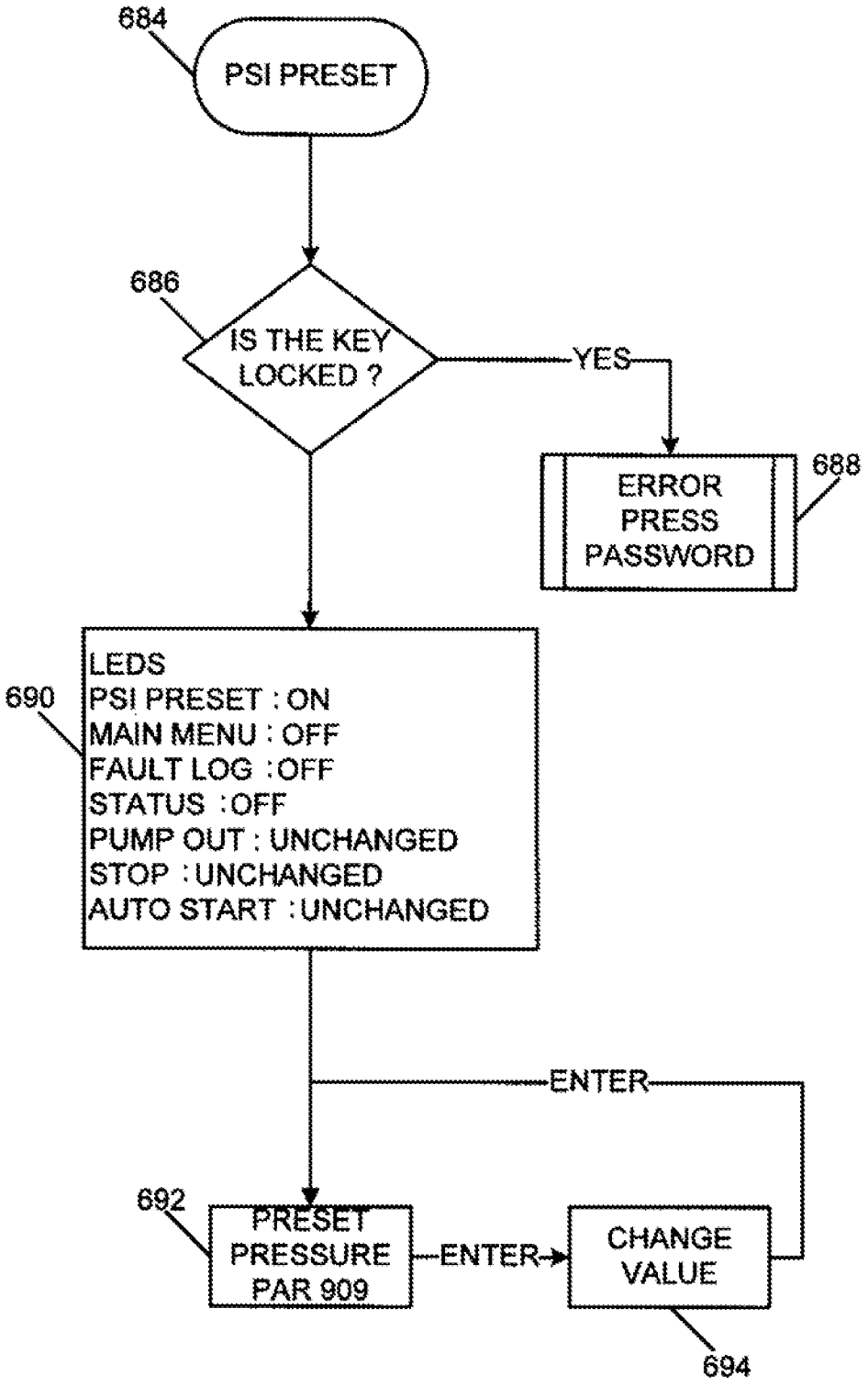
FIG. 49 is a flow chart illustrating a pressure preset button control operation.

FIG. 49 illustrates a pressure preset button control operation, according to some embodiments. When the pressure preset button 42 is pressed (step 684), the controller 75 first determines if the control pad 14 is locked (step 686). If so, the controller 75 executes a keys locked error operation (step 688). If the control pad 14 is not locked, the controller 75 sets the LED indicators 66 on or off accordingly (step 690) and a preset pressure parameter is displayed (step 692). The user can adjust the displayed pressure parameter using the keypad and hit enter to change the value of the preset pressure parameter, changing the pressure set point for the controller 75 (step 694).

Figure 50:
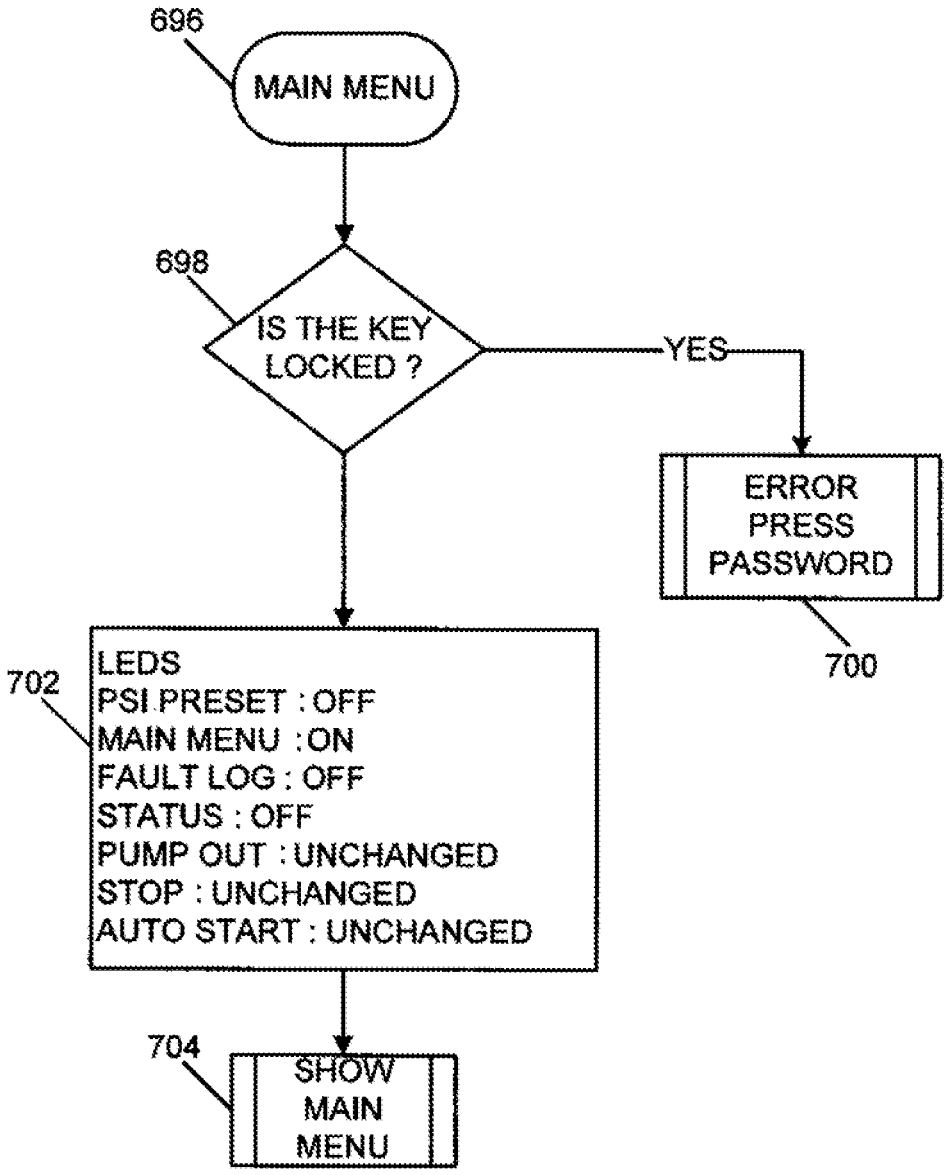
FIG. 50 is a flow chart illustrating a main menu button control operation.

FIG. 50 illustrates a main menu button control operation, according to some embodiments. When the main menu button 44 is pressed (step 696), the controller 75 first determines if the control pad 14 is locked (step 698). If so, the controller 75 executes a keys locked error operation (step 700). If the control pad 14 is not locked, the controller 75 sets the LED indicators 66 on or off accordingly (step 702) and the main menu, as described with respect to FIG. 16, is displayed (step 704).

Figure 51:
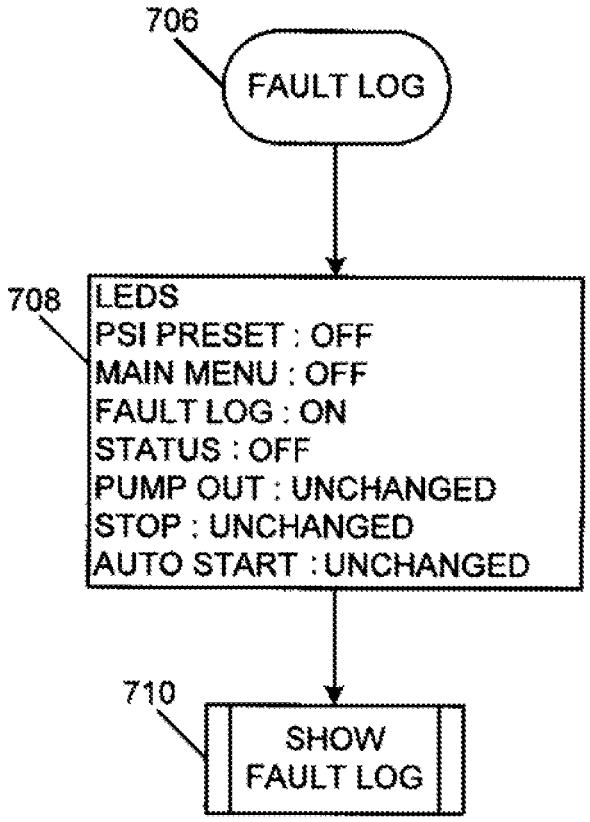
FIG. 51 is a flow chart illustrating a fault log button control operation.

FIG. 51 illustrates a fault log button control operation, according to some embodiments. When the fault log button 46 is pressed (step 706), the controller 75 sets the LED indicators 66 on or off accordingly (step 708) and the fault log is displayed, detailing fault history information to the user (step 710).

Figure 52:
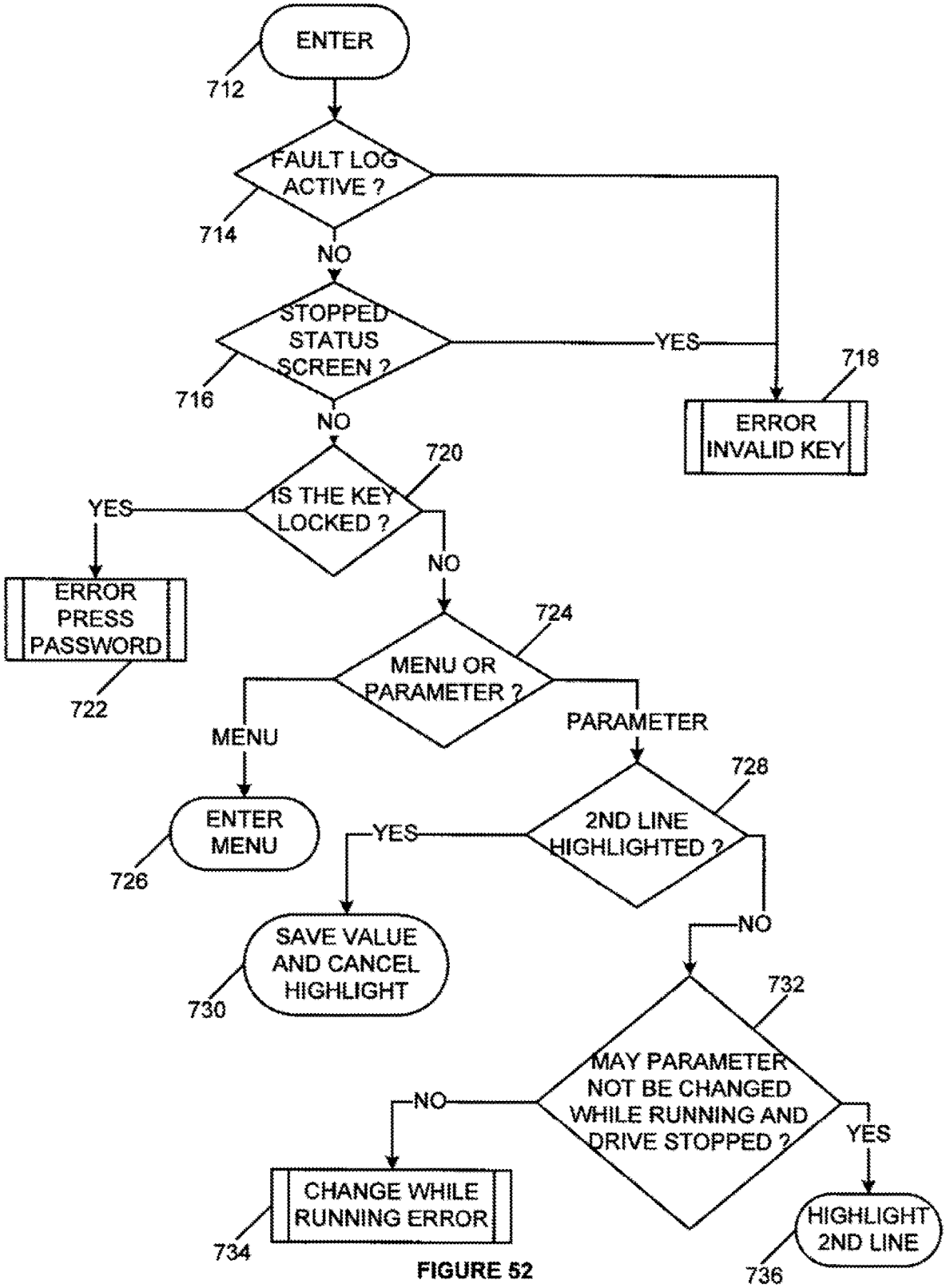
FIG. 52 is a flow chart illustrating an enter button control operation.

FIG. 52 illustrates an enter button control operation, according to some embodiments. When the enter button 56 is pressed (step 712), the controller 75 first determines if the fault log is active (e.g., being displayed) at step 714 or if the stopped status screen is being displayed (step 716). If either step 714 or step 716 is true, the controller 75 executes an invalid key error operation (step 718). If neither the fault log or stopped status screen are being displayed, the controller 75 determines if the control pad 14 is locked (step 720). If so, the controller 75 executes a keys locked error operation (step 722). If the control pad 14 is not locked, the controller 75 determines if the display currently selecting a menu option or a parameter (step 724). If the display is currently selecting a menu option, the controller 75 will enter the selected menu (step 726). If the display is currently selecting a parameter option, the controller 75 determines if the parameter is highlighted (step 728). If the parameter is highlighted, the controller 75 saves the value of the selected parameter and cancels the highlighting of the parameter (step 730). If, at step 728, the parameter is not highlighted, the controller 75 determines if the parameter can be changed with the motor is running and the drive 10 is stopped (step 732). If not, a running error operation is executed (step 734). If the parameter may be changed, then the selected parameter is highlighted (step 736).

Figure 53:
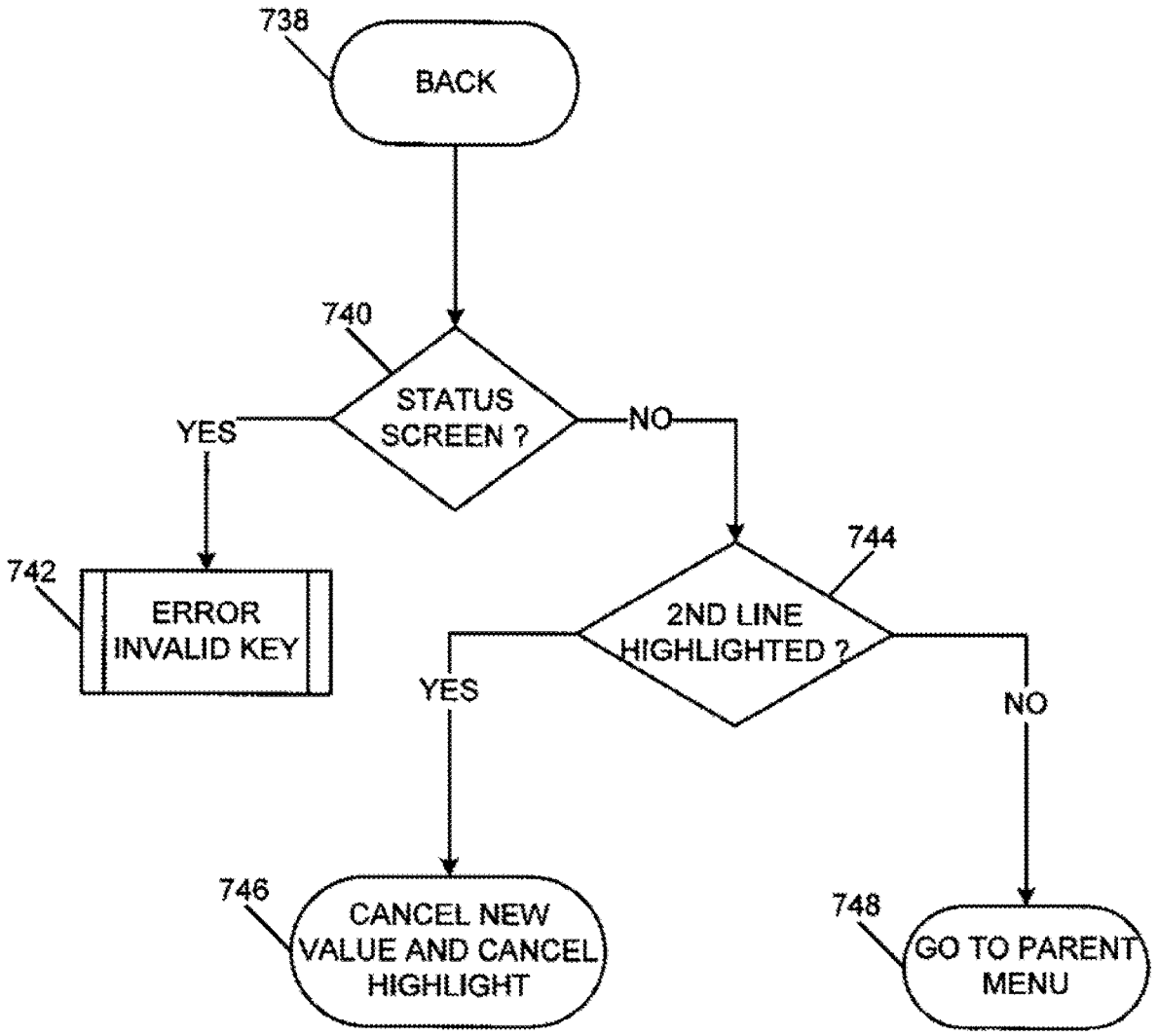
FIG. 53 is a flow chart illustrating a back button control operation.

FIG. 53 illustrates a back button control operation, according to some embodiments. When the back button 54 is pressed (step 738), the controller 75 determines if a status screen is being displayed (step 740). If so, an invalid key error operation is executed (step 742). If a status screen is not being displayed, the controller 75 determines if a line in the display is highlighted (step 744). If so, the new value on the highlighted line is cancelled and the highlighting is cancelled as well (step 746). If, at step 744, there is no highlighted line, the parent, or previous, menu is displayed (step 748).

Figure 54:
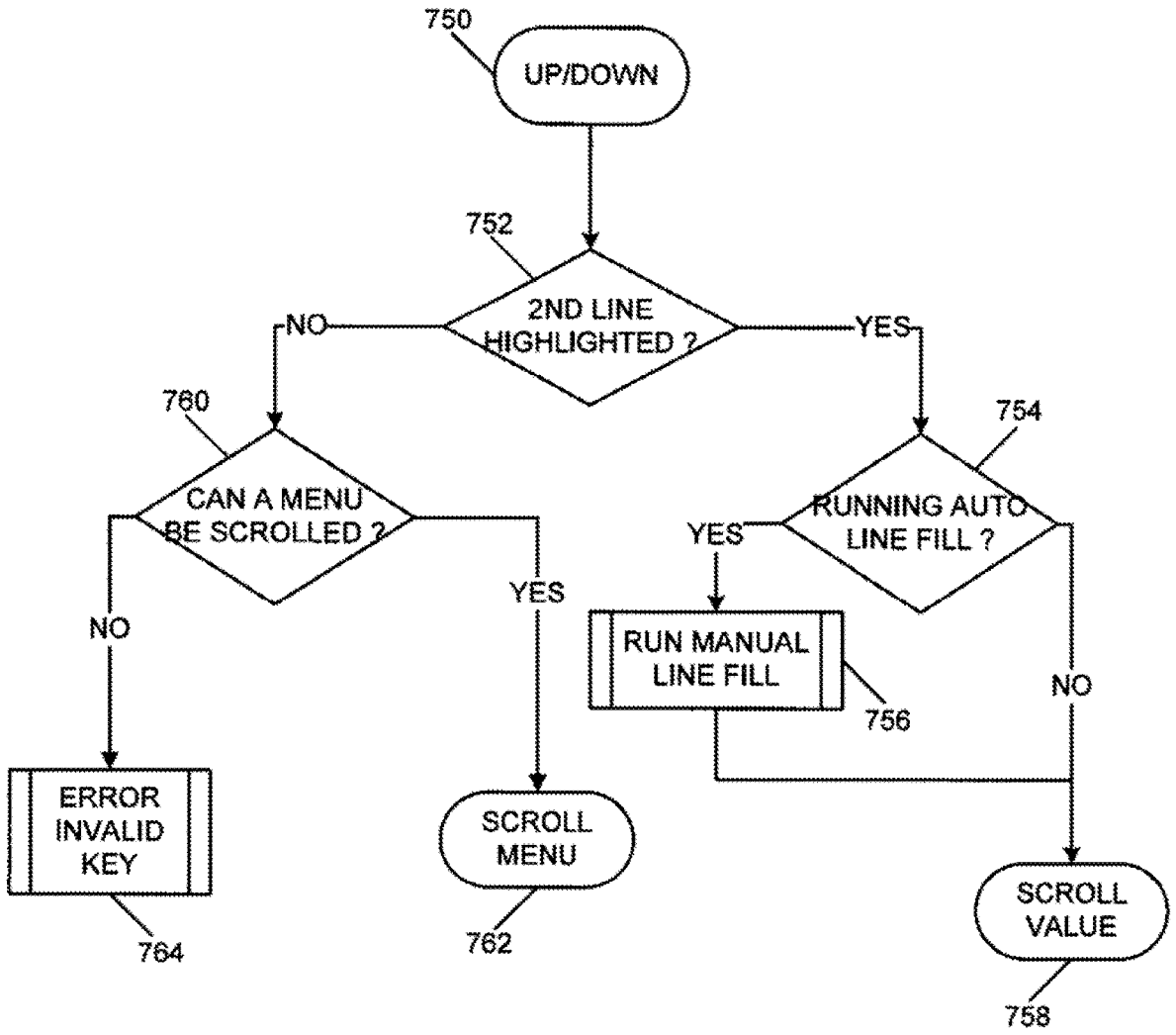
FIG. 54 is a flow chart illustrating an up/down button control operation.

FIG. 54 illustrates an up/down button control operation, according to some embodiments. When either the up or down directional button 52 is pressed (step 750), the controller 75 determines if a line in the display is highlighted (step 752). If so, the controller 75 then determines if the auto line fill operation is being executed (step 754). If so, the controller 75 proceeds to the manual line fill operation (step 756), as described with reference to FIG. 9, then scrolls to another value in the display (step 758). If the controller 75 determines that the auto line fill operation is not being executed at step 754, the controller 75 proceeds to step 758 and scrolls to another value in the display. If, at step 752, the controller 75 determines that no line is highlighted, the controller 75 then determines if a menu in the display can be scrolled (step 760). If so, the menu is scrolled (step 762). If not, an invalid key error operation is executed (step 764).

Figure 55:
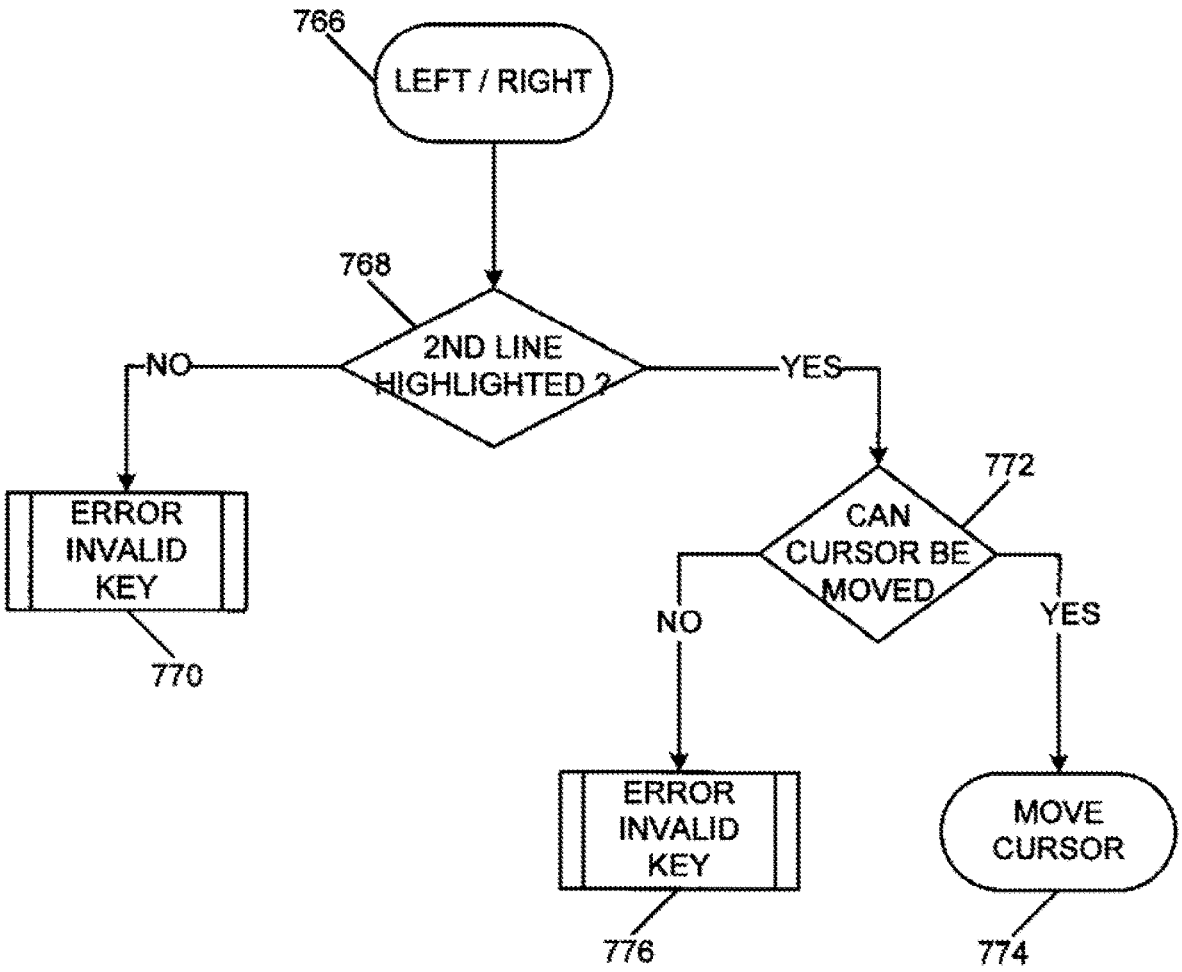
FIG. 55 is a flow chart illustrating a left/right button control operation.

FIG. 55 illustrates a left/right button control operation, according to some embodiments. When either the left or right directional button 52 is pressed (step 766), the controller 75 determines if a line in the display is highlighted (step 768). If not, an invalid key error operation is executed (step 770). If, at step 768, the controller 75 determines that the line is highlighted, the controller 75 then determines if a curser in the display can be moved (step 772). If so, the curser is moved (step 774). If not, an invalid key error operation is executed (step 776).

Figure 56:
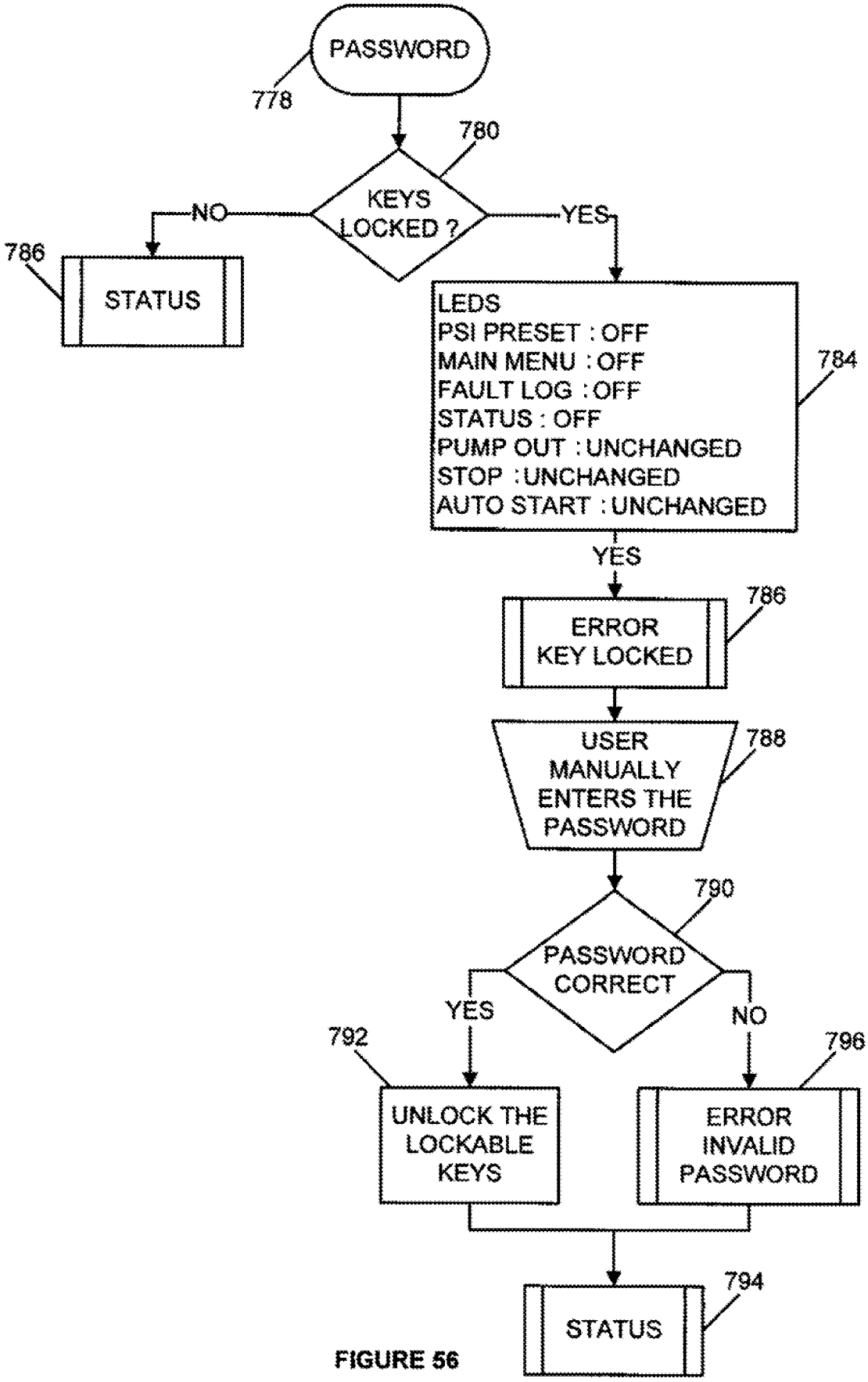
FIG. 56 is a flow chart illustrating a password button control operation.

FIG. 56 illustrates a password button control operation, according to some embodiments. When the password button 48 is pressed (step 778), the controller 75 first determines if the control pad 14 is locked (step 780). If not, a status screen is displayed (step 782). If the control pad 14 is locked, the controller 75 sets the LED indicators 66 on or off accordingly (step 784) and executes a keys locked error operation (step 786). If a user then enters a password (step 788), the controller 75 determines if the password is correct (step 790). If the password is correct, any lockable keys are unlocked (step 792) and the status screen is displayed (step 794). If the password is incorrect, an invalid password error operation is executed (step 796), then the status screen is displayed (step 794). In some embodiments, the lockable keys can include the directional buttons 52, the language button 50, the pump-out button 40, the pressure preset button 42, and/or the main menu button 44.

Figure 57:
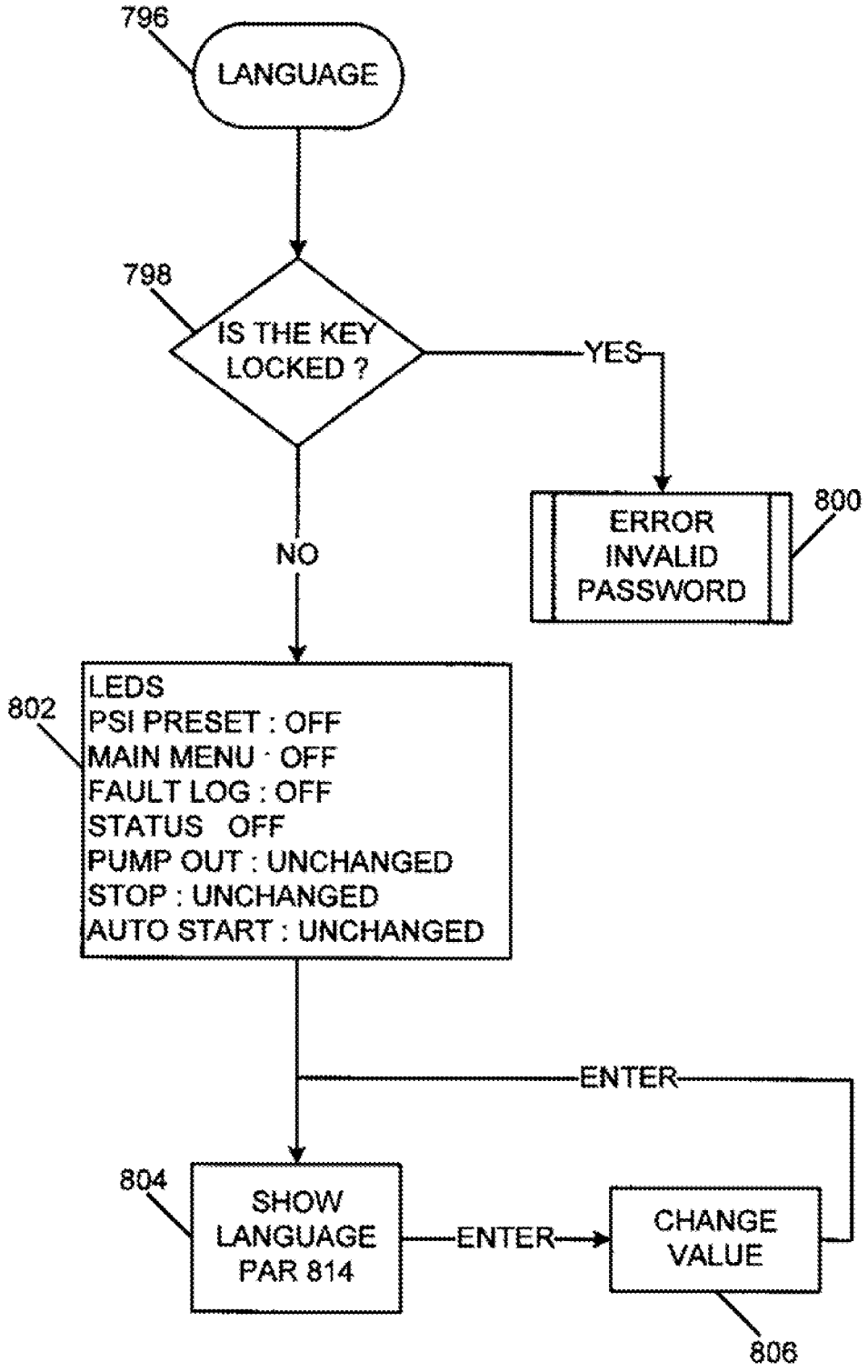
FIG. 57 is a flow chart illustrating a language button control operation.

FIG. 57 illustrates a language button control operation, according to some embodiments. When the language button 50 is pressed (step 796), the controller 75 first determines if the control pad 14 is locked (step 798). If so, the controller 75 executes a keys locked error operation (step 800). If the control pad 14 is not locked, the controller 75 sets the LED indicators 66 on or off accordingly (step 802) and a language parameter is displayed (step 804). The user can change the displayed language using the keypad and hit enter to update the language parameter (step 806).

Figure 58:
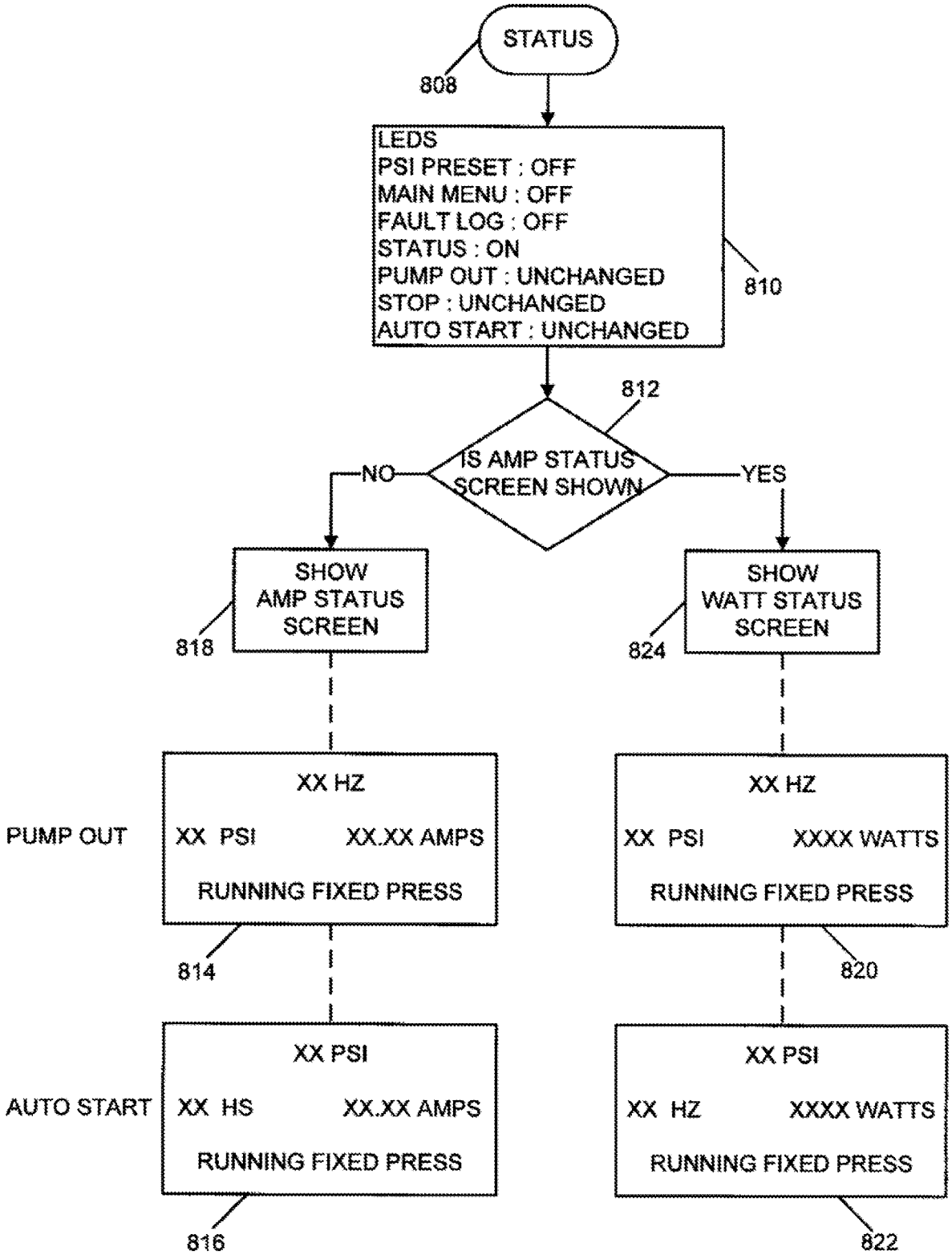
FIG. 58 is a flow chart illustrating a status button control operation.

FIG. 58 illustrates a status button control operation, according to some embodiments. When the status button 58 is pressed (step 808), the controller 75 sets the LED indicators 66 on or off accordingly (step 810) and determines if a current status screen is being displayed (step 812). If not, the current status screen 814 or 816 is displayed (step 818). If the controller 75, at step 812, determines that the current status screen is being displayed, the currents status screen is cleared and a power status screen 820 or 822 is displayed (step 824).

Figure 59:
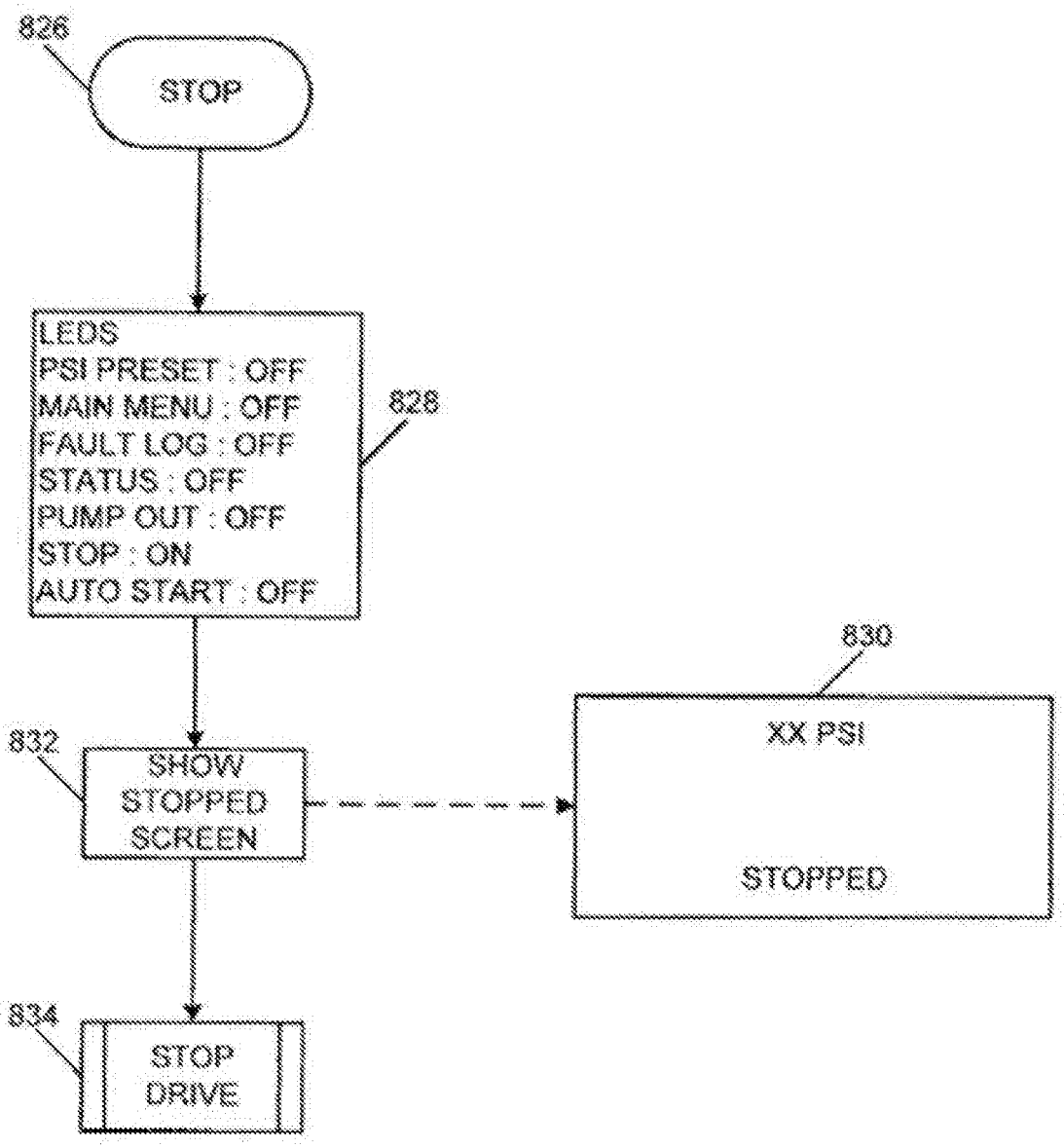
FIG. 59 is a flow chart illustrating a stop button control operation.

FIG. 59 illustrates a stop button control operation, according to some embodiments. When the stop button 60 is pressed (step 826), the controller 75 sets the LED indicators 66 on or off accordingly (step 828) and a stopped status screen 830 is displayed (step 832). The controller 75 then stops the drive 10 (step 834), as described with reference to FIG. 10.

Figure 60:
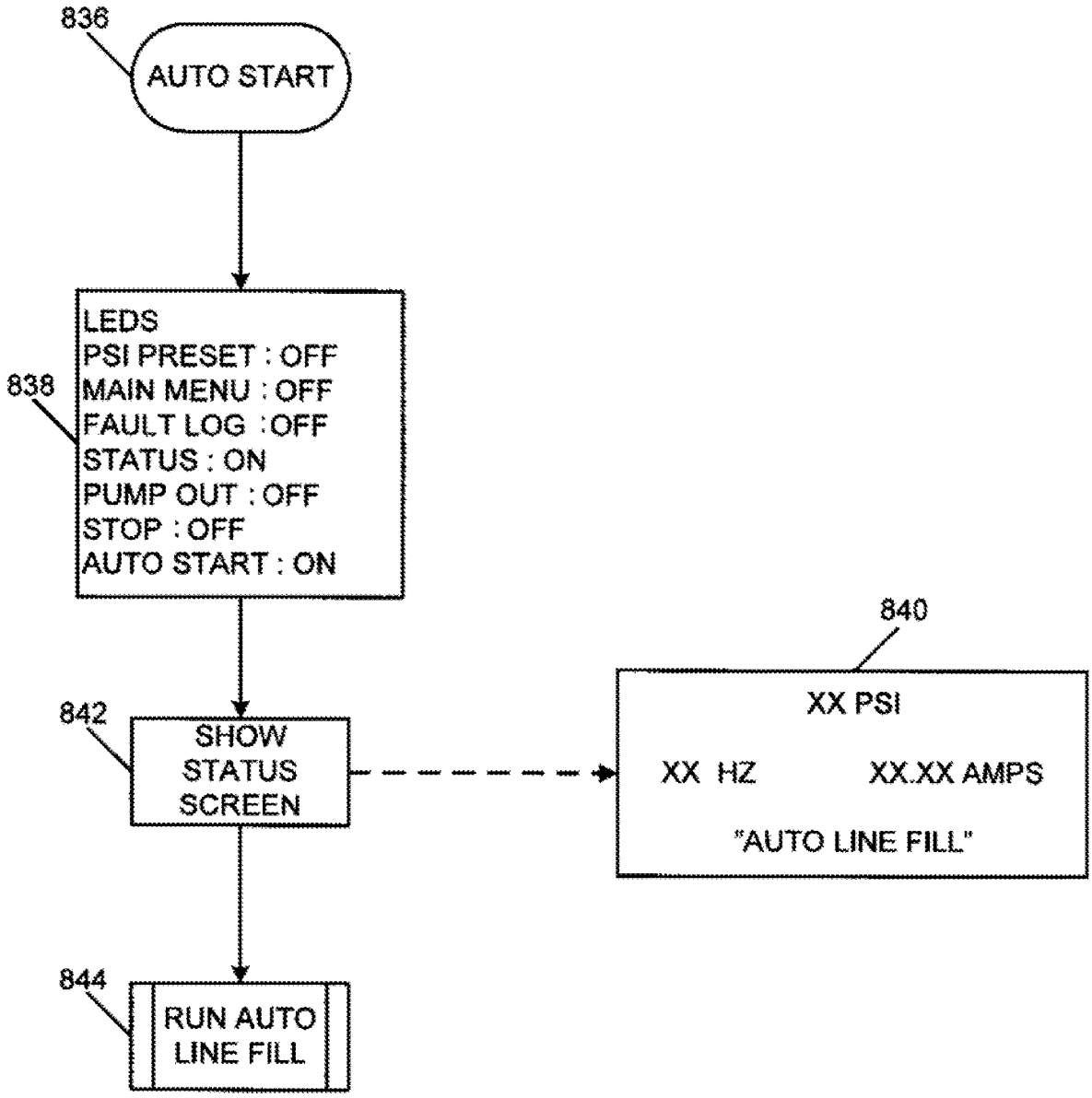
FIG. 60 is a flow chart illustrating an automatic start button control operation.

FIG. 60 illustrates an automatic start button control operation, according to some embodiments. When the automatic start button 62 is pressed (step 836), the controller 75 sets the LED indicators 66 on or off accordingly (step 838) and a status screen 840 is displayed (step 842). The controller 75 then runs the automatic line fill operation (step 844), as described with reference to FIG. 8.

Figure 61:
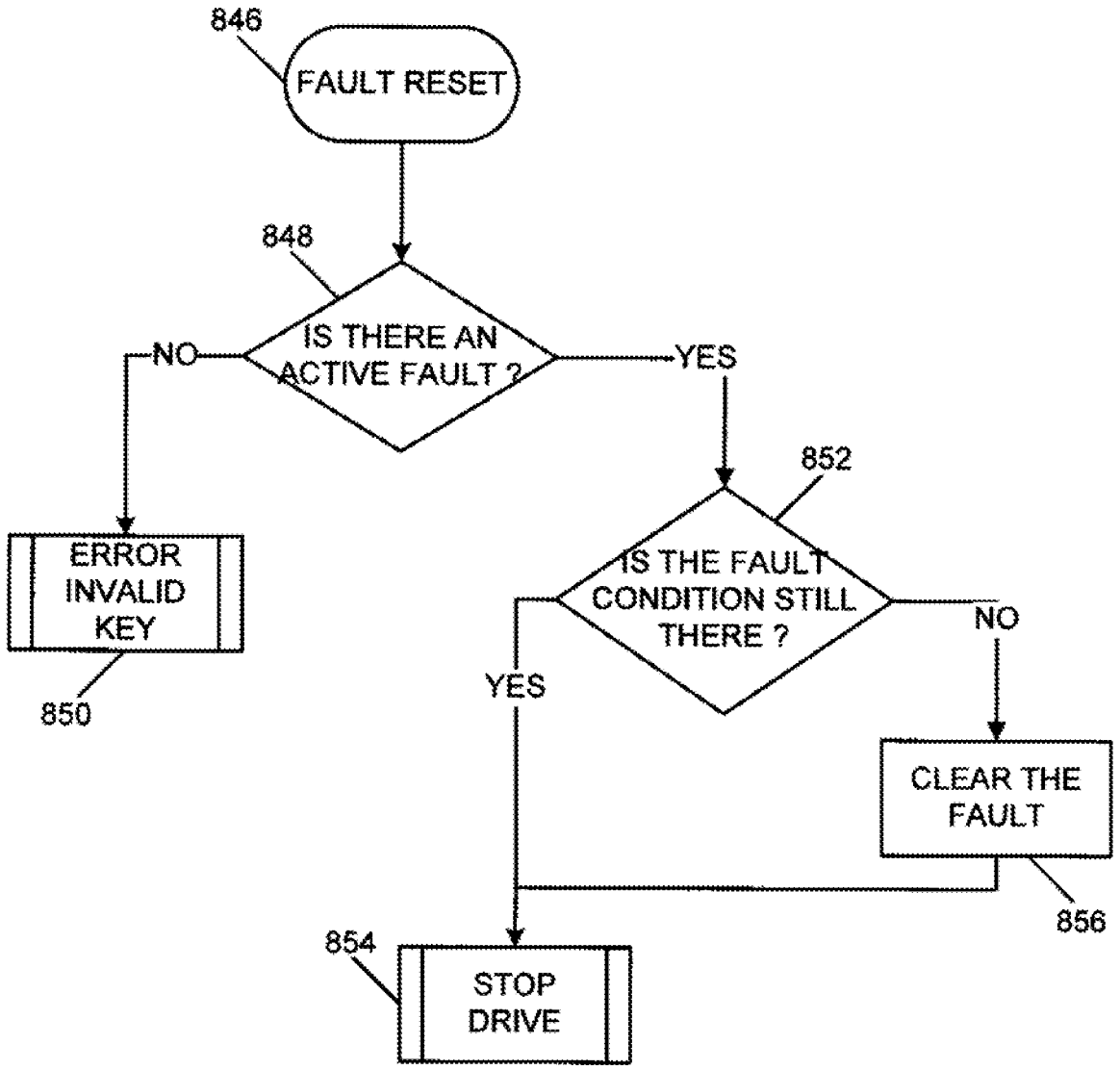
FIG. 61 is a flow chart illustrating a fault reset button control operation.

FIG. 61 illustrates a fault reset button control operation, according to some embodiments. When the fault reset button 64 is pressed (step 846), the controller 75 determines if there is an active fault (step 848). If not, the controller 75 executes an invalid key error operation (step 850). If there is an active fault, the controller 75 determines if the fault condition is still present (step 852). If so, the controller 75 stops the drive 10 (step 854), as described with reference to FIG. 10. If not, the controller 75 first clears the fault (step 856), then stops the drive 10 (step 854).

Figure 62A:
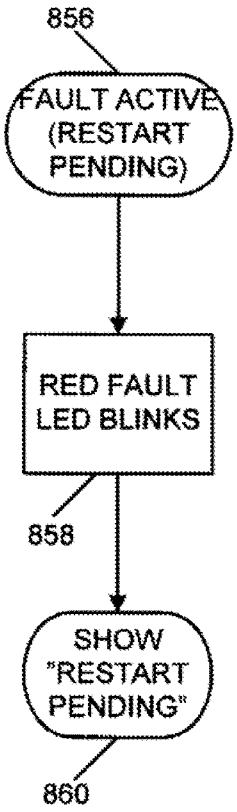
FIGS. 62A-62D are flow charts illustrating LED indicator control operations.
Figure 62B:
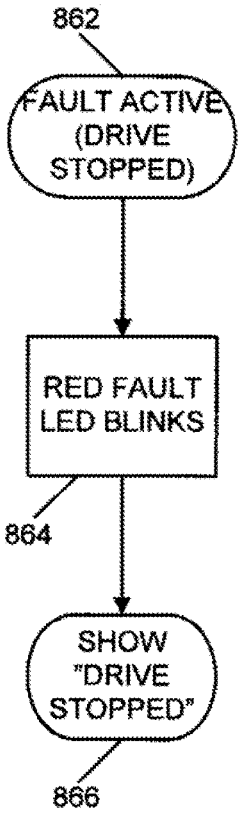
Figure 62C:
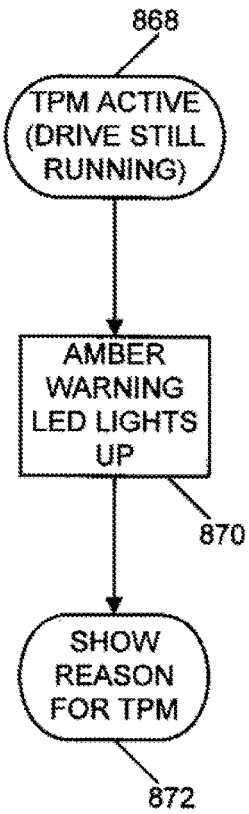
Figure 62D:
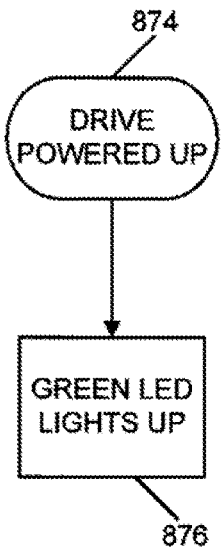

FIGS. 62A-62D illustrate LED indicator control operations, according to some embodiments. As shown in FIG. 62A, if a fault is active and a restart is pending (step 856), the Fault LED 72 blinks (step 858), and a "Restart Pending" message is displayed (step 860). As shown in FIG. 62B, if a fault is active and the drive 10 is stopped (step 862), the Fault LED 72 blinks (step 864), and a "Drive Stopped" message is displayed (step 866). As shown in FIG. 62C, if a TPM is active and the drive 10 is still running (step 868), the Warning LED 70 is lit (step 870), and a message is displayed describing the warning (step 872). As shown in FIG. 62D, when the drive 10 is powered up (step 874), the ON LED 68 is lit (step 876).

Figure 63A:
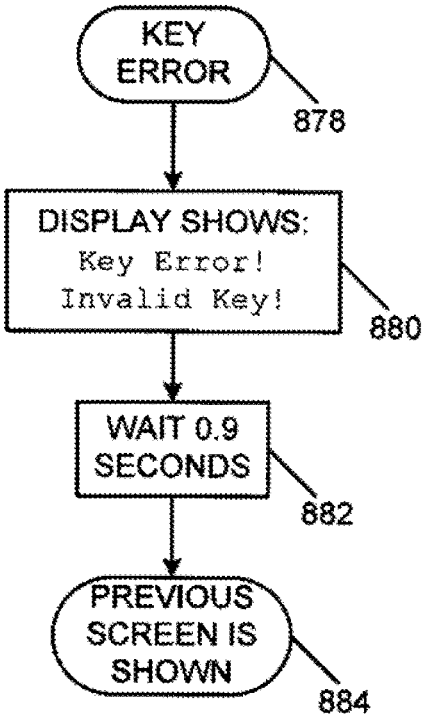
FIGS. 63A-63D are flow charts illustrating error display control operations.
Figure 63B:
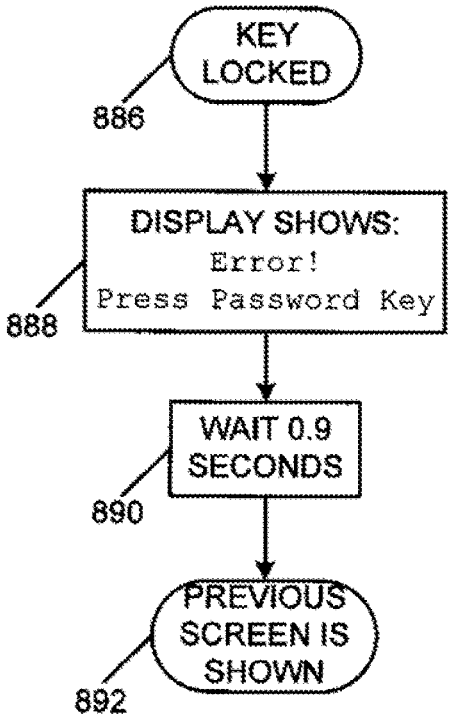
Figure 63C:
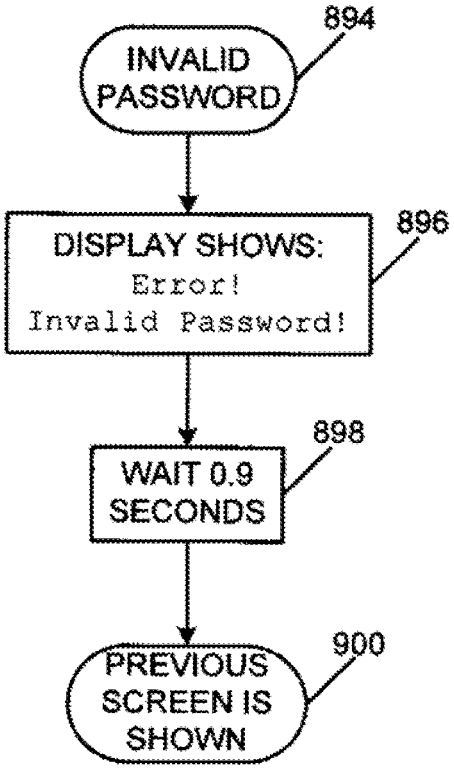
Figure 63D:
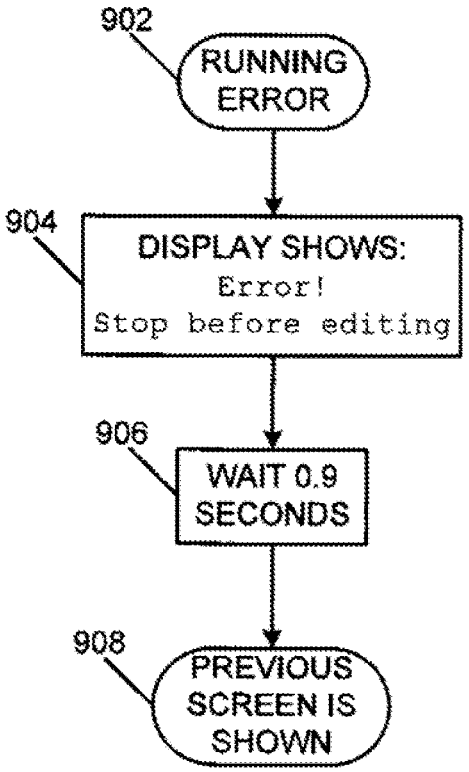

FIGS. 63A-63D illustrate error display control operations, according to some embodiments. As shown in FIG. 63A, for the invalid key error operation (step 878), a "Key Error! Invalid Key!" error screen can be displayed (step 880). The controller 75 can display the error screen for a time period, such as 0.9 seconds (step 882), then return the display to the previous screen (step 884). As shown in FIG. 63B, for the keys locked error operation (step 886), an "Error! Press Password Key" error screen can be displayed (step 888). The controller 75 can display the error screen for a time period, such as 0.9 seconds (step 890), then return the display to the previous screen (step 892). As shown in FIG. 63C, for the invalid password error operation (step 894), an "Error! Invalid Password!" error screen can be displayed (step 896). The controller 75 can display the error screen for a time period, such as 0.9 seconds (step 898), then return the display to the previous screen (step 900). As shown in FIG. 63D, for the running error operation (step 902), an "Error! Stop before editing" error screen can be displayed (step 904). The controller 75 can display the error screen for a time period, such as 0.9 seconds (step 906), then return the display to the previous screen (step 908).

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A controller for a pump driven by a motor, the pump in fluid communication with a fluid system, the controller comprising:

a variable frequency drive circuit that controls operation of the pump;

and a control panel connected to the variable frequency drive circuit, the control panel including an automatic start button and a stop button, the variable frequency drive circuit configured to automatically operate in a line fill mode when the automatic start button is engaged, the line fill mode including a first ramp up period, and a second ramp up period, the variable frequency drive circuit configured to gradually increase a frequency of the pump at a first rate during the first ramp up period, the variable frequency drive circuit configured to gradually increaseing the frequency of the pump at a second rate during the second ramp up period, the variable frequency drive circuit configured to determine the line fill mode is complete by determining that a pressure setpoint in the fluid system is reached, the variable frequency drive circuit configured to automatically operate in a PID mode after the line fill mode is complete, and the variable frequency drive circuit configured to disable the pump when the stopbutton is engaged.

2. The controller of claim 1, wherein the variable frequency drive circuit operates in the first ramp up period of the line fill mode for a first time period when the pump starts, and the variable frequency drive circuit operates in the second ramp up period of the line fill mode after the first time period has elapsed.

3. The controller of claim 2, wherein the variable frequency drive circuit operates the motor within a first frequency range during the first ramp up period and second frequency range during the second ramp up period.

4. The controller of claim 3, wherein the variable frequency drive circuit operates the motor at a normal frequency in order to maintain a normal pressure set point after the line fill mode is complete.

5. The controller of claim 1, wherein the variable frequency drive circuit automatically starts and operates in the line fill mode after a power interruption when the automatic start button is engaged.

6. The controller of claim 1, wherein the first rate of gradually increasing the frequency of the pump is higher than the second rate of gradually increasing the frequency of the pump.

7. The controller of claim 1, wherein a first operating frequency range of the first ramp up period is lower than a second operating frequency range of the second ramp up period.

8. The controller of claim 7, wherein the first operating frequency range of the pump during the first ramp up period is between 0 Hz to 45 Hz.

9. The controller of claim 7, wherein the second operating frequency range of the pump during the second ramp up period is between 45 Hz to 55 Hz.

10. The controller of claim 2, wherein the pressure in the fluid system at the end of the first ramp up period is less than the pressure set point of the fluid system.

11. A controller for a pump driven by a motor, the pump in fluid communication with a fluid system, the controller comprising:

a variable frequency drive circuit that controls operation of the pump;

and a control panel connected to the variable frequency drive circuit, the control panel including an automatic start button and a stop button, the variable frequency drive circuit configured to automatically operate the motor at a low frequency for a first time period when the pump starts when the automatic start button is engaged, the variable frequency drive circuit configured to gradually increase the low frequency at a first rate during the first time period when the pump starts, the variable frequency drive circuit configured to disable the pump when the stop button is engaged, the variable frequency drive circuit configured to monitor a pressure using a pressure transducer and adjust an operating frequency of the motor to gradually increase the operating frequency at a second rate after the first time period until the pressure corresponds to a line filled pressure, and the variable frequency drive circuit configured to maintain the pressure at a pressure set point after the pressure corresponds to the line filled pressure.

12. A method of controlling a pump driven by a motor, the pump in fluid communication with a fluid system, the method comprising:

monitoring a power input of the pump;

monitoring a pressure in the fluid system;

adjusting an operating frequency of the motor using a variable frequency circuit;

determining when the pump starts based on the monitored power input of the pump;

determining whether the pressure in the fluid system is below a pressure set point of the fluid system;

in response to the pressure in the fluid system being below the pressure set point, operating the pump in a line fill mode by causing the variable frequency circuit to gradually increase the operating frequency of the motor at a first rate until the pressure set point of the fluid system is reached; and based on the pressure set point of the fluid system being reached, causing the pump to operate in a PID mode.

13. The method of claim 12 further comprising:

starting a first ramp up period when the pump starts; and starting a second ramp up period after determining that the first ramp up period is complete and the pressure in the fluid system is below a pressure set point of the fluid system.

14. The method of claim 13 further comprising:

determining whether the pressure in the fluid system is below the pressure set point of the fluid system after the second ramp up period is complete; and starting a third ramp up period if the pressure in the fluid system is below the pressure set point in the fluid system after the second ramp up period is complete.

15. The method of claim 13, further comprising the variable frequency circuit increasing the operating frequency of the motor at a faster rate during the first ramp up period than during the second ramp up period.

16. The method of claim 13, further comprising:

the variable frequency circuit gradually increasing the operating frequency from 0 Hz to 45 Hz during the first ramp up period; and the variable frequency circuit gradually increasing the operating frequency of the motor from 45 Hz to 55 Hz during the second ramp up period.

17. The method of claim 13, wherein the first ramp up period is complete when a first time period has elapsed.

18. The method of claim 13, wherein the second ramp up period is complete when the pressure set point is reached.

19. The method of claim 13, wherein the second ramp up period is complete only when the pressure set point is reached and a second time period has elapsed.

20. The method of claim 14, further comprising disabling the pump based on determining the pressure in the fluid system is below the pressure set point after the third ramp up period is complete.

* * * * *